US012352027B2

(12) United States Patent
Erickson

(10) Patent No.: US 12,352,027 B2
(45) Date of Patent: Jul. 8, 2025

(54) DEVICE FOR DRAIN FILTRATION AND/OR HAIR COLLECTION AND EJECTING WASTE OBJECTS

(71) Applicant: Revel Innovations, LLC, Boone, IA (US)

(72) Inventor: Nicholas Hans Erickson, Boone, IA (US)

(73) Assignee: Revel Innovations, LLC, Boone, IA (US)

( * ) Notice: Subject to any disclaimer, the term of this patent is extended or adjusted under 35 U.S.C. 154(b) by 0 days.

(21) Appl. No.: 18/438,344

(22) Filed: Feb. 9, 2024

(65) Prior Publication Data

US 2024/0183139 A1 Jun. 6, 2024

Related U.S. Application Data

(63) Continuation-in-part of application No. 18/143,600, filed on May 4, 2023.

(60) Provisional application No. 63/364,111, filed on May 4, 2022.

(51) Int. Cl.
*E03C 1/264* (2006.01)

(52) U.S. Cl.
CPC ..... *E03C 1/264* (2013.01)

(58) Field of Classification Search
CPC ..... A47K 1/14; E03C 1/264
See application file for complete search history.

(56) References Cited

U.S. PATENT DOCUMENTS

| | | | | |
|---|---|---|---|---|
| 3,982,289 | A * | 9/1976 | Robbins | E03C 1/264 4/292 |
| 7,832,027 | B2 * | 11/2010 | Escobar | E03C 1/262 4/290 |
| 9,963,862 | B2 * | 5/2018 | Carpenter-Crawford | E03C 1/264 |
| 10,570,594 | B2 * | 2/2020 | Karnegie | E03C 1/262 |
| 2009/0094766 | A1 * | 4/2009 | Dombrowski | E03C 1/126 15/105 |
| 2021/0235940 | A1 * | 8/2021 | Hyde | A47K 1/08 |

OTHER PUBLICATIONS

Catapult drain strainer, published in YouTube on May 2, 2022 [online], Retrieved on Feb. 8, 2025 from URL: https://www.youtube.com/watch?v=QfBEp-2x7vg.
Catapult Sink Strainer, published in YouTube on Mar. 22, 2023 [online], Retrieved on Feb. 8, 2025 from URL: https://www.youtube.com/watch?v=6NiF_4Qnhrw.
Speed Drain Shower Strainer, published in You Tube on Mar. 22, 2023 [online], Retrieved on Feb. 7, 2025 from URL: https://www.youtube.com/watch?v=MdlYhWhwOd8.
Speed Drain, published in You Tube on May 2, 2022 [online], Retrieved on Feb. 7, 2025 from URL: https://www.youtube.com/watch?v=Ng9w70EFKa8.

* cited by examiner

*Primary Examiner* — Janie M Loeppke
(74) *Attorney, Agent, or Firm* — Brett A. Schenck

(57) ABSTRACT

A drain strainer is provided that includes a basket. The basket defines a central cavity and includes perforations that are sized to enable liquid to drain through the basket while debris is collected in the basket. The drain strainer is configured to be preloaded to a potential energy state and upon the drain strainer being released from the potential energy state the potential energy converts to kinetic energy that is sufficient to eject the debris from the basket.

30 Claims, 61 Drawing Sheets

DEVICE FOR DRAIN FILTRATION AND/OR HAIR COLLECTION AND EJECTING WASTE OBJECTS

CROSS-REFERENCE TO RELATED APPLICATIONS

This application is a continuation-in-part of U.S. patent application Ser. No. 18/143,600 filed on May 4, 2023, which claims benefit under 35 U.S.C. § 119(e) of Provisional Application No. 63/364,111 filed May 4, 2022, the disclosure of which is incorporated by reference in its entirety.

FIELD OF THE INVENTION

This application relates to a device for drain filtration and/or hair collection and ejecting waste objects. More particularly, this application relates to a strainer for drains on showers, bathtubs, and sinks that collects hair and/or other objects before going down the drain. Additionally, this application includes a method to quickly eject the waste objects caught by the strainer without touching the waste objects with your hands or fingers.

BACKGROUND OF THE INVENTION

Currently there are a number of solutions for drain strainers, in particular shower or bath strainers and sink strainers. Most of the solutions feature a cylindrical or coned device that sits atop the drain, flat or elevated, and feature numerous protrusions to allow water to pass through, but not other objects or hair. While some of these solutions seem to prevent most of the hair and objects from escaping into the drain, they do not catch all of it. Another problem with these solutions is removing the hair and waste from the device after it is collected on or around the strainer. These devices require the user to remove the hair and waste from the strainer using their fingers to collect the hair from the device in order to dispose of it. Many users find this action disgusting and undesirable. Another variation of this device features a plug type of unit that is inserted into the drain fixture. It features an inset tubular sleeve with holes to allow water to pass through while preventing hair and objects to pass. This solution also allows some hair and objects past its strainer and also requires the user to use their fingers to dislodge and remove the hair and waste in order to dispose of it.

It is desirable to have a device that prevents nearly all objects and hair from entering a drainpipe when draining water from a shower, bathtub, sink, or other body of water. It is also desirable to collect the objects in a common area or cavity. It is also desirable to be able to empty the objects collected in the common area or cavity without touching the objects with your hands or fingers, since most people are disgusted by doing so. It is also desirable to eject or propel the objects away from the common area or cavity so as to easily dispose the objects into a trash container or other suitable storage container.

SUMMARY OF THE INVENTION

In one aspect of the present invention, a drain strainer is provided that includes a basket. The basket defines a central cavity and includes perforations that are sized to enable liquid to drain through the basket while debris is collected in the basket. The drain strainer is configured to be preloaded to a potential energy state and upon the drain strainer being released from the potential energy state the potential energy converts to kinetic energy that is sufficient to eject the debris from the basket.

Other aspects of the disclosed invention will become apparent from the following detailed description, the accompanying drawings and the appended claims.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

FIG. 19 is a schematic side and bottom perspective view a portion of the drain strainer of FIG. 1 showing an embossed hole with hair curling rather than passing through.

FIG. 119 is a side view of the grip collar of the drain strainer of FIG. 118.

FIG. 120 is a sectional view taken along line A-A of FIG. 119.

FIG. 121 is a side view of the drain strainer of FIG. 118.

FIG. 122 is an enlarged part surrounded by circle B of FIG. 123.

FIG. 123 is a sectional view taken along line A-A of FIG. 121.

DETAILED DESCRIPTION OF THE INVENTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1:
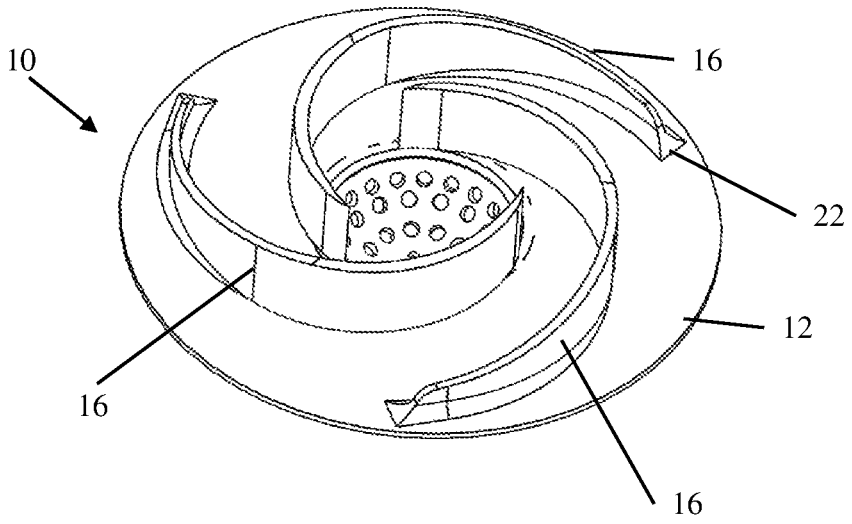
FIG. 1 is a perspective view of a drain strainer of a first embodiment according to the present invention.

Throughout the present description, the terms "upper", "lower", "top", "bottom", "left", "right", "front", "forward", "rear", and "rearward" shall define directions or orientations with respect to the apparatus as illustrated in FIG. 1, which shows a top and side perspective view of an embodiment of the drain strainer of the present invention. It will be understood that the spatially relative terms "upper", "lower", "top", "bottom", "left", "right", "front", "forward", "rear", and "rearward" are intended to encompass different orientations of the apparatus in use or operation in addition to the orientation depicted in the figures. For example, if the apparatus in the figures is turned over, elements described as "upper" elements or features would then be "lower" elements or features.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The device for drain filtration and/or hair collection and ejecting waste objects may, however, be embodied in many different forms and should not be construed as being limited to the embodiments set forth herein; rather, these embodiments are provided by way of illustration only and so that this disclosure will be thorough, complete and fully convey understanding to those skilled in the art.

Figure 2:
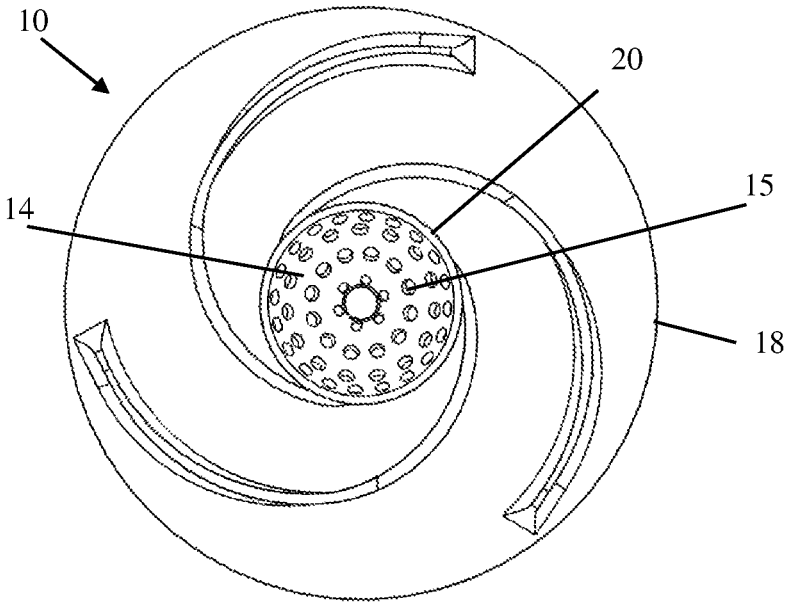
FIG. 2 is a top view of the drain strainer of FIG. 1.
Figure 3:
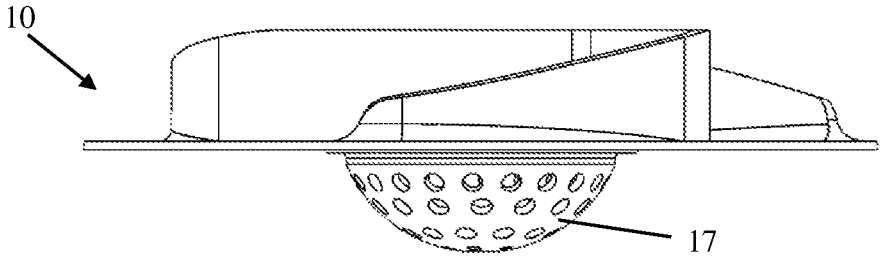
FIG. 3 is a side view of the drawing strainer of FIG. 1

Referring to FIGS. 1-3, a drain strainer 10 is provided which comprises a circular base flange 12 that sits in the base of a tub, shower, or other liquid storage container. The base flange 12 is relatively flat at an outer diameter of the base flange 12, and then transitions to a depressed central common area or cavity 14 (FIG. 2) that is defined by a basket 17 with perforations 15 within the basket 17. The drain strainer 10 further comprises three upwardly vertical protrusions 16 that originate near the outer diameter or edge 18 of the base flange 12 and spiral or curve in towards the center to the outer edge 20 of the cavity 14. Each protrusion 16 is c-shaped and has a base 22 that mounts or is formed on the base flange 12 and tapers a partial distance going upwardly from the bottom side of the protrusion 16. The base flange 12 is made of a soft, rubber-like material with an approximate outside diameter of 4" but may also feature other variations of this dimension. Inset a bit from the outer diameter or edge 18 of the base flange 12, the three vertical protrusions 16 begin an incline to their full height in a spiral fashion towards the central axis of the drain strainer 10 and stop around 1.75" from the axis but may also feature other variations of this dimension. At this approximate dimension, the base flange 12 transitions into the central common area or cavity 14.

Figure 7:
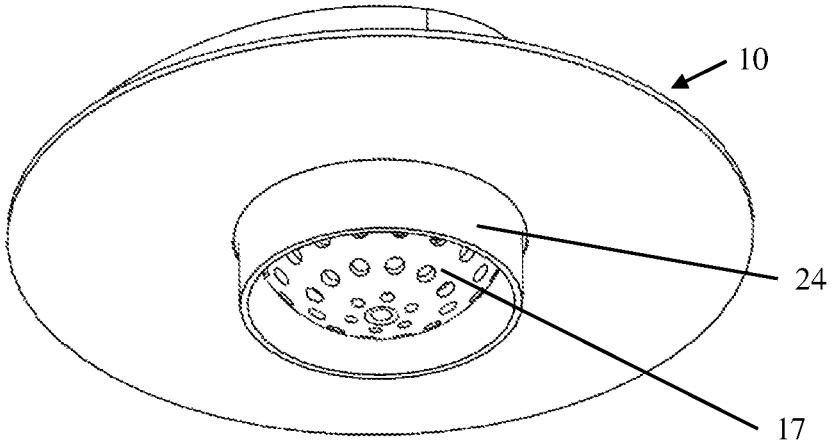
FIG. 7 is a bottom perspective view of a version of a drain strainer with a cylindrical reinforcement ring.

The depressed central cavity 14 features a downward semi-circular shape and has the perforations 15 located in multiple areas of the cavity 14. The basket 17 rests within the opening of a drain flange. Within the cavity 14, rows of the perforations 15 line the upper, mid, and lower wall of the basket 17. On the bottom side of the basket 17 there may be embossed cylindrical walls (FIG. 19) around each perforation, giving each perforation an additional thickness. Along the outer edge 20 of the cavity 14, a downward vertical sleeve 24 (FIG. 7) may protrude downwardly from the base flange 12 and incorporates a reinforcement sleeve in the molded material. An alternative drains strainer 11 may be provided that has on the bottom surface of the basket 17, a flat-shaped pull tab 28 (FIG. 5) that protrudes downward and features a fattened grip structure 30 among its flat surface. The top flange 12 and the basket 17 are made of a silicone or a Thermoplastic elastomers (TPE) type of material that has flexibility. The soft, rubber-like material of the central basket 17 allows the basket 17 to be stretched and when the pull tab 28 on the bottom of the basket 17 is pulled, the basket 17 stretches and stores potential energy. Upon release of the pull tab 28, the potential energy is converted to mechanical energy and propels the contents within the cavity 14 outward. This unique feature allows a user to aim and discharge the contents within the central cavity 14 in a quick, efficient motion without touching the contents within the cavity 14.

Figure 8:
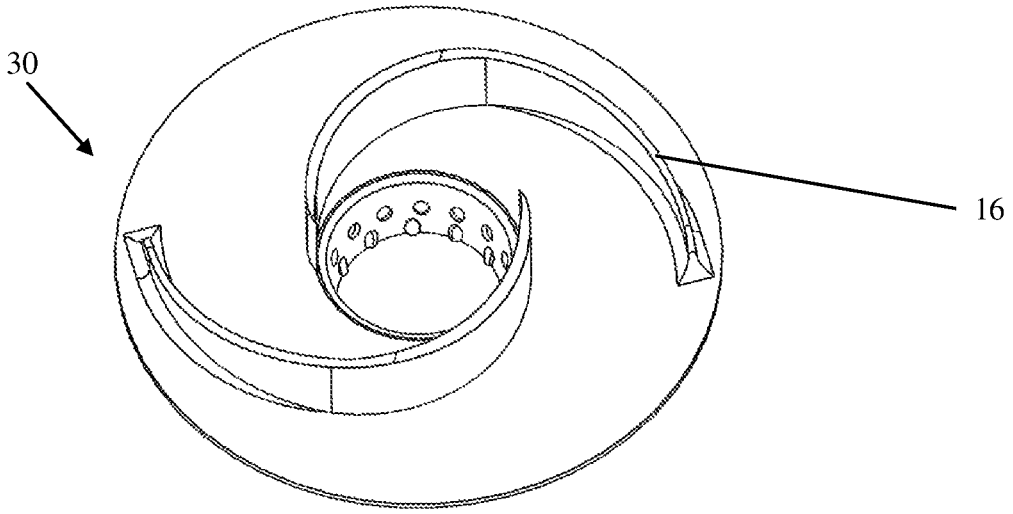
FIG. 8 is a top perspective view of a version of a drain strainer of FIG. 1 with two vertical projections in spiral formation.
Figure 9:
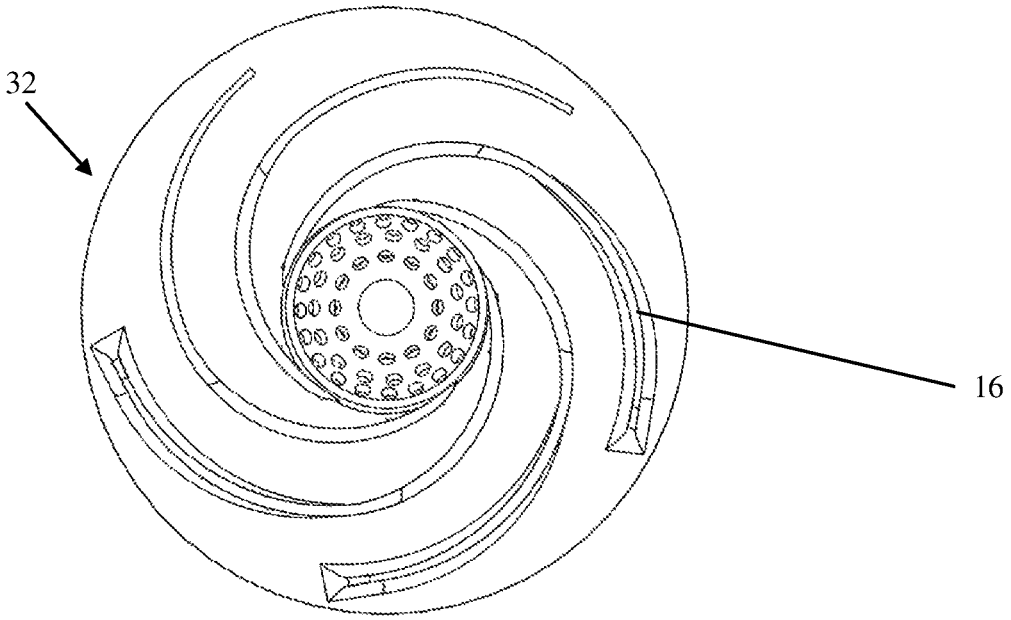
FIG. 9 is a top perspective view of a version of a drain strainer with five vertical projections in spiral formation.
Figure 13:
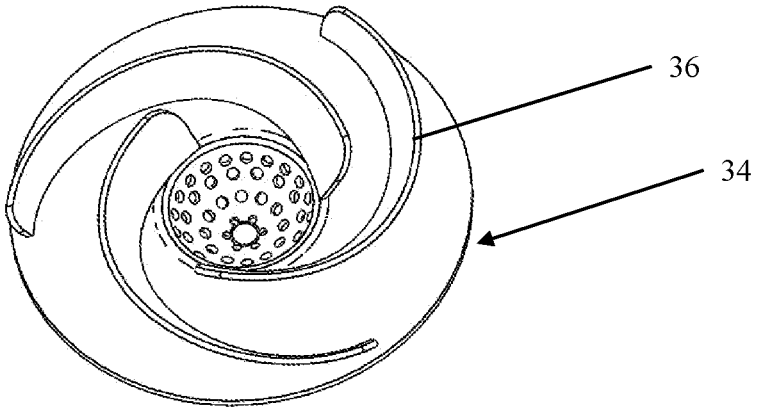
FIG. 13 is a top perspective view of the drain strainer of FIG. 1 but with the spiral protrusions being slanted.

The drain strainer 10 may also have one or more of the following features. Specifically, the drain strainer 10 may comprise a base flange that has two or more upwardly extending vertical protrusions that are spiral or slanted to direct water flow in a prescribed manner. In an alternate version, instead of three vertical protrusion, FIG. 8 shows a drain strainer 30 that has two vertical protrusions that spiral or curve in towards the center to the outer edge 20 of the cavity 14. FIG. 9 shows an alternate version of a drain strainer 32 that has five vertical protrusions 16 that spiral or curve in towards the center to the outer edge 20 of the cavity 14. The number of spiral protrusions may be different than two, three or five. The upwardly vertical spiral or slanted protrusions 16 may include inclines from the base flange at both beginning and end locations. The upward vertical spiral or slanted protrusions may also have an upward nature that is perpendicular to the base flange. Alternatively, the protrusions may be protrusions 36 that are slanted upwardly or tilted so as to not be perpendicular in nature, such as a 45 degree angle or any other variation of degrees as shown for example in FIG. 13, and may also feature an irregular or curved shape. The upward vertical protrusions may be arranged in slant-like patterns (FIG. 13) or short semi-circular arrangements rather than solely having a spiral shape.

Figure 10:
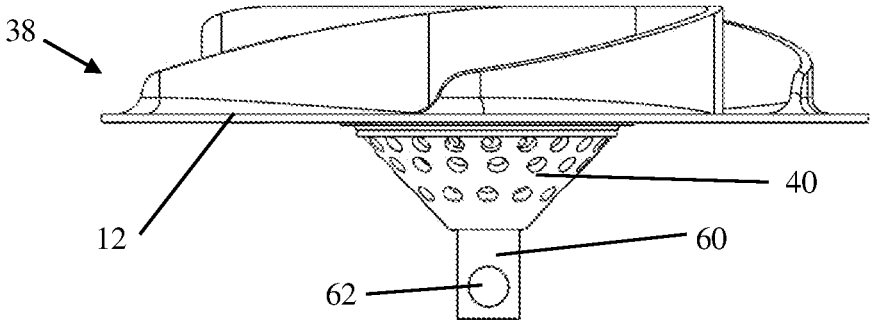
FIG. 10 is a side view of a version of a drain strainer with a V-shaped basket at a central common area and with a tension pull tab having a hole in the tension pull tab.
Figure 11:
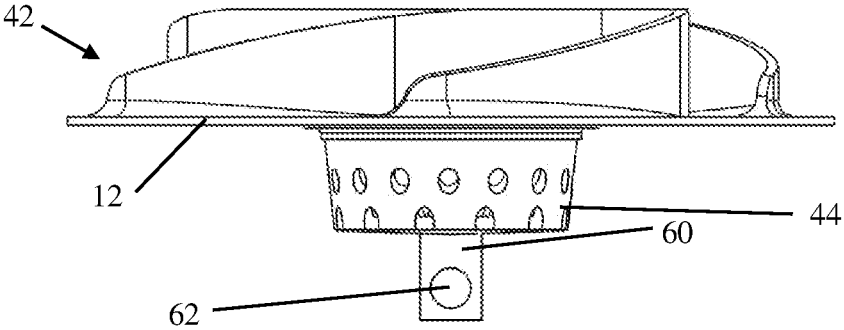
FIG. 11 is a side view of a version of a drain strainer with a U-shaped basket at a central common area and with a tension pull tab having a hole in the tension pull tab.
Figure 12:
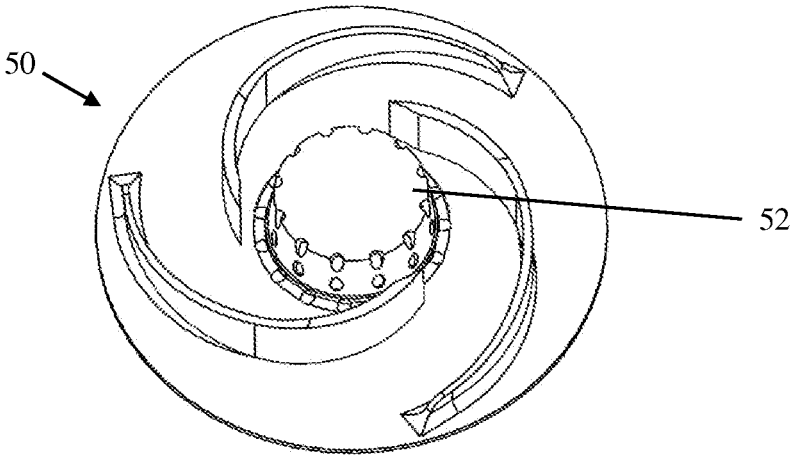
FIG. 12 is a top perspective view of a version of a drain strainer with a basket configuration extending upwardly at a central common area and having its access opening facing downwardly.
Figure 23:
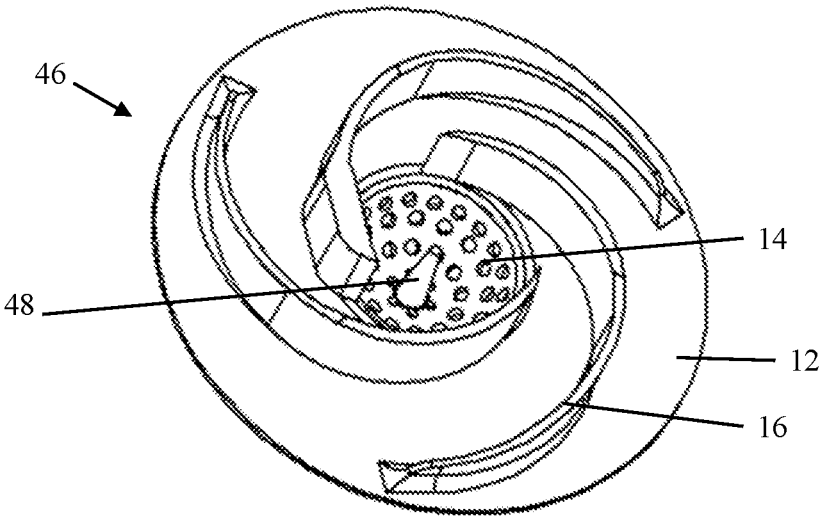
FIG. 23 is top perspective view of a drain strainer version showing a spindle.
Figure 24:
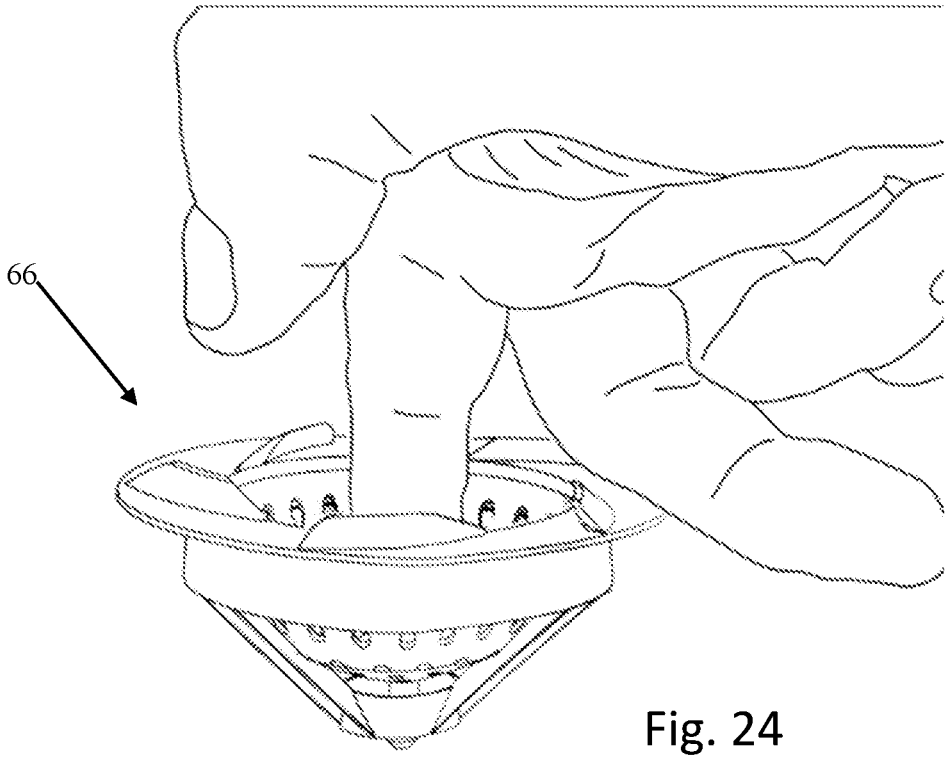
FIG. 24 is a side perspective view of a version of the drain strainer having a plunger being pushed by a user for use in a sink.
Figure 25:
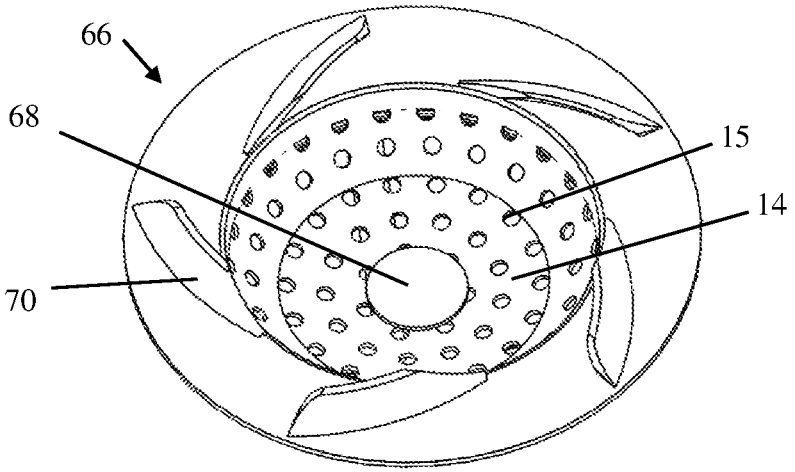
FIG. 25 is a top perspective view of the drain strainer of FIG. 24.
Figure 26:
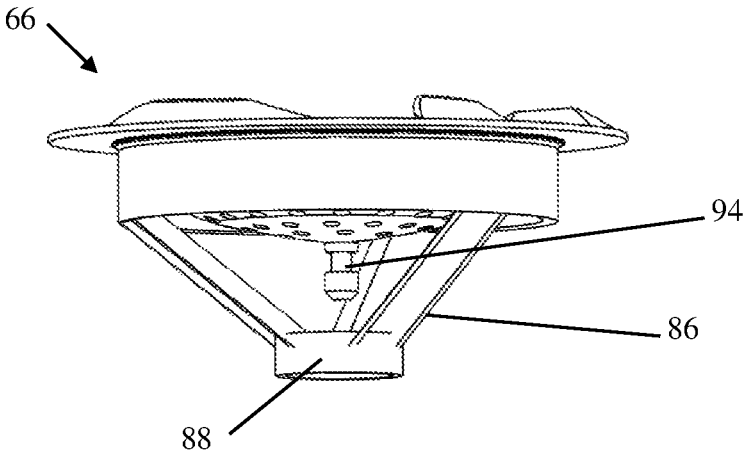
FIG. 26 is a bottom and side perspective view of the drain strainer of FIG. 24.
Figure 27:
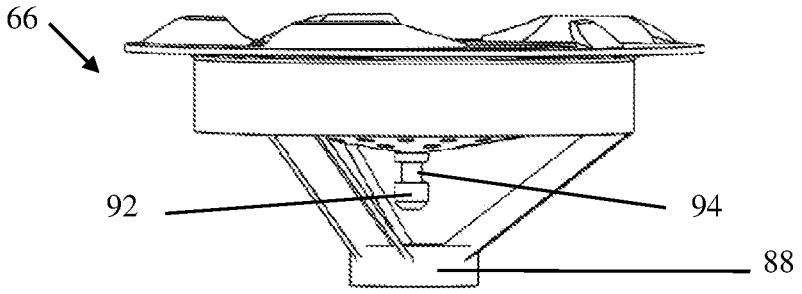
FIG. 27 is a side perspective view of the drain strainer of FIG. 26.

The device may also feature alternate versions of the basket 17. The basket 17 defining the central common area or cavity 14 may have a downward semi-circular shape, but it may also have different shapes. For example, FIG. 10 shows drain strainer 38 that has a basket 40 that is a downward v-shape, and FIG. 11 shows a drain strainer 42 that has a basket 44 that has a downward u-shape. Within these downward shaped cavities, an alternative version of a drain strainer 46 may have an upward spindle 48 (FIG. 23) in the cavity 14, so as to promote a vortex flow of water and waste and hair around the spindle. The central common area may also feature an upward shape, such as an upward u or upward v shape among other inverted basket type shapes. For example, FIG. 12 shows a drain strainer 50 that has a basket 52 that extends upwardly at the central common area and has its access opening facing downwardly.

Figure 4:
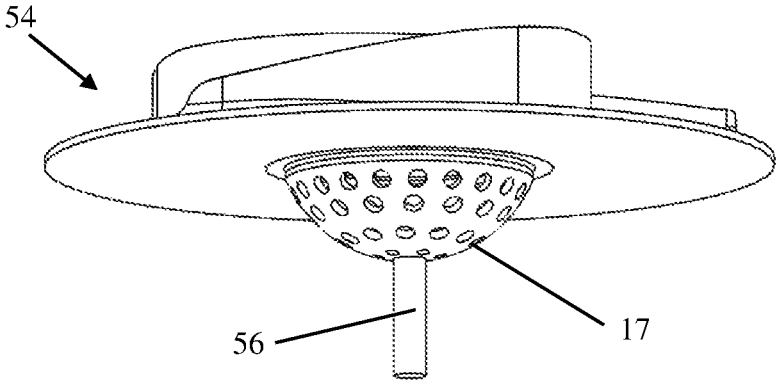
FIG. 4 is a side and bottom perspective view of a version of a drain strainer with a tension pull node.
Figure 5:
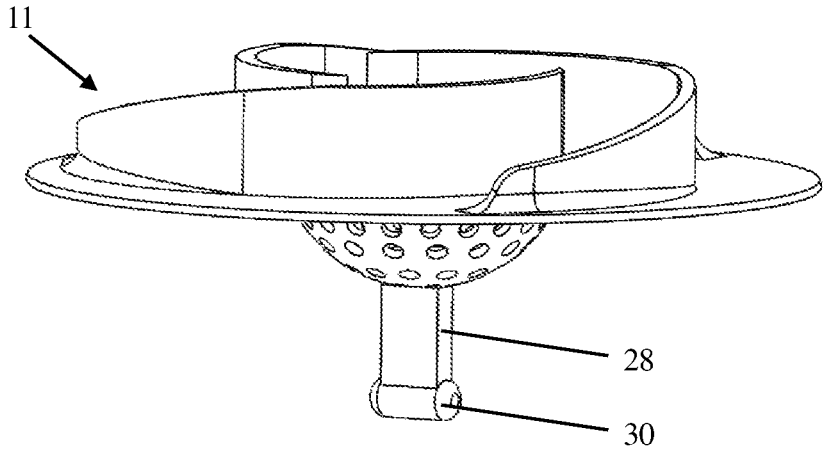
FIG. 5 is a side perspective view of a version of a drain strainer with a tension pull tab.
Figure 6:
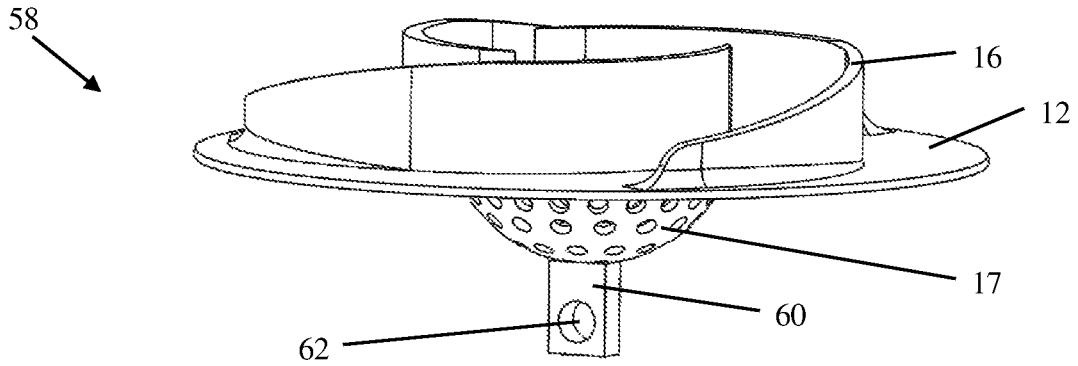
FIG. 6 is a side perspective view of a version of a drain strainer of FIG. 1 with a tension pull tab having a hole in the tension pull tab.

Several different types of tension pull protrusion setups may be provided on the bottom of the central common area for preloading the ejection feature of the drain strainer, such as a flat tab, a round axial node, and or a flat, tab-like protrusion with a grip hole among other arrangements. In particular, FIG. 4 shows drain strainer 54 that has a tension pull node 56 which is a round axial node that is attached to the underside of the basket 17 and extends downwardly from the underside of the basket at the central common area. FIG. 5 shows a drain strainer 11 that generally has a rectangular flat tension pull tab 28 that has a bulbous cylindrical portion formed at its free end that defines the fattened grip structure 30. The cylindrical portion extends beyond the width of the remaining portion of the pull tab 30 and has a diameter that is larger than thickness (measured between the largest opposite sides) of the remaining portion of the pull tab 28 to aid the user to grasp and pull the pull tab 28. FIGS. 6, 10 and 11 show a drainer strainer 58 that has a rectangular tension pull tab 60 that has a grip hole 62 extending through the largest opposite sides of the pull tab.

Figure 14:
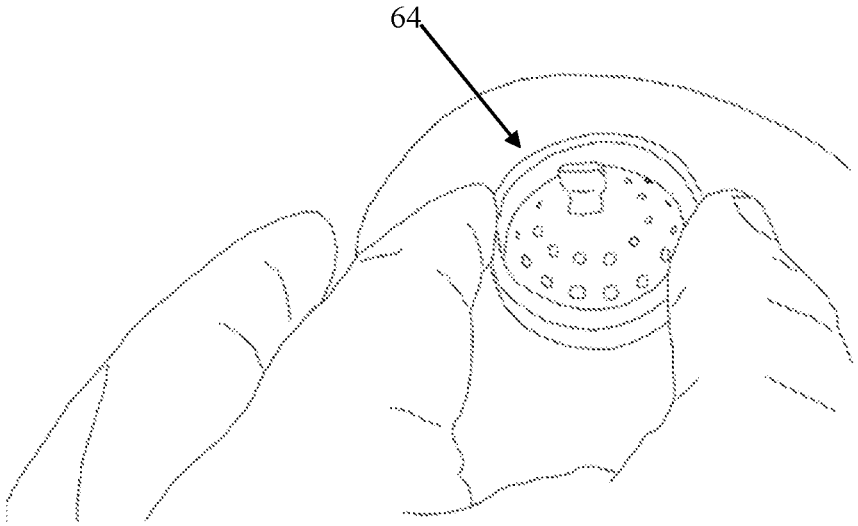
FIG. 14 is a bottom perspective view of a version of a drain strainer with a pull tab in an unstretched (not preloaded) position and being grasped by a hand of a user.
Figure 15:
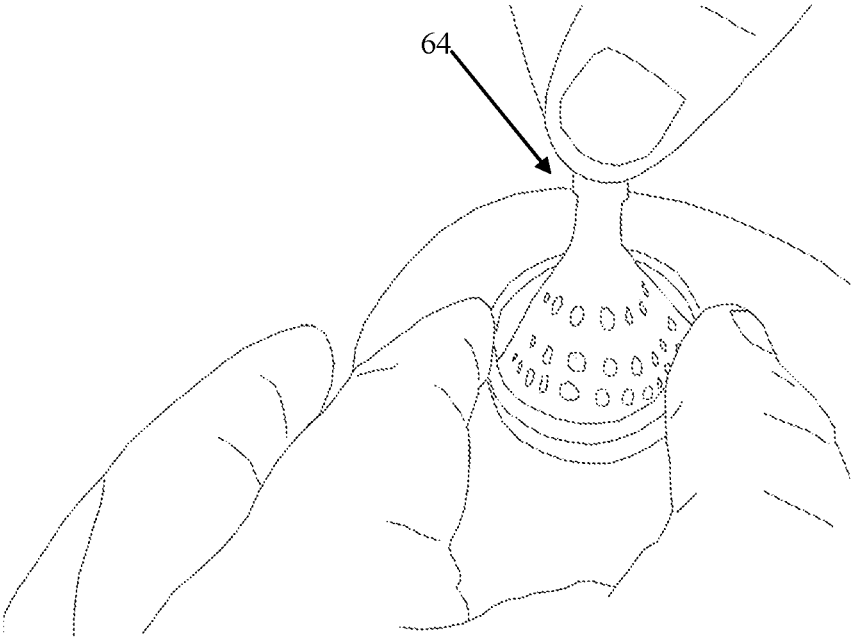
FIG. 15 is a bottom perspective view of the drain strainer of FIG. 14 with a pull tab in a stretched (preloaded) position and being grasped by a hand of a user.
Figure 16:
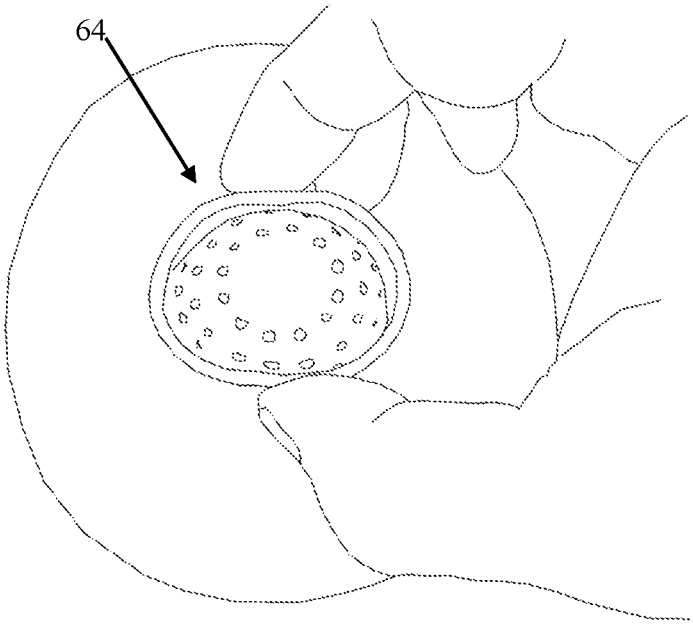
FIG. 16 is a bottom perspective view of a drain strainer showing an alternative version of a pinch type drain strainer.
Figure 17:
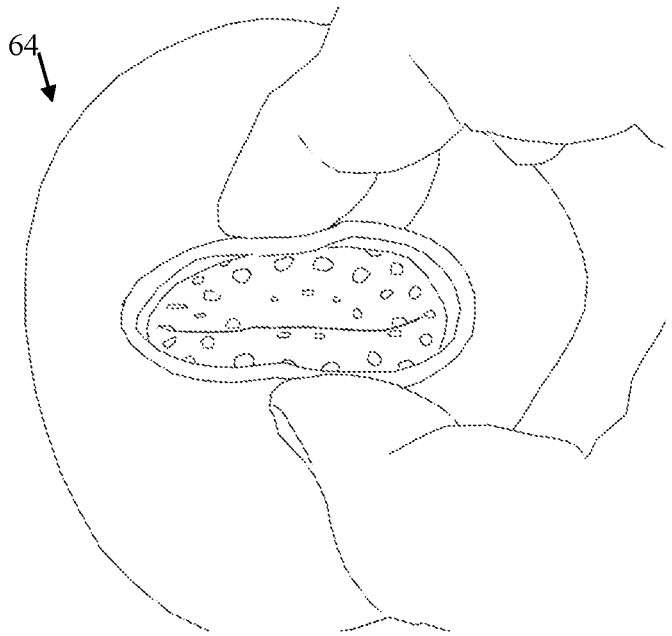
FIG. 17 is a bottom perspective view of the drain strainer of FIG. 16 showing a pinch method of waste ejection.

The spring-loaded nature of the drain strainer may be predominantly in a pull and release setup, but other setups may be featured within the scope of this invention, such as a twist motion, or slanted or pinched type of action to drive the waste ejection motion. The device may also feature a variation of reinforcements to support the structure or for alignment with a drain fixture. As previously mentioned, the device may feature a reinforcement sleeve within the material of the downward sleeve wall next to the outer edge of the common central area or cavity. Another variation is having one or more reinforcement rings 26 (FIG. 28) embedded or superimposed in the material of the base flange at any point relative to the diameter of the base flange. FIGS. 14 to 16 show a pinch type drain strainer 64 that has reinforcement rings that are flexible so that they may be pinched.

Figure 36:
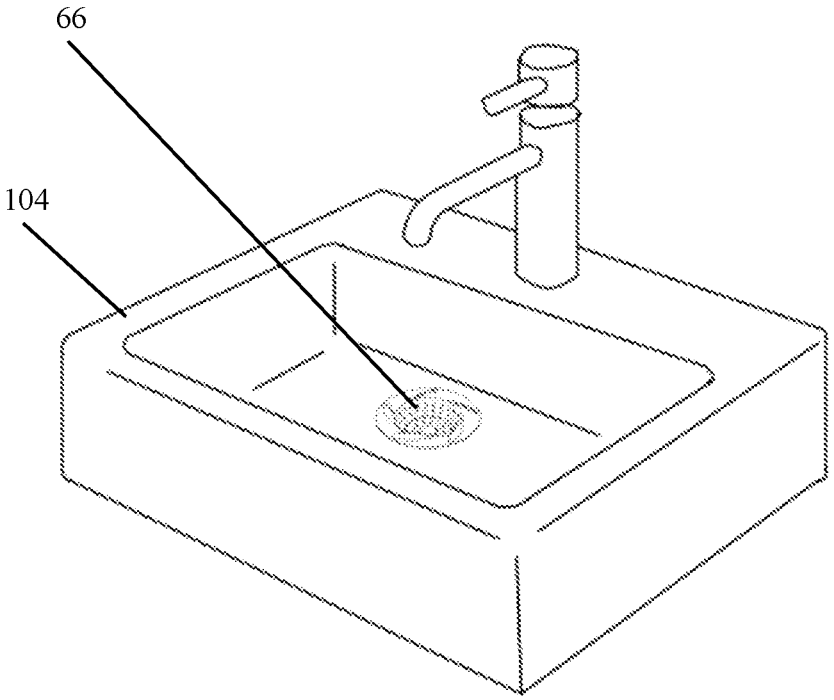
FIG. 36 is a perspective view of the drain strainer of FIG. 24 being mounted in a drain of a sink.

Another variation of a reinforcement would feature a component that could snap into place during final assembly of the product. As illustrated in FIGS. 20-22 and 24-31, an alternative drain strainer 63 or 66 may also have a top button 68 of a plunger 90. In the embodiment shown in FIGS. 20-22, three protrusions 16 similar to the embodiment shown in FIG. 1 are provided. In the embodiment of the drain strainer 66 shown in FIGS. 24-31, there are four protrusions 70 that are c-shaped and are slanted or inclined inwardly going in the upward direction that serve as water vortex fins and also allow the user to grip and remove the strainer from the sink drain. This drain strainer 66 may be mounted in a drain of a sink 104 as illustrated in FIG. 36. Alternatively, a stopper may be provided to block water flow, such as for a bath or sink basin. One such stopper can be placed over the basket 17 at the central common area or cavity 14 thereby preventing water from entering that area. Another variation would be to block the perforations 15 from the bottom side of the basket 17. The drain strainer may also feature attachments or molded in components such as a suction cup component in order to hang the device on the bathtub, shower, or sink wall and/or a stopper that is used to plug the strainer temporarily. The drain strainer may also feature a structure under the flange and cavity material that is designed to capture and hold the stretched basket material in a pre-loaded or potential energy state. The drain strainer device may also have a structure that can release the cavity material from its pre-loaded or potential energy state so as to expel contents within the cavity material. The drain strainer may be constructed of a variety of materials and is not limited to one or more material choices. Materials may include: silicone, rubber, soft or hard urethanes, steel, stainless steel, aluminum, or other materials commonly or uncommonly used in this industry and by those experienced in this art.

Figure 18:
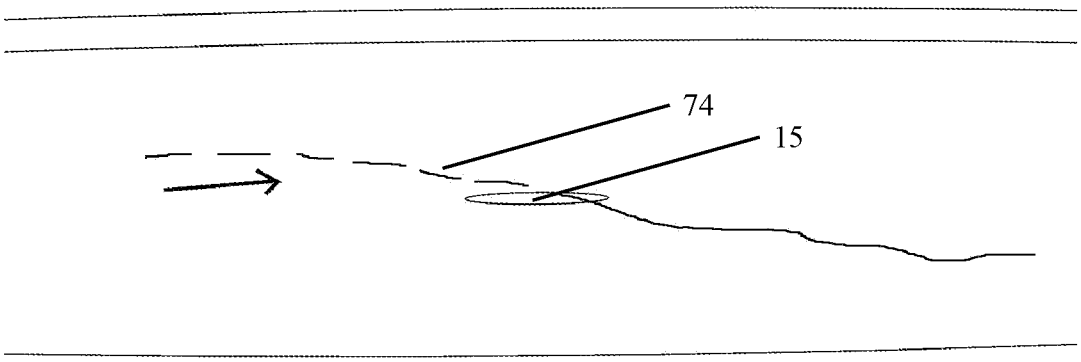
FIG. 18 is a schematic side and top perspective view of a hair passing through a hole in the drain strainer of FIG. 1.
Figure 19:
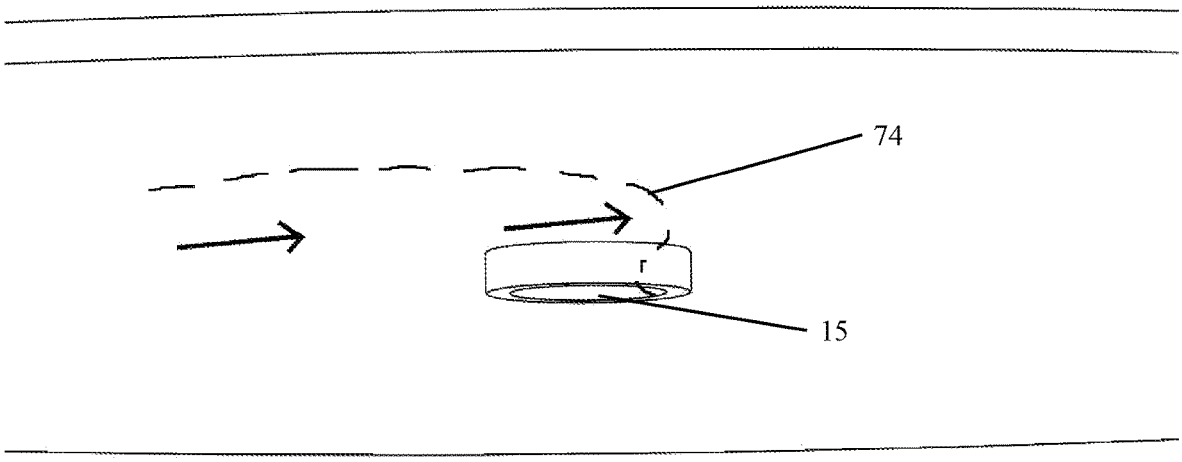
Figure 20:
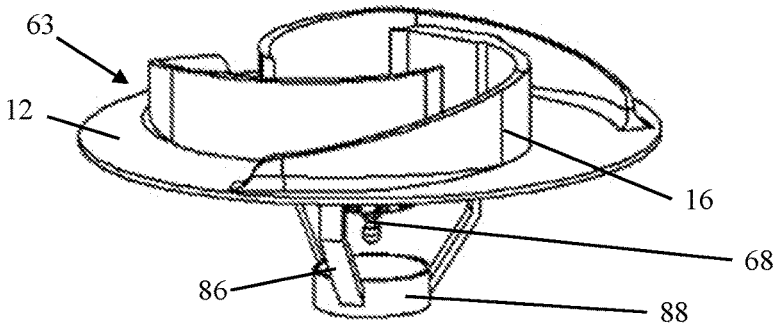
FIG. 20 is a side perspective view of an alternate version of the drain strainer.
Figure 21:
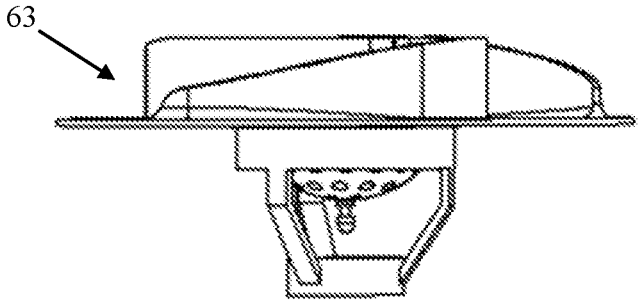
FIG. 21 is a side view of the drain strainer of FIG. 20.
Figure 22:
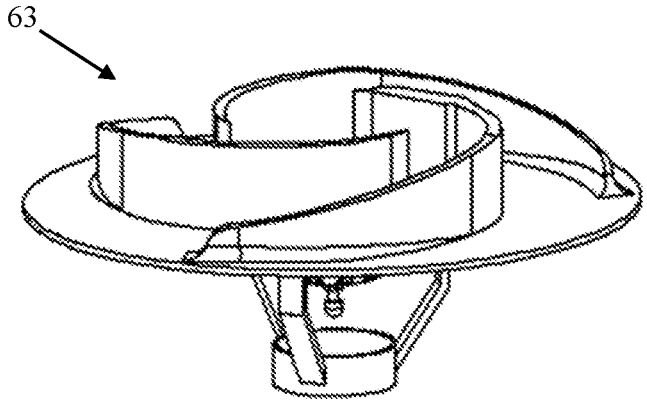
FIG. 22 is a side perspective view of the drain strainer of FIG. 20.
Figure 49:
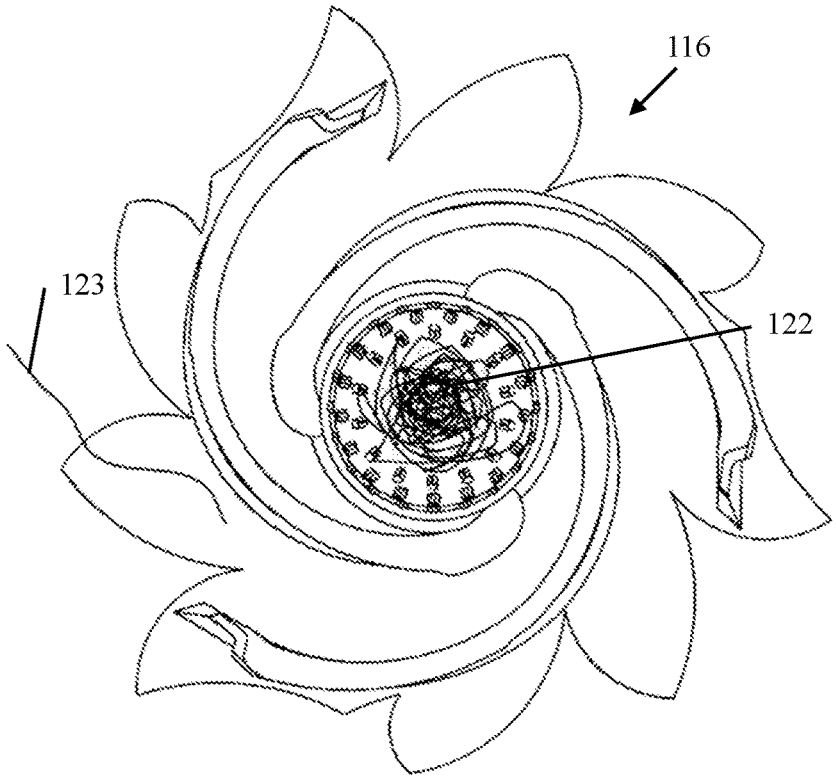
FIG. 49 is a top view of the drain strainer of FIG. 45 with hair collected in the basket and showing a single strand of hair entering the side of the drain strainer.

As previously mentioned, the drain strainer includes spiral or slanted vertical protrusions formed or otherwise mounted on the base flange 12 that serve as guides for the water being drained. These guides direct the water into a spiral or vortex motion, thereby inducing spin. The vortex motion of the water serves multiple purposes. The first purpose of the vortex motion of the water is for collection and rolling of objects and hair within the central axis of the vortex. The hair, illustrated as a single strand of hair 123, enters the side of the drain strainer and enters the vortex motion. The vortex motion of the water is extremely beneficial for capturing hair by which it tumbles or rolls the hair into a ball or disk of hair. As illustrated by FIGS. 18 and 19, this tumbling or rolling action prevents a hair 74 from passing through the perforations 15 within the basket 17 at the central common area or cavity, and also condenses the hair 122 into a single area (see FIG. 49) which makes it easier to dispose. Another purpose of the vortex motion comes from the driven spin of the water in the vortex. As the water spins, it develops angular momentum. This momentum helps to drive the water down the drain at a faster rate through the drain strainer. Another purpose of the vortex motion is to provide visible proof of the device working in action. As a user drains water through the device, the vortex spin of the water and subsequent soap and hair provides visual proof that the water both picks up speed and collects hair and waste through its spinning action.

Figure 32:
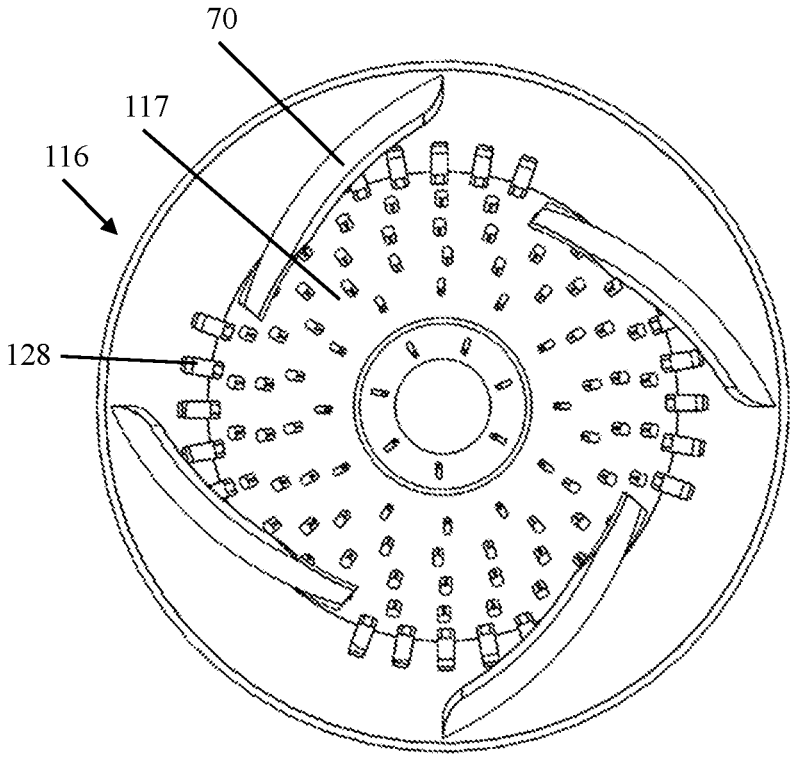
FIG. 32 is a top view of another version of the drain strainer.
Figure 33:
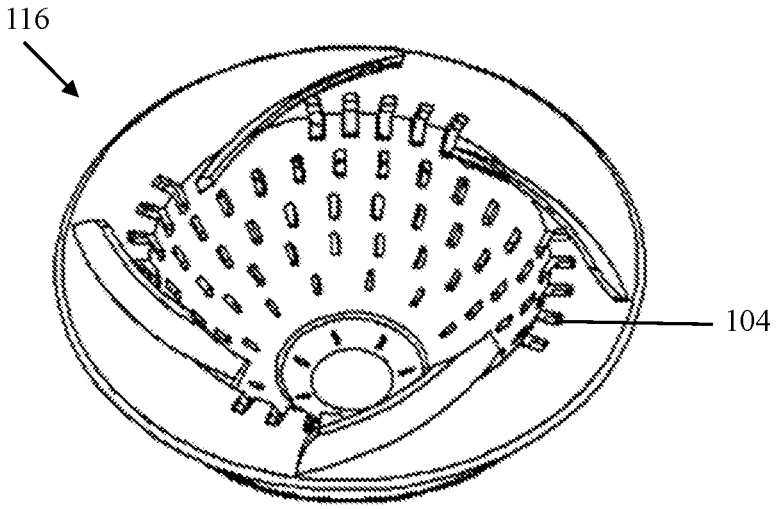
FIG. 33 is a top and side perspective view of the drain strainer of FIG. 32.
Figure 42:
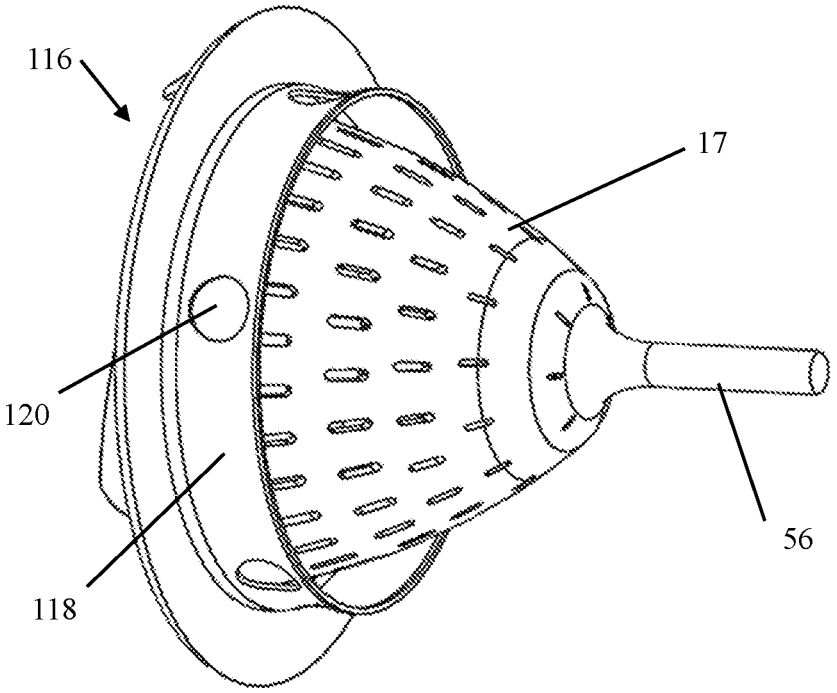
FIG. 42 is a side and bottom perspective view of a drain strainer in the stretched position.
Figure 43:
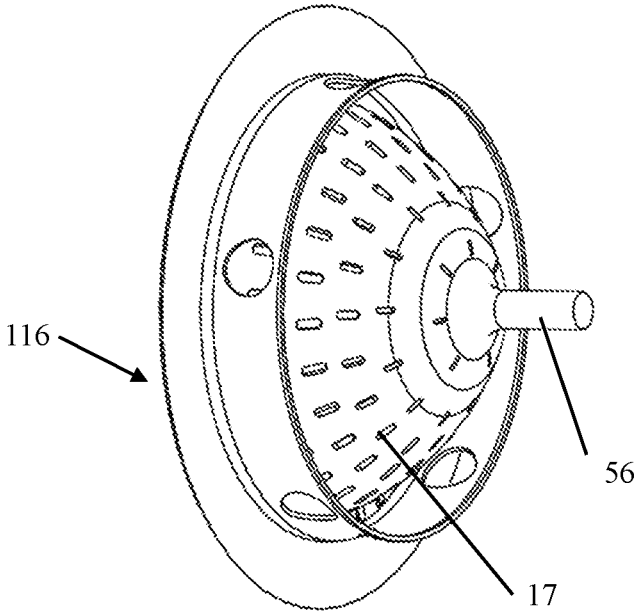
FIG. 43 is a side and bottom perspective view of the drain strainer of FIG. 42 in the unstretched position.
Figure 44:
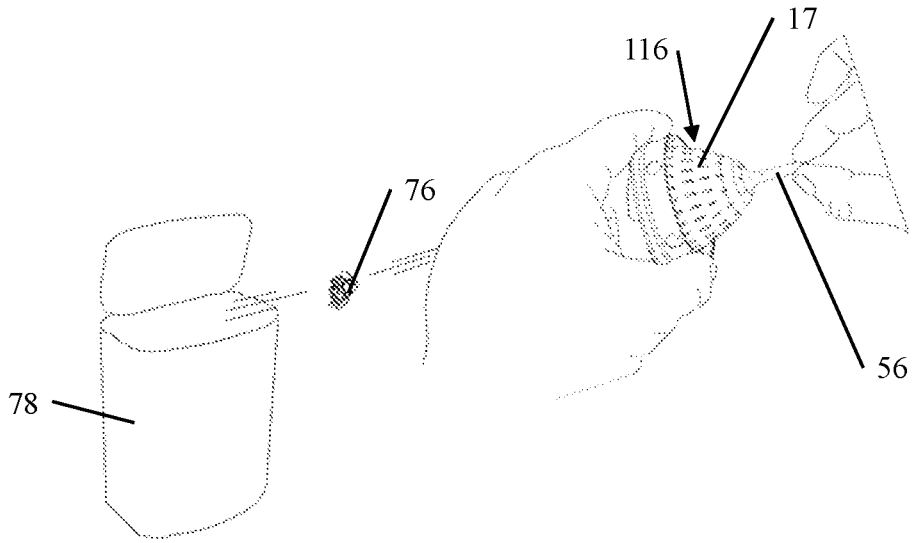
FIG. 44 is a side perspective view of the drain strainer of FIG. 42 being illustrated to eject debris in trash can by a user.
Figure 45:
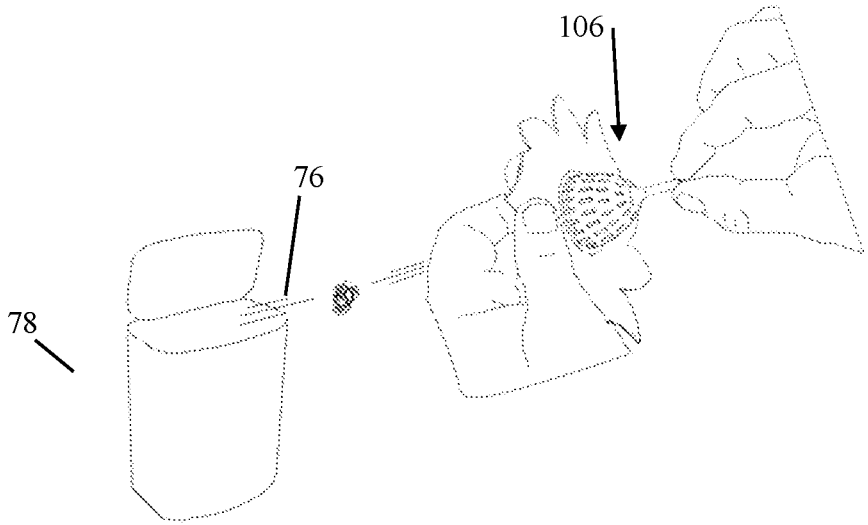
FIG. 45 is a side perspective view of another version of a shower type drain strainer being illustrated to eject debris in trash can by a user.

FIGS. 32, 33, and 42-44 show a version of a drain strainer 116 that has the pull tab 56 and a sleeve 118 around a basket 117 with lateral holes 120 to help a user grip the drain strainer 116. FIGS. 32 and 33 show that this drain strainer 116 has a basket 117 that has L-shaped perforations 128 on the outer edge 20 of the cavity 14. This allows draining at the top of the flange 12. Also, four protrusions 70 that are c-shaped and are slanted or inclined inwardly going in the upward direction serve as water vortex fins and also allow the user to grip and remove the strainer 116 from the sink drain. FIG. 43 shows the drain strainer 116 with a basket 117 being unstretched. When the debris 76 needs to be removed, a user grasps the pull tab 56 and pulls the pull tab 56 away from the drain strainer 116 such that the common area or cavity is stretched as seen in FIGS. 42 and 44. The user then releases the pull tab to eject the debris 76 (FIG. 44) into a garbage container 78. This slingshot type of motion serves multiple purposes. First, it allows users to remove the waste and hair without having to touch it. Secondly, it facilitates the waste removal by allowing the user to aim and shoot the waste like a projectile into a trash container.

Figure 46:
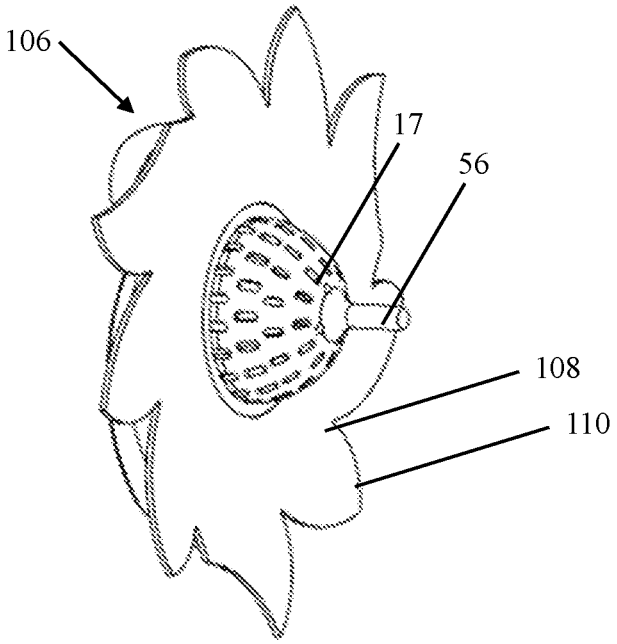
FIG. 46 is a bottom and side perspective view of the drain strainer of FIG. 45.
Figure 47:
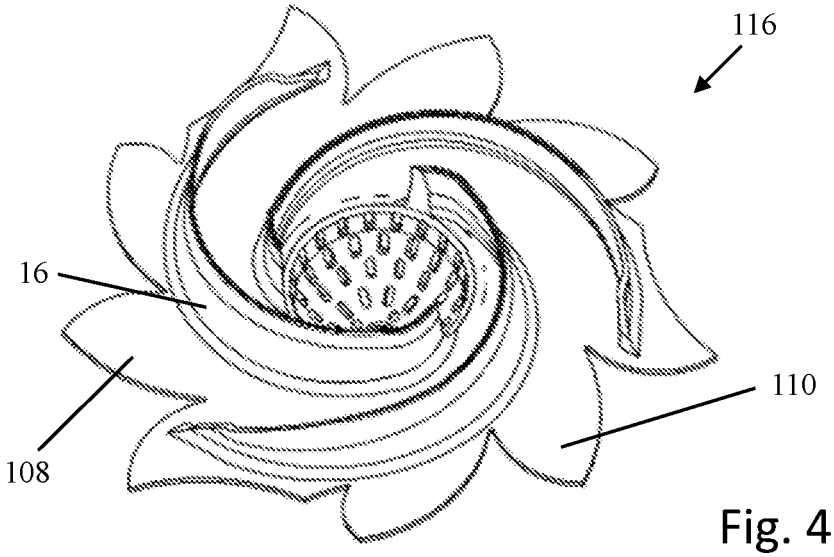
FIG. 47 is a top perspective view of the drain strainer of FIG. 46.
Figure 48:
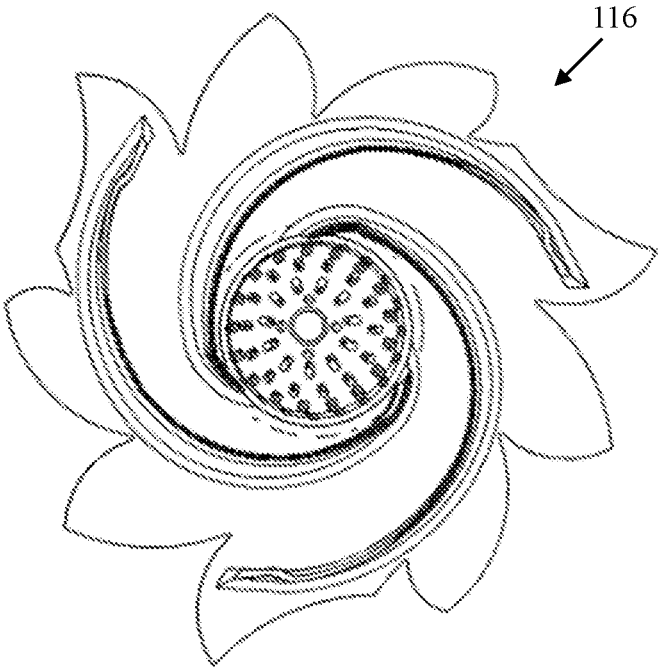
FIG. 48 is a top view of the drain strainer of FIG. 45.
Figure 50:
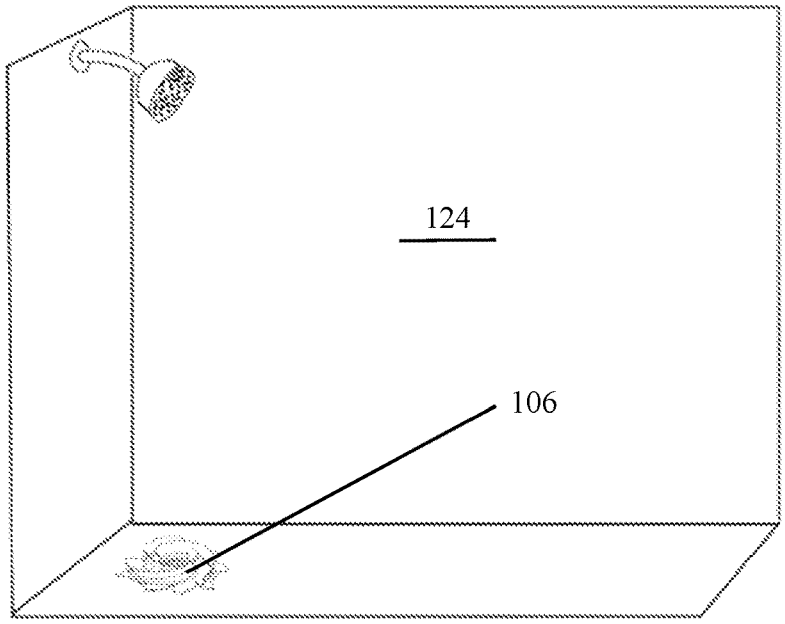
FIG. 50 is a side perspective view of the drain strainer of FIG. 45 being mounted in a drain of a shower.

FIGS. 45-50 show another version of a drain strainer 106. This drain strainer 106 has a base flange 108 that has petals 110 around the periphery that define a flower shape configuration. The three protrusions may be upwardly vertical protrusions 16 or slanted radially outwardly relative to the base flange 108. FIG. 46 shows the basket 17 being unstretched. When the debris 76 needs to be removed, a user grasps the pull tab 56 and pulls the pull tab 56 away from the drain strainer 106 such that the common area or cavity is stretched as seem in FIG. 45. The user then releases the pull tab to eject the debris 76 (FIG. 44) into a garbage container 78. FIG. 50 shows this drain strainer 106 being mounted in a drain of a shower 124. It should be noted that the shape of the base flange may take many forms.

Figure 28:
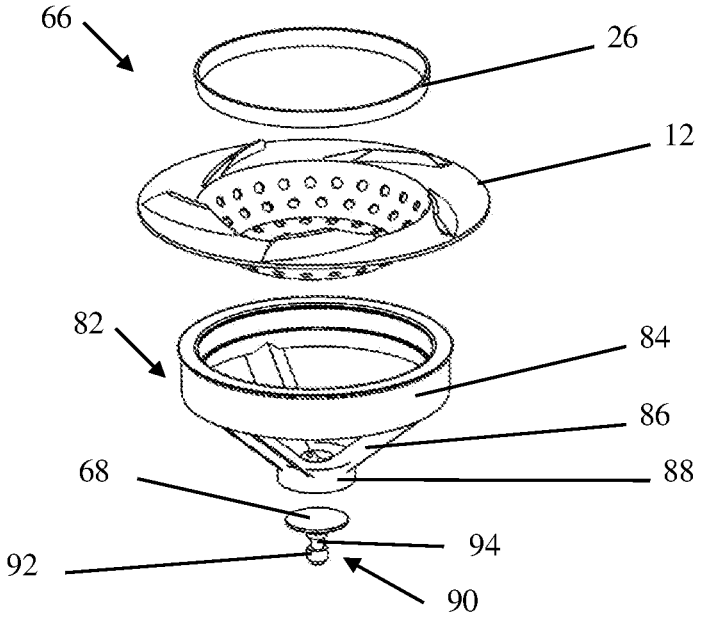
FIG. 28 is an exploded view of the drain strainer of FIG. 24.
Figure 39:
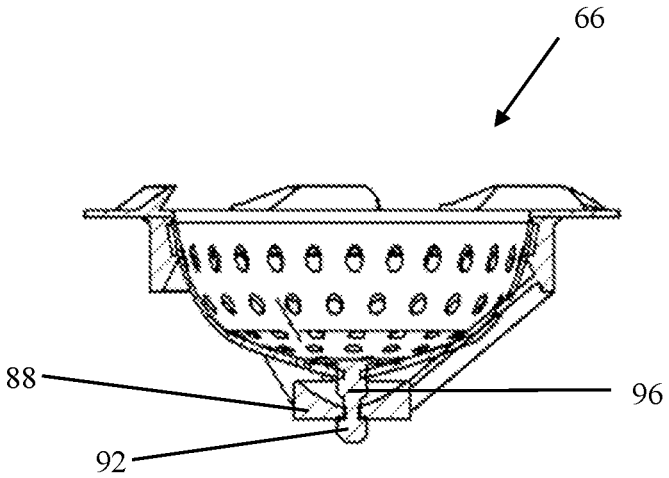
FIG. 39 is a sectional view taken along line 39-39 of FIG. 38.

The drain strainers 63, 66 that have the plungers 90 comprise the flange 12 that comprise a soft, rubber like material that has a large central cavity defined by the basket 17 with the perforations 15. The plunger is inserted into the bottom of the basket 17. The top flange 12 and the basket 17 are made of a silicone or a Thermoplastic elastomers (TPE) type of material that has flexibility. With reference to FIG. 28, the drain strainer 66 or 63 comprises a bottom section 82 that is rigid such as plastic or metal or other suitable material. At the outer edges of the cavity 14, the base flange 12 sits in a cylindrical structure or sleeve 84 of the bottom section 82 and the basket 17 is pinched against the cylindrical structure or sleeve 84 with a thin retaining ring 26 placed on the inside of the cavity to hold it in place. On the bottom side of the cylindrical structure 84, two or more legs 86 extend downward and angle toward the central axis of the structure. The legs 86 converge into a lower base structure or hub that features a cylindrically shaped capture element in the form of a catch 88. A push tab or plunger 90 is provided. The plunger 90 comprises the top button 68, a lower plunger element 92, a stem 94, and an upper plunger element 96 (FIG. 39). The top button 68 of the plunger rests above the silicone basket. The upper plunger element 96 sits below the basket, which holds the plunger in the basket and keeps it from getting dislodged. The stem 94 is positioned between the upper plunger element 96 and the lower plunger element 92 and is sized smaller than the upper and lower plunger elements 92, 96. The lower plunger element 92 is positioned through the bottom of the basket 17, whereas the top stopper 68 of the plunger rests on the top of the basket 17 and provides a central push point to depress and spring-load the basket 17. The lower plunger element 92 is positioned below the basket 17 and is designed to plunge into the catch 88 to hold its position there when the plunger 90 gets pushed by the user to spring load the basket 17.

Figure 29:
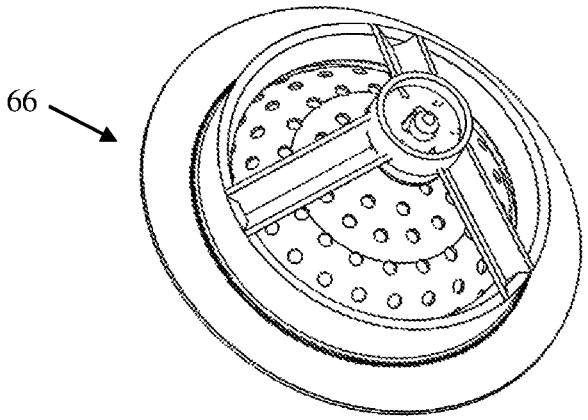
FIG. 29 is a bottom perspective view of the drain strainer of FIG. 24.
Figure 30:
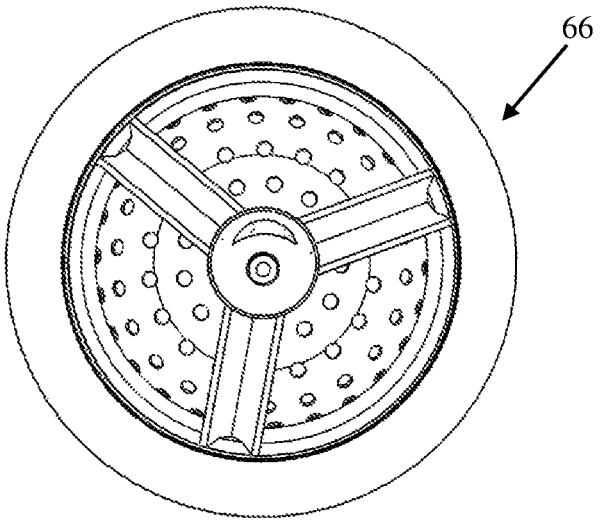
FIG. 30 is a bottom view of the drain strainer of FIG. 24.
Figure 31:
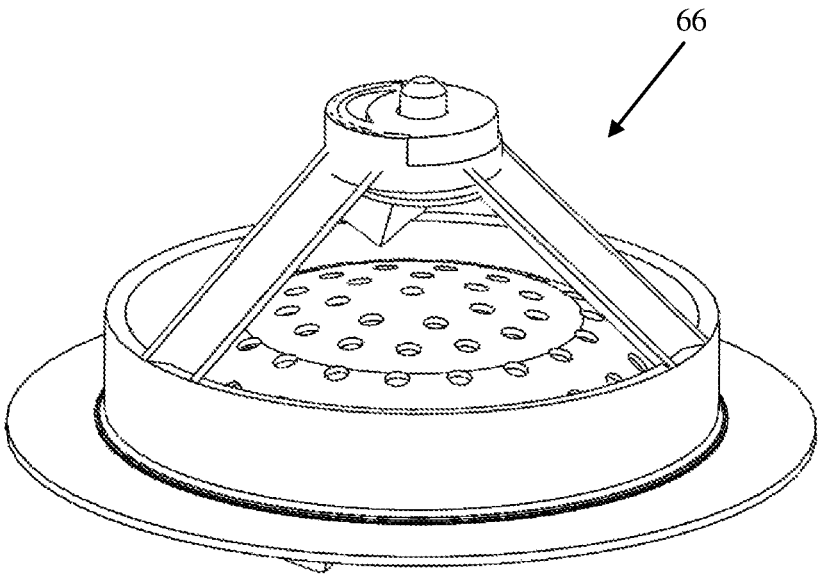
FIG. 31 is a bottom and side view of the drain strainer of FIG. 24.
Figure 34:
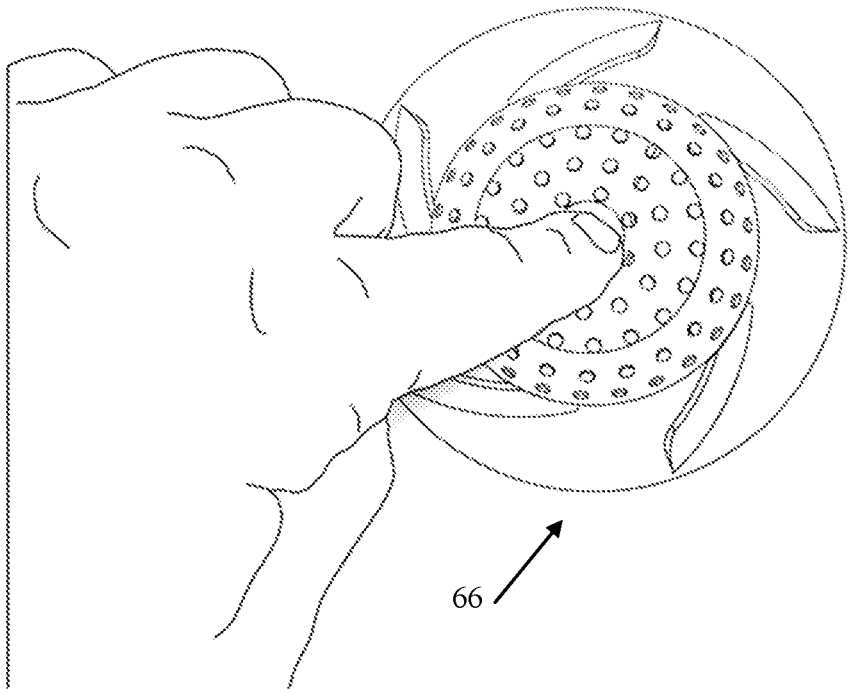
FIG. 34 is a top perspective view of the drain strainer of FIG. 24 being pushed by a user.
Figure 37:
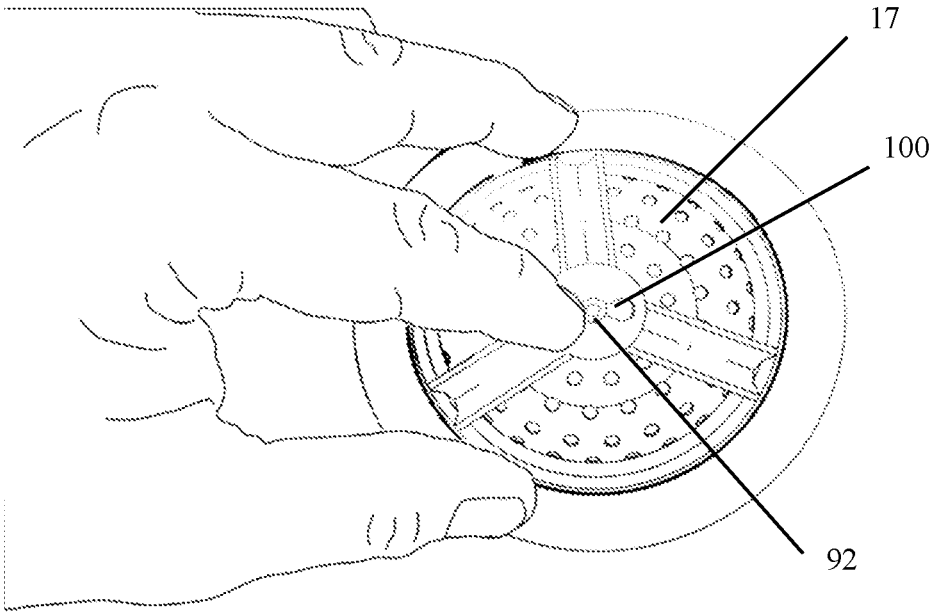
FIG. 37 is a bottom perspective view of the drain strainer of FIG. 24 being operated by a user to release the plunger from its locked position.
Figure 38:
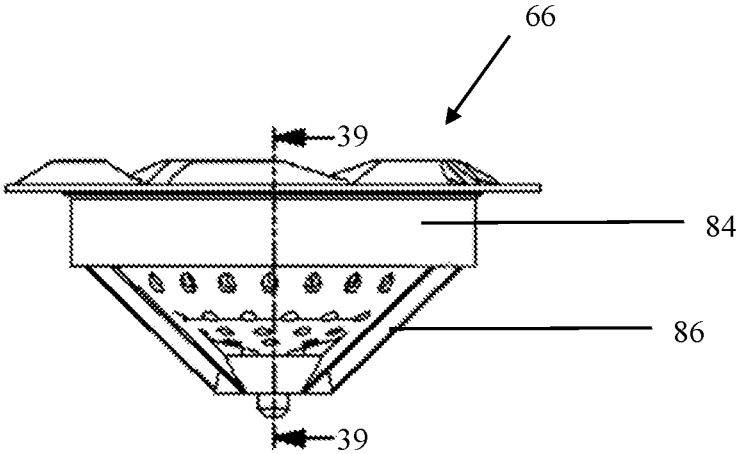
FIG. 38 is a side view of the drain strainer of FIG. 24 in a locked and stretched position.
Figure 40:
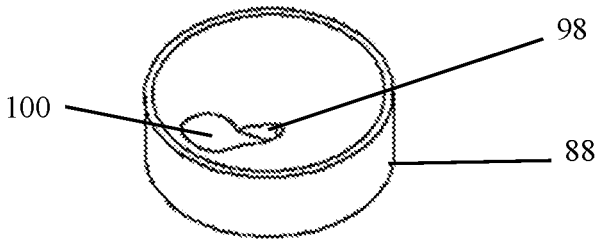
FIG. 40 is a top perspective view of the catch of the drain strainer of FIG. 24.
Figure 41:
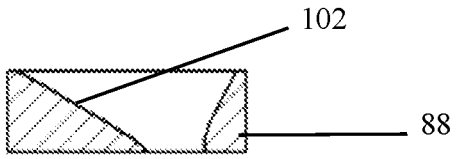
FIG. 41 is a side sectional view of the catch of FIG. 40.

In particular, as illustrated in FIG. 40, the catch 88 includes a central slot 98 and an larger offset hole 100 that laterally merges with the central slot 98. The lower plunger element 92 is sized to fit through the offset hole 100 but not through the central slot 98. The stem 94 of the plunger 90 however is sized to fit through the central slot 98. When the top button 68 of the plunger 90 is pushed (FIGS. 24 and 34), it is guided through the offset hole by a funnel 102 (FIG. 41) formed in the catch 88. The top button 68 is pushed downwardly through the offset hole 100 until the lower plunger element 92 extends down away from the underside of the catch 88. Simultaneously, as the lower plunger element 92 extends downwardly through the offset hole 100, the resistance of the material of the silicone basket forces the stem 94 laterally from the offset hole 100 until the stem 94 is received by the central slot 98 as illustrated in FIGS. 29, 37, and 39. The resistance of the material of the silicone basket 17 forces the plunger 90 to the center, so once the lower plunger element 92 is through the offset hole 100, it guides into the slot 98 towards the center to remain locked in the stretched position.

Figure 35:
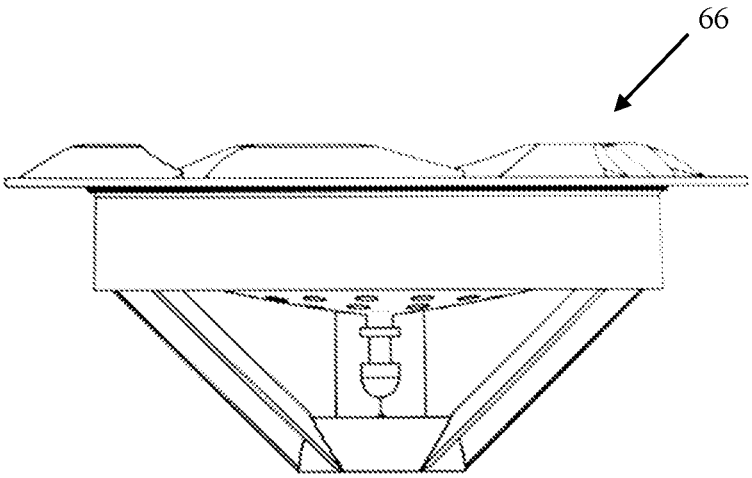
FIG. 35 is a side perspective view of the drain strainer of FIG. 27.

That is, the top side of the lower plunger element 92 engages the underside of the catch 88 to prevent the lower plunger element 92 from moving back through the central slot 98. Upon this action, the basket material is stretched and is in a potential energy position. The plunger 90 is released by sliding the plunger laterally away from the center hole and towards the offset hole 100 until the lower plunger element 92 is aligned under the offset hole 100. FIG. 37 shows a user beginning to slide the plunger toward the offset hole 100 using a finger to accomplish this action. As the plunger aligns with the offset hole 100, it releases the tension stored in the basket 17, which also moves the basket 17 rapidly upward, thereby projecting or ejecting any debris or other material in the basket 17 outward. In essence, this releasing of the grip on the lower plunger element 92 in turn causes the stored energy in the basket 17 to be released by which the basket 17 abruptly returns to its rest position. This motion also expels any contents resting inside the common area or cavity 14 defined by the basket 17. The basket 17 then goes back to its unstretched rest position as shown in FIG. 35.

Figure 51:
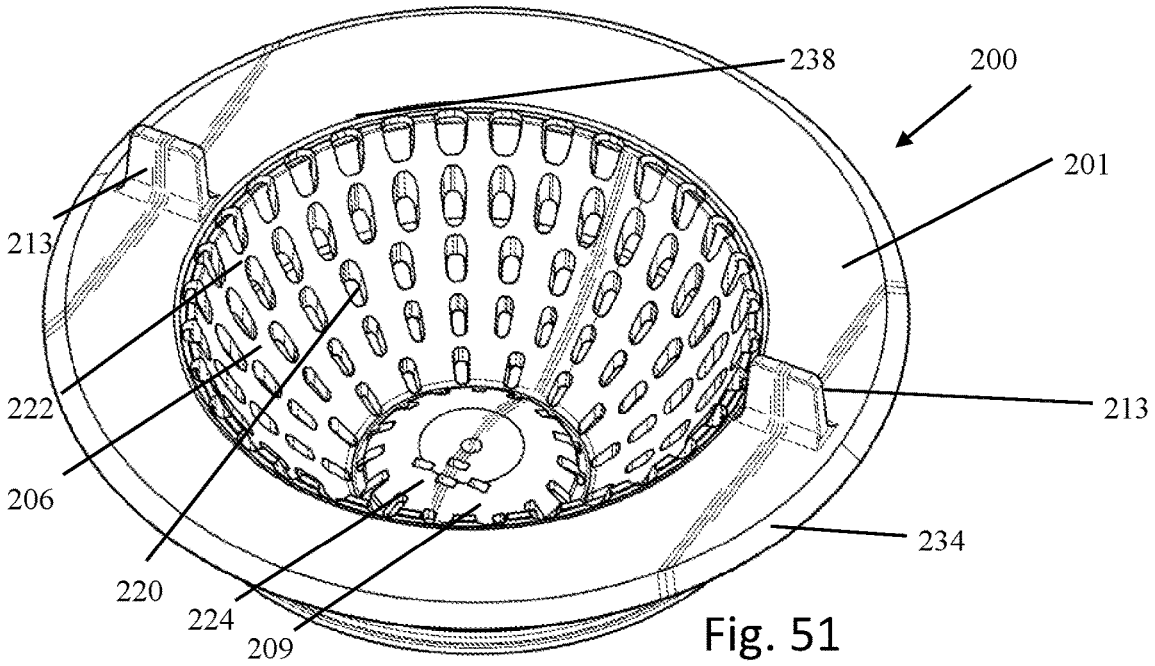
FIG. 51 is a top perspective view of a drain strainer according to another embodiment of the present invention.

FIGS. 51-69 show another embodiment of a drain strainer 200 of the present invention. Referring to FIG. 51, the drain strainer 200 comprises a horizontal strainer flange 201, and one or more lift-out tabs 213 that extend in an upwards fashion from the strainer flange 201. The lift-out tabs 213 are oriented crossways on the strainer flange 201 as shown in FIG. 51. Specifically, the lift-out tabs 213 extend radially (relative to the longitudinal axis 240 (FIG. 53) of the drain strainer 200) from an inner end 238 of the strainer flange 201 to almost across the strainer flange 201 to a flexible outer end 234 of the strainer flange 201.

Figure 52:
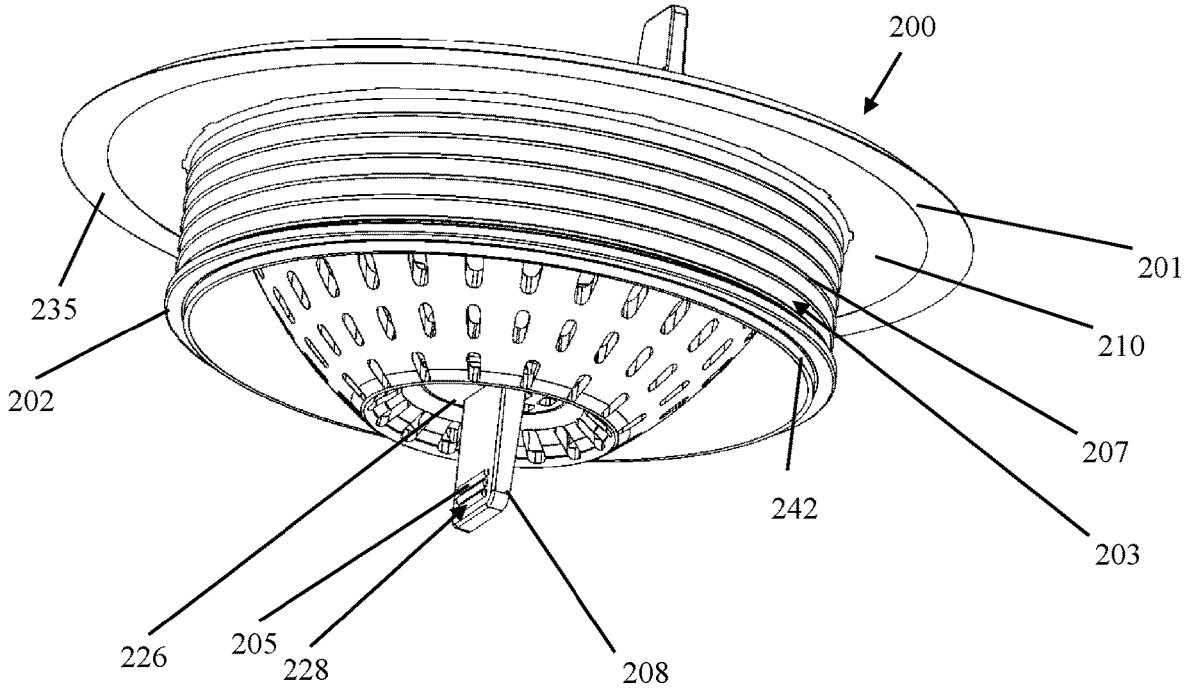
FIG. 52 is a bottom and side perspective view of the drain strainer of FIG. 51.
Figure 53:
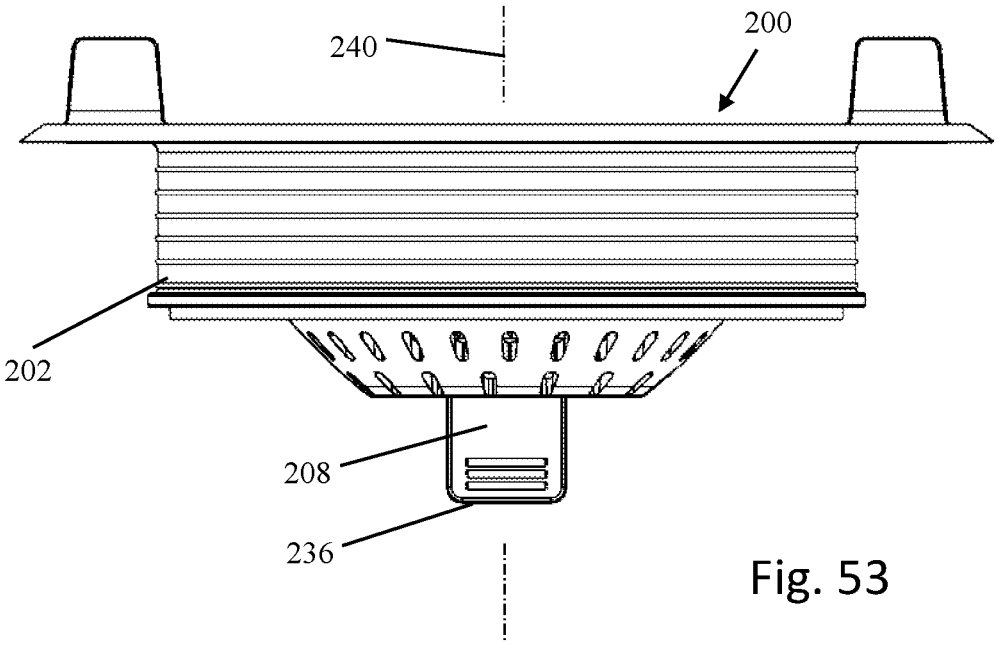
FIG. 53 is a side view of the drain strainer of FIG. 51.
Figure 54:
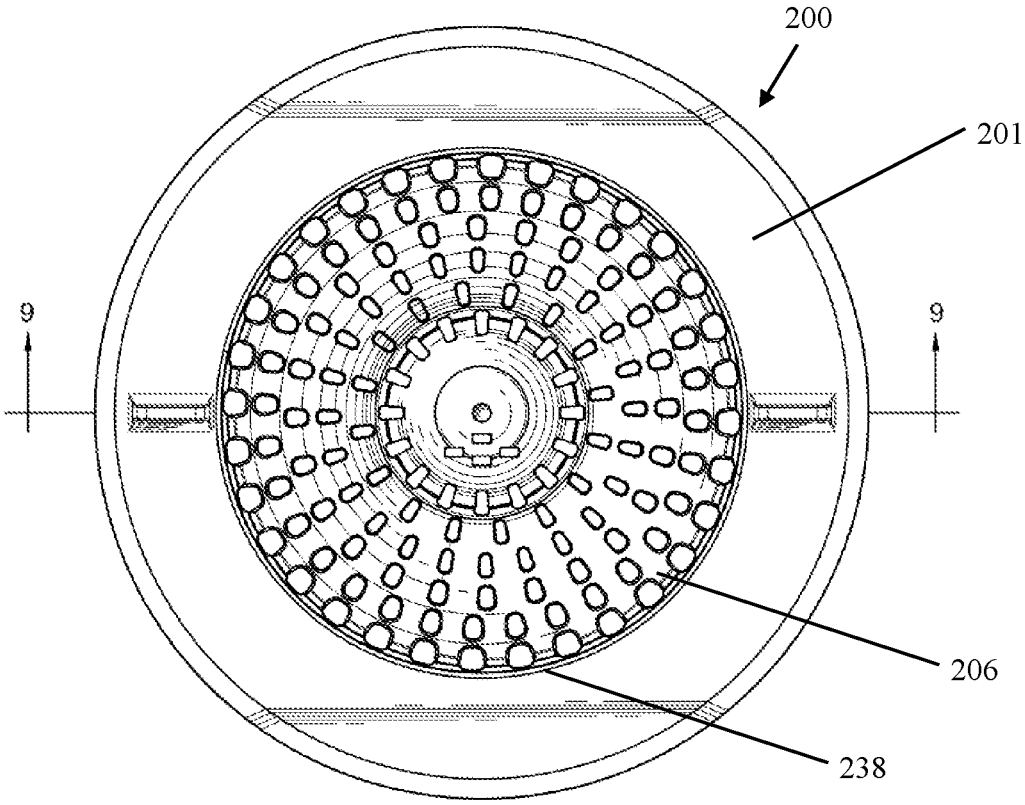
FIG. 54 is a top view of the drain strainer of FIG. 51.

As illustrated in FIG. 52, the strainer flange 201 is circular shaped and extends radially inward transitioning to a tubular grip body 202. The tubular grip body 202 is vertically oriented or near vertically oriented and extends downwardly from the strainer flange 201. The grip body 202 has an outer surface that includes grip elements in the form of ridges 207 that define a grip surface 203. The ridges 207 are configured to enable the grip surface 203 to be comfortably held by a user's hand and also to help prevent the user's hand from slipping off the grip surface 203 especially when the grip surface 203 is wet. Other variations may be possible to provide a comfortable, non-slip surface such as dots or other patterned protrusions or indents. In the present invention, the grip body 202 is oriented in a circular fashion, but may take shape in other formats, such as an ellipse, square, or other variations. The strainer flange 201 features a molded soft top that transitions inwardly to an elastic basket 206 that surrounds a central cavity as also shown in FIG. 51.

The basket 206 has a side wall 222 that depends downwardly and inwardly from the inner end 238 of the flange and terminates into a bottom wall 224 to define a frustoconical shape. The basket 206 comprises perforations 220 formed in the side wall 222 and bottom wall 224 that allow water to flow through, but catch waste and other objects to prevent them from entering the drain. As the side wall 222 of the basket 206 transitions to the bottom wall 224, there is a slight inversion portion 209 in which the bottom wall of the basket projects upwardly to define a recess 226 (FIG. 52) formed on the underside of the basket 206. As seen in FIG. 52, a pull tab 208 is integrally formed in one piece with or otherwise attached to the inversion portion 209 of the bottom wall 224 and extends downwardly from the underside of the bottom wall 224. The pull tab 208 includes grip elements in the form of ridges 205 near its distal end 236 that define a non-slip surface 228 to help prevent a user's hand from slipping off the pull tab 208 when pulling it down. Other variations of a non-slip surface may be employed. The inversion portion 209 also enables the pull tab to be tucked up to provide sufficient clearance with the bottom of a drain 212 (FIGS. 57 and 58) to prevent the pull tab from interfering with the bottom of the drain 212. In essence, the main purpose of the bottom inversion portion 209 is to "tuck" the pull tab 208 up and away from the bottom of the drain 212 to prevent it from striking certain drain flanges.

Figure 55:
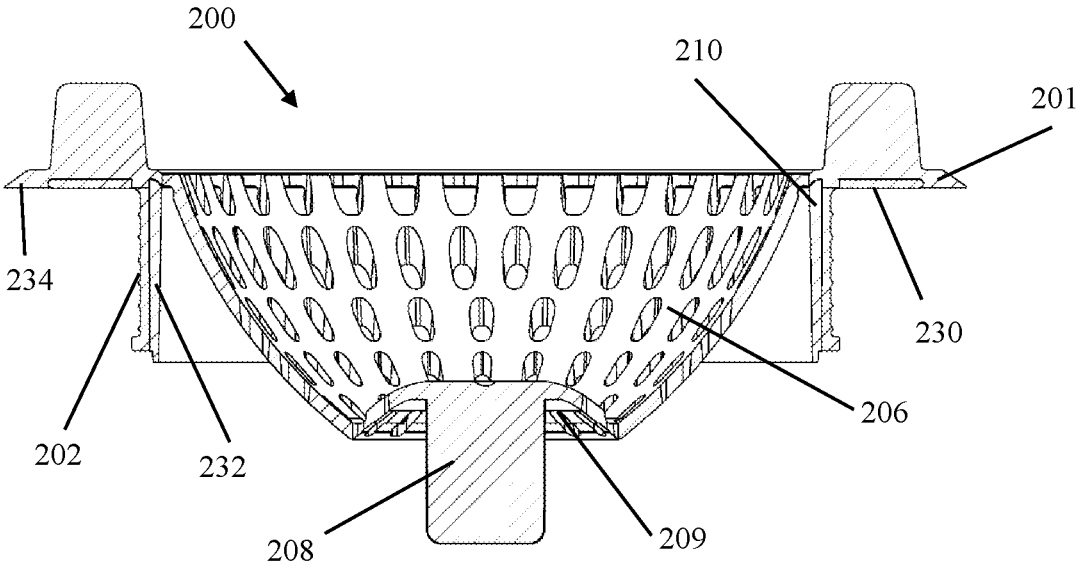
FIG. 55 is a sectional view taken along line 9-9 of FIG. 54.
Figure 56:
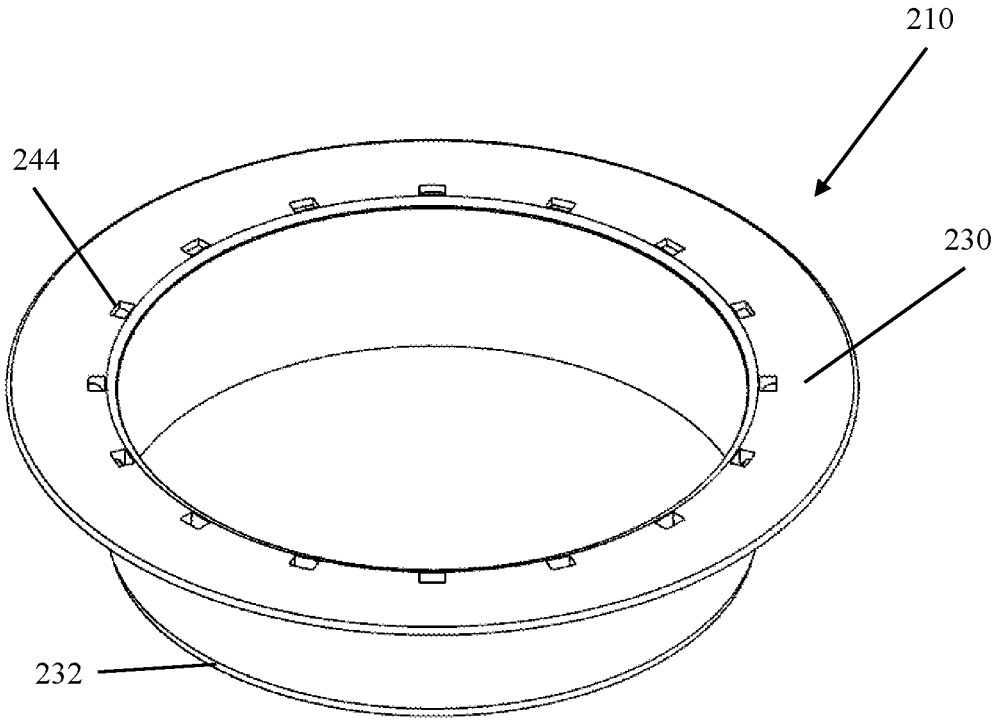
FIG. 56 is a side and top perspective view of the reinforcement collar of the embodiment of FIG. 51.
Figure 58:
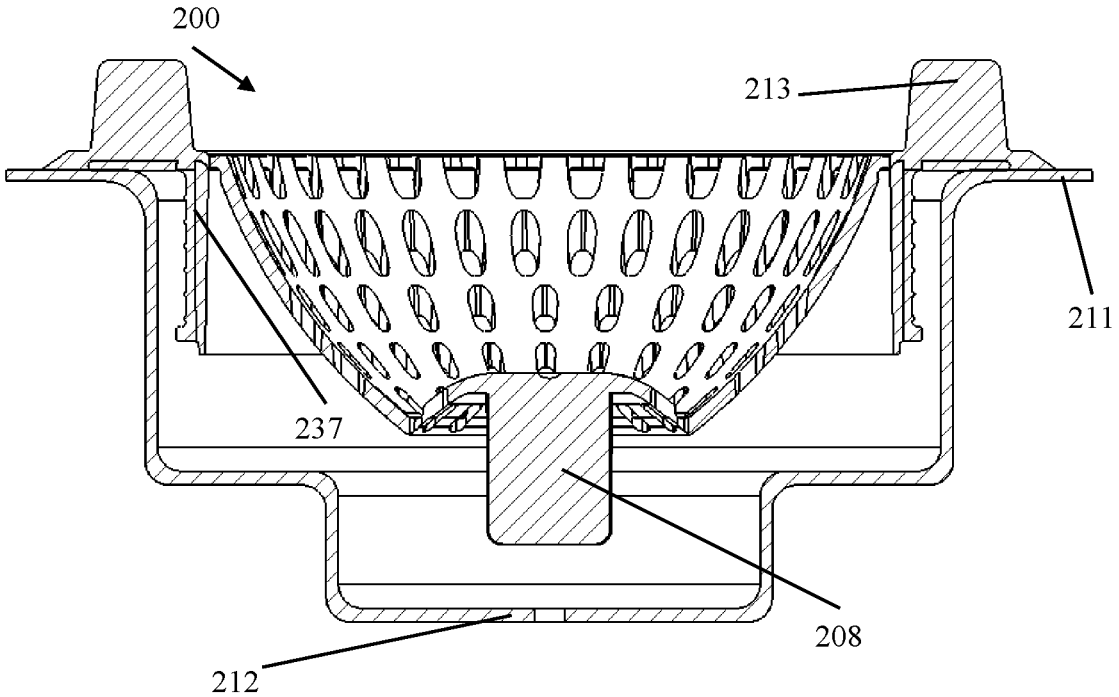
FIG. 58 is a sectional view taken along line A-A of FIG. 57.
Figure 59:
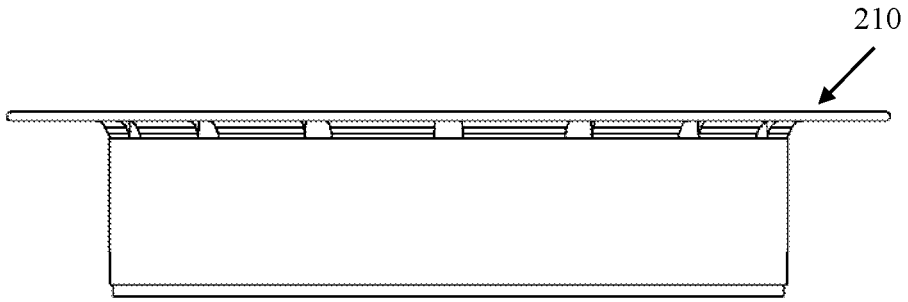
FIG. 59 is a side view of the reinforcement collar of the embodiment of FIG. 51.

As seen in FIG. 55, the soft top of the strainer flange 201 and the basket 206 are molded with a flexible and elastic material such as silicone or a thermoplastic elastomer. This material enables the basket 206 to stretch and then quickly retract back to its unstretched position. A reinforcement collar 210 made of a rigid material is attached on the underside 235 (FIG. 52) of the strainer flange 201 and on the inner side 237 (FIG. 58) of the grip body 202. In particular, the reinforcement collar 210 includes a flat collar flange 230 and a tubular collar body 232 as shown in FIGS. 56 and 59. The tubular collar body 232 extends downwardly from the flat collar flange 230 terminating beyond the grip body 202. The flexible and elastic material is molded over the outside and top of the collar flange 230 and over the outside of the collar body 232, but not on the bottom 242 (FIG. 52) of the collar 210 as shown in FIGS. 52, 55 and 58. The collar material is suitable so that silicone has a chemical bond to it. The reinforcement collar 210 may also be adapted to be mechanically bonded to the strainer flange 230 and other elements of the drain strainer 200. The strainer flange 201 also extends radially outward beyond the collar flange 230 to define the flexible outer end portion 234 of the strainer flange 201.

Figure 57:
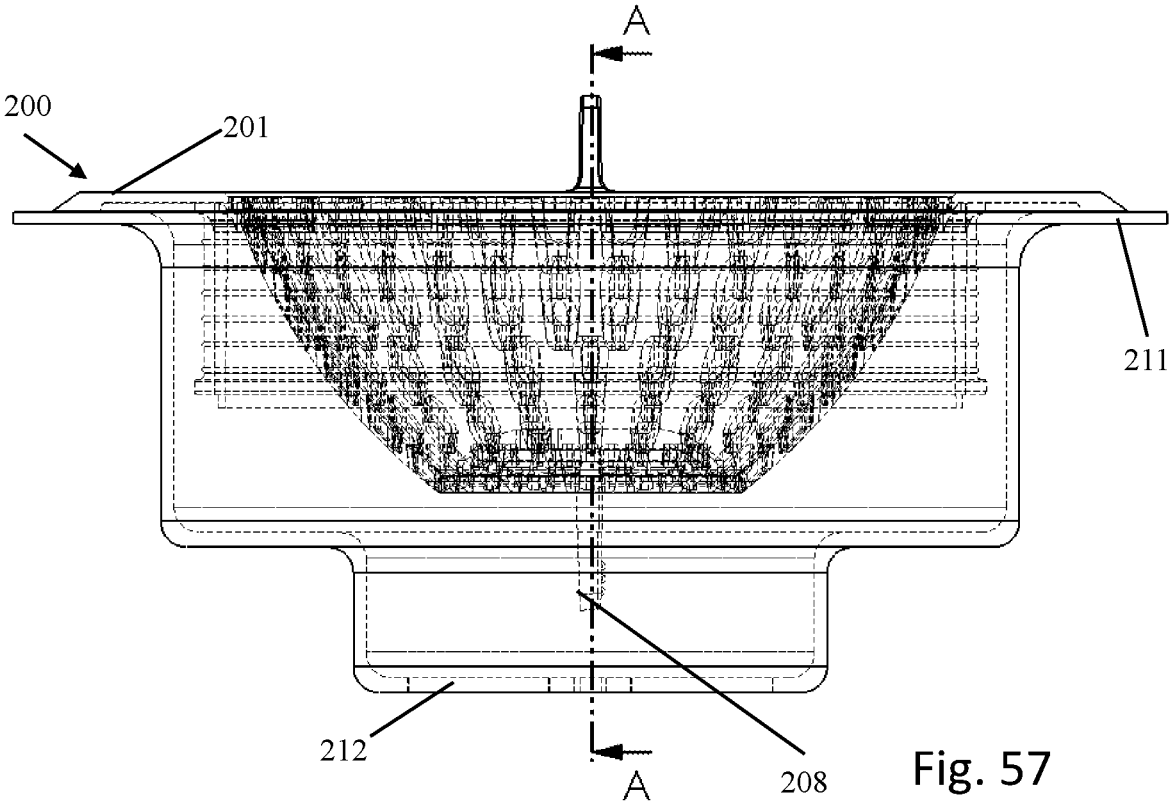
FIG. 57 is another side view of the drain strainer of FIG. 1 sitting within a drain and with hidden lines illustrating elements of the drain strainer of FIG. 51.
Figure 61:
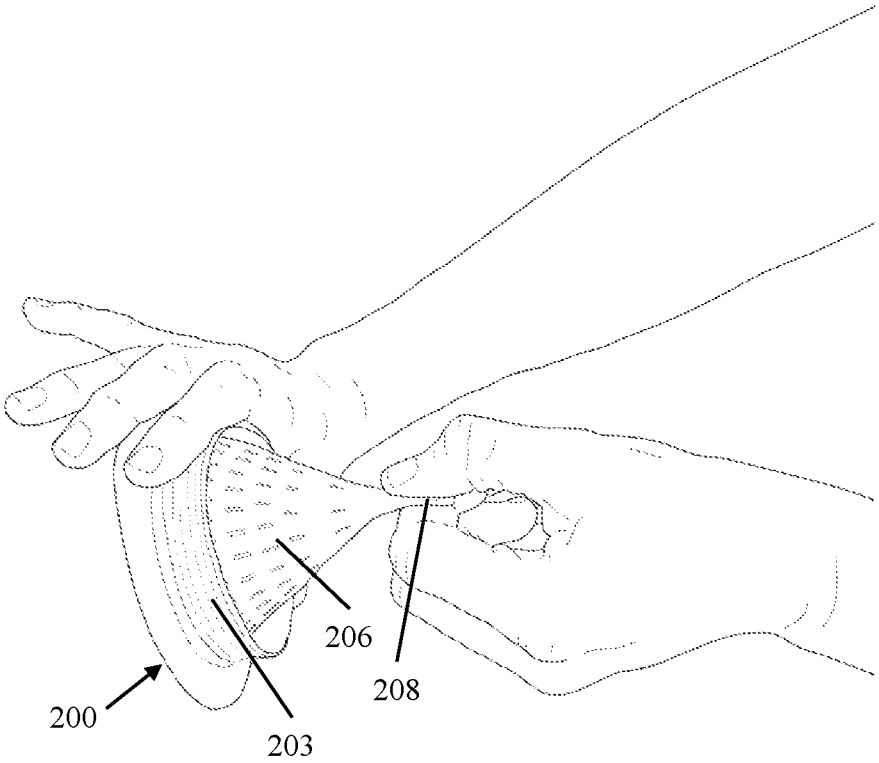
FIG. 61 is a schematic side perspective view of the drain strainer of FIG. 51 with the pull tab being pulled before ejection of the waste material.
Figure 62:
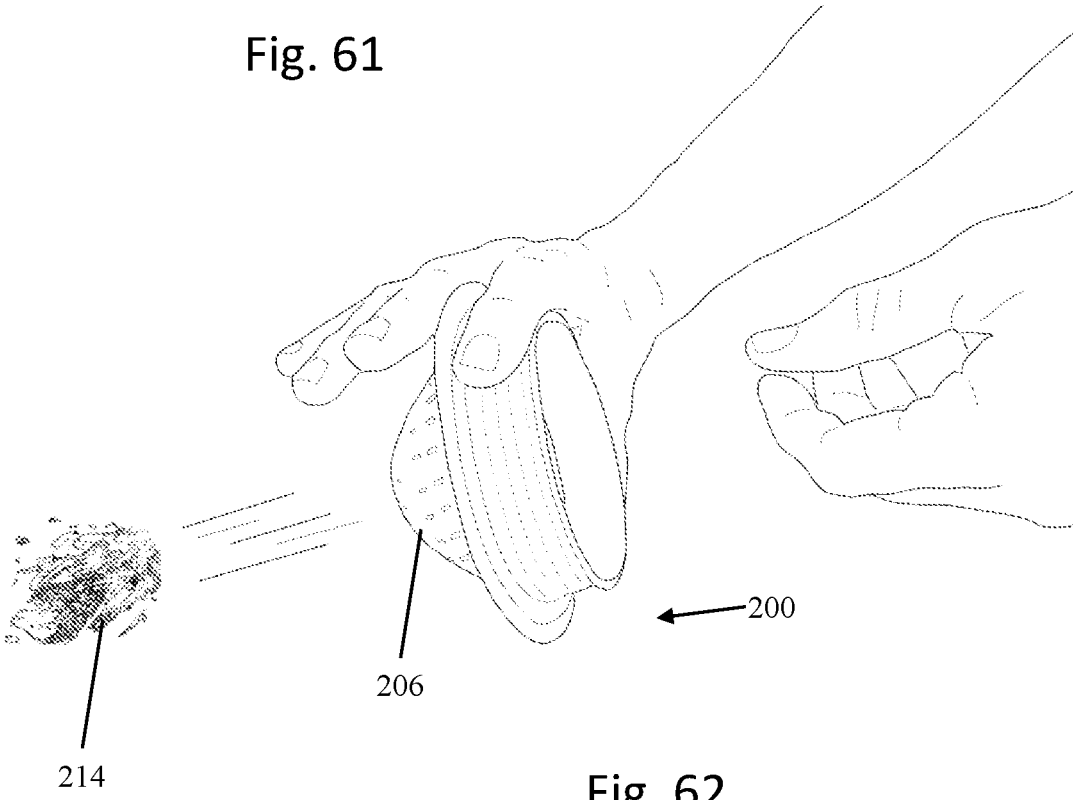
FIG. 62 is a schematic side perspective view of the drain strainer of FIG. 51 showing the waste material being ejected from drain strainer by releasing the pull tab.

FIG. 52 shows the grip surface 203 on the outer circumference of the grip body 202 and the tubular collar body 210 attached to the inner side of the grip body 202. The cylindrical nature of the collar body 210 and the grip body 202 allows a user to grasp with his or her hand around the grip body 202 to hold the strainer 200 with his or her hand in a comfortable manner, while simultaneously being able to pull the pull tab 208 downstream with the other hand as shown in FIGS. 61 and 62. The collar body 210 and grip body 202 are cylindrical and concentric with the drain strainer 200 but may take the form of other shapes such as an oval, square, or other irregular shapes. FIGS. 57 and 58 show the drain strainer 200 seated within a drain flange 211 with the strainer flange 201 positioned on and engaging the drain flange 211 in the rest position. The pull tab 208 is shown with clearance above the bottom of the drain 212 due to the recess 226 formed from the inversion of the bottom wall 224 of the basket 206. Another feature of the inverted bottom wall 224 is that it increases the surface area for which drain perforations can be located, thus increasing the speed at which the strainer can take and strain objects from water.

Figure 60:
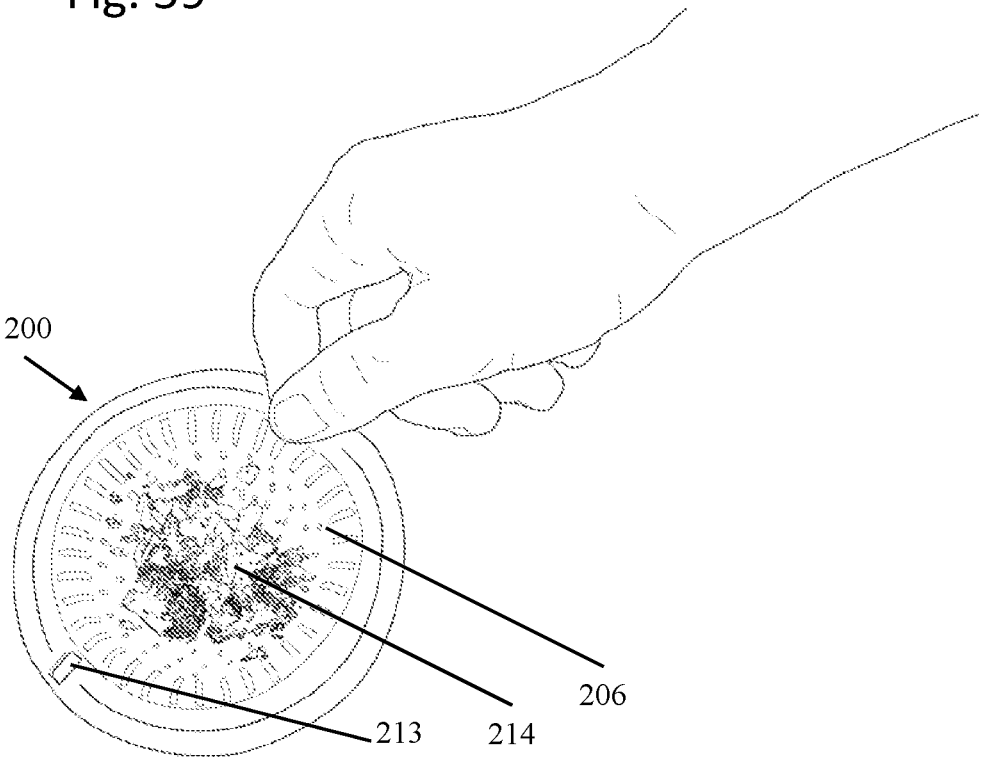
FIG. 60 is a schematic top view of the drain strainer of FIG. 51 being picked up from the drain.

In use, a user grasps the lift out tabs 213 and picks up the drain strainer 200 with waste 214 within the basket 206 as shown in FIG. 60. Then as shown in FIG. 61, a user holds the drain strainer 200 around the grip body 202 with one hand, and pulls back on the pull tab 208 along the longitudinal axis 240 with the other hand to pre-load the strainer by stretching the basket 206 to move the basket 206 relative to the strainer flange 201. Then, as shown in FIG. 62, the user releases the pull tab 208 such that the pre-loaded basket 206 converts potential energy to kinetic energy and creates momentum in the basket to eject the debris and expels the waste 214 from the basket 206.

Figure 63:
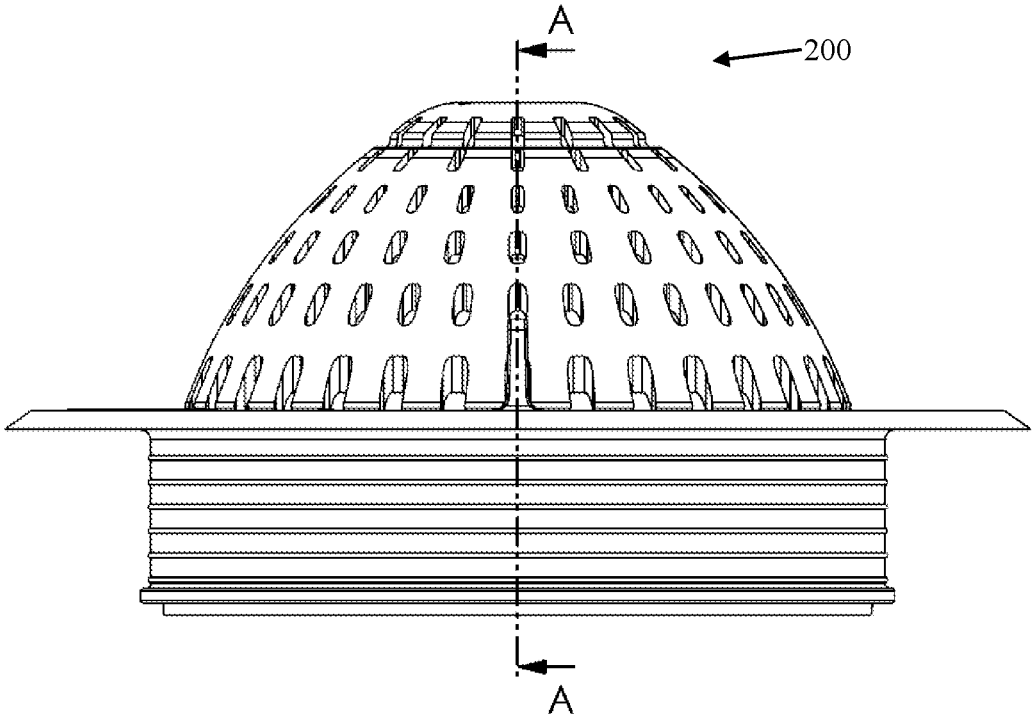
FIG. 63 is a view similar to FIG. 53 but with no hidden lines and with the drain strainer being in the inverted position for manufacturing it.
Figure 64:
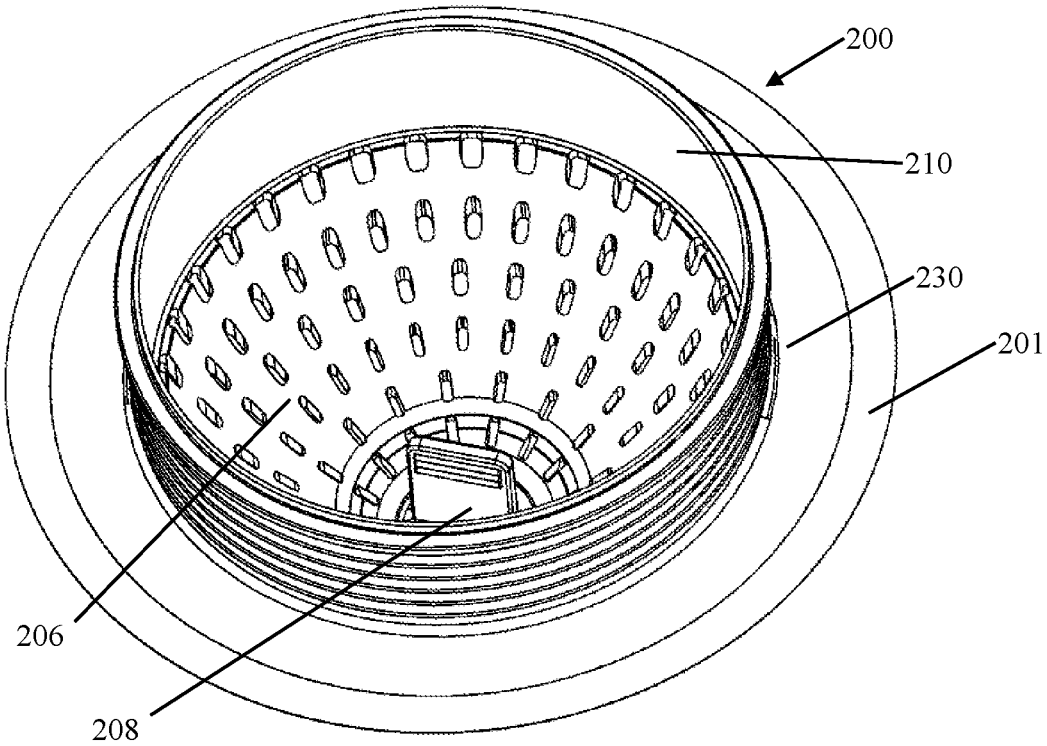
FIG. 64 is a bottom perspective view of the drain strainer of FIG. 51 in the inverted position for manufacturing it.

FIGS. 63 and 64 show the drain strainer 200 in a manufactured mode, wherein the strainer flange 201 is over-molded over the reinforcement collar 210 in the inverted/ejected position. The inverted "L"-shaped profile of the reinforcement collar presents many challenges to over-molding a silicone or TPE surface onto it. By molding the basket 206 in an inverted position, standard injection molding methods can be utilized. Specifically, the drain strainer is manufactured in the Up/Inverted Mode for ease to manufacture, since the collar 210 causes issues in injection molding when trying to mold the basket 206. The reinforcement collar may include holes 244 (FIG. 56) to allow the silicone to pass through during the over-mold process.

Figure 65:
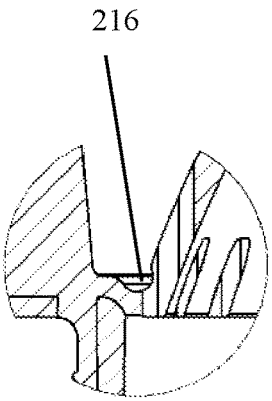
FIG. 65 is an enlarged part surrounded by circle B of FIG. 67.
Figure 66:
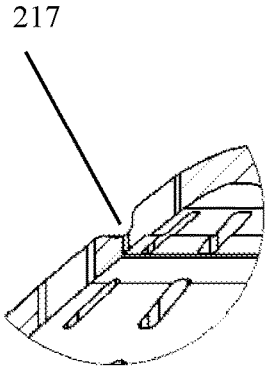
FIG. 66 is an enlarged part surrounded by circle C of FIG. 67.
Figure 67:
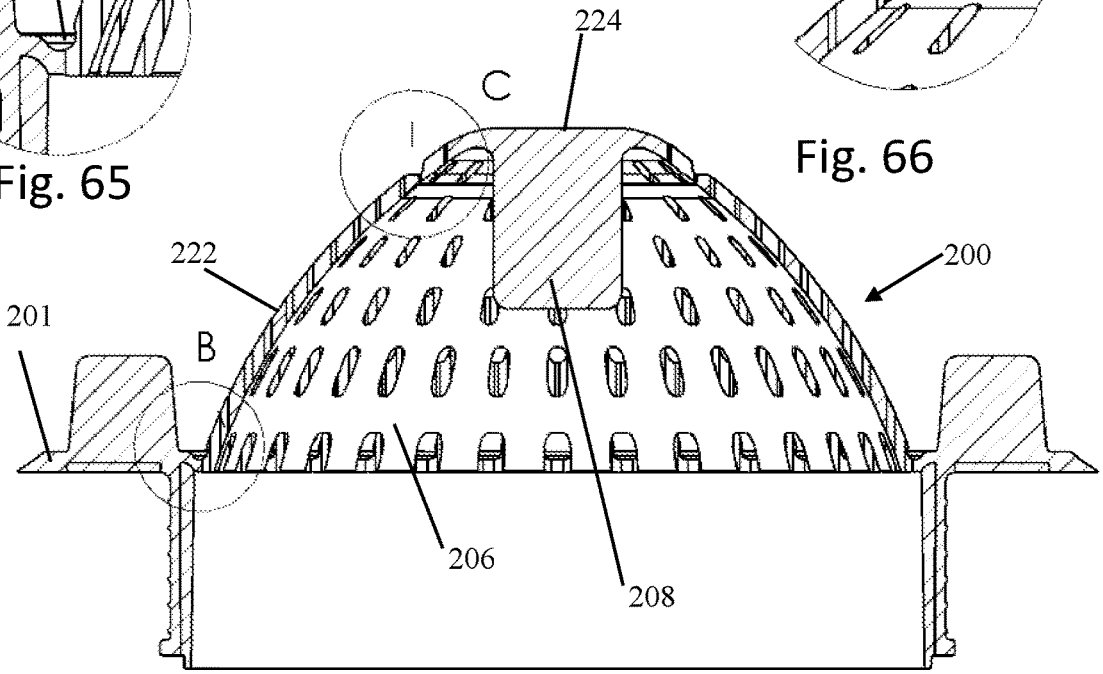
FIG. 67 a sectional view taken along line A-A of FIG. 63.
Figure 68:
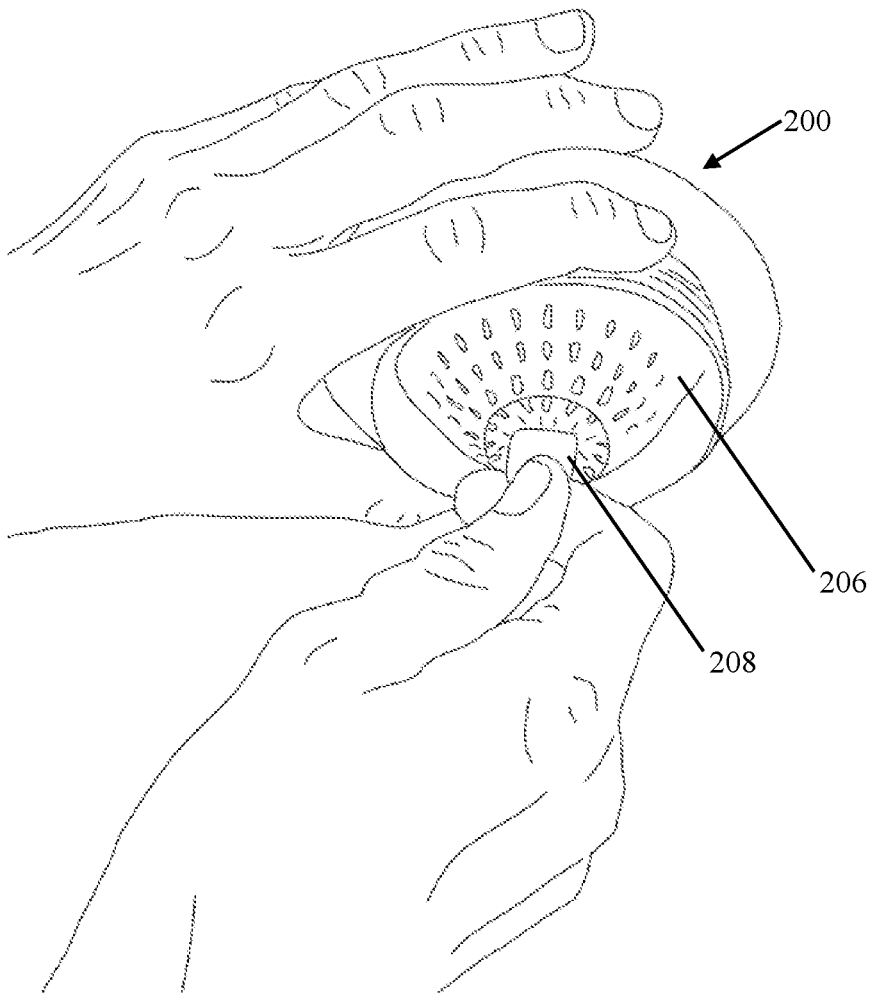
FIG. 68 is a schematic bottom perspective view of the drain strainer of FIG. 51 being held by a user just before being stretched.
Figure 69:
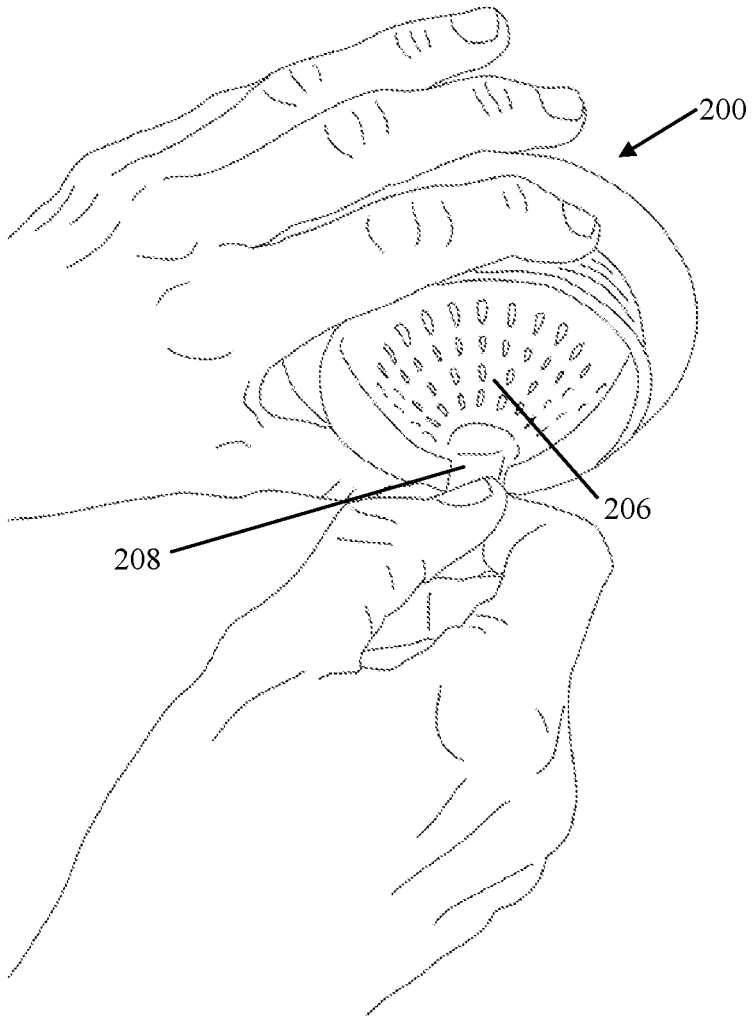
FIG. 69 is a schematic bottom perspective view of the drain strainer of FIG. 51 being partially stretched by a user.
Figure 70:
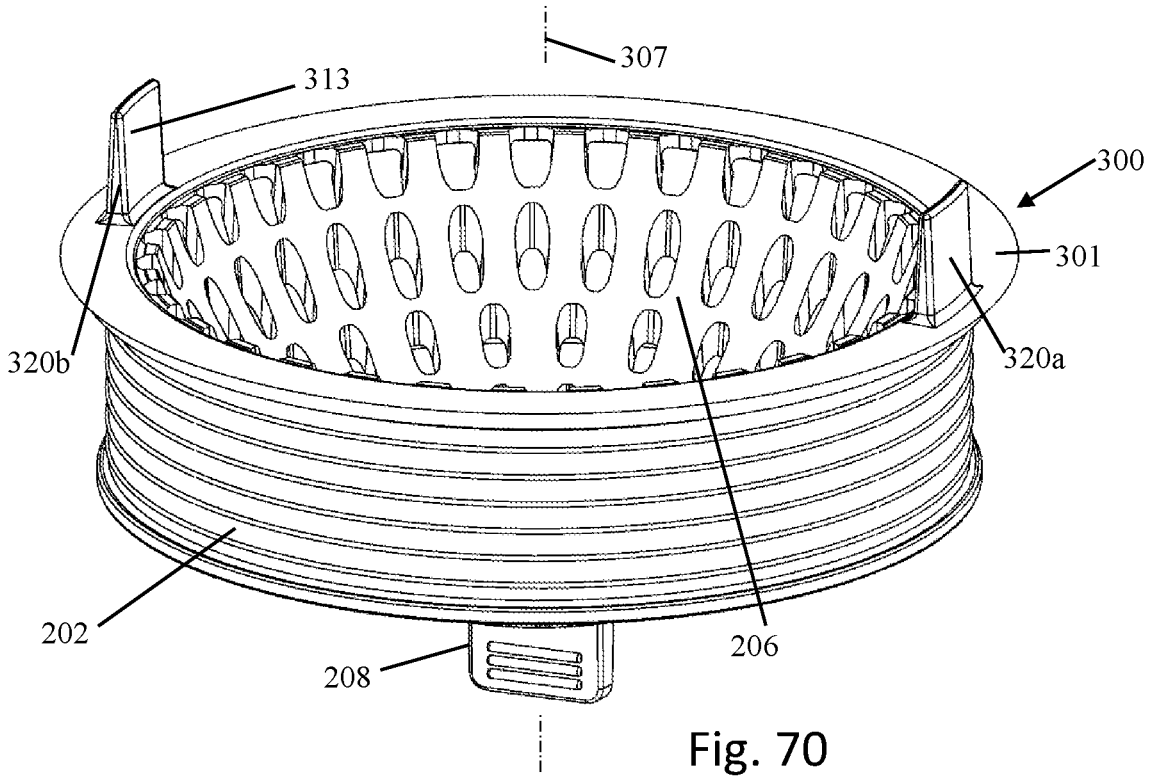
FIG. 70 is a top and side perspective view of a drain strainer according to another embodiment of the present invention.

As seen in figure FIGS. 65-67, the profile of the basket 206 utilizes first and second living hinges 216, 217. The first living hinge 216 is formed at the junction of the strainer basket 206 and the strainer flange 201 and extends around the strainer basket 206. The first living hinge 216 is configured to enable the side wall of the basket 206 to naturally invert or move between the "up" manufacturing mode position wherein the basket 206 is inverted and extends upwardly beyond the strainer flange 201 and the "down" operational mode position (FIG. 68), wherein the basket 206 is uninverted and extends downwardly beyond the strainer flange 201. The second living hinge 217 is formed at the junction of the bottom and side walls of the strainer basket 206 and extends around the bottom wall 224. The second living hinge 217 allows the center inversion portion 209 of the basket 206 to always naturally remain in the "up" mode, despite the side wall 222 of the basket 206 being in the "down" operational mode (FIG. 51). The center inversion portion 209 of the basket 206 only goes in the "down" mode when a user is pulling on the pull tab to stretch the entire basket 206. So, as the user starts to stretch/pre-load the basket 206, the user pulls slightly on the pull tab 208 to move the inversion portion 209 downwardly or downstream (as viewed in FIG. 51) along the longitudinal axis 240 until the recess 226 disappears as seen in FIG. 69. The user can then pull more to stretch the entire basket 206 to increase the strength of the slingshot action. The use of the first and second living hinges 216, 217 within the silicone material promotes normal inversion of the main body while keeping the very bottom of the basket 206 in the same orientation, despite the inversion.

Figure 71:
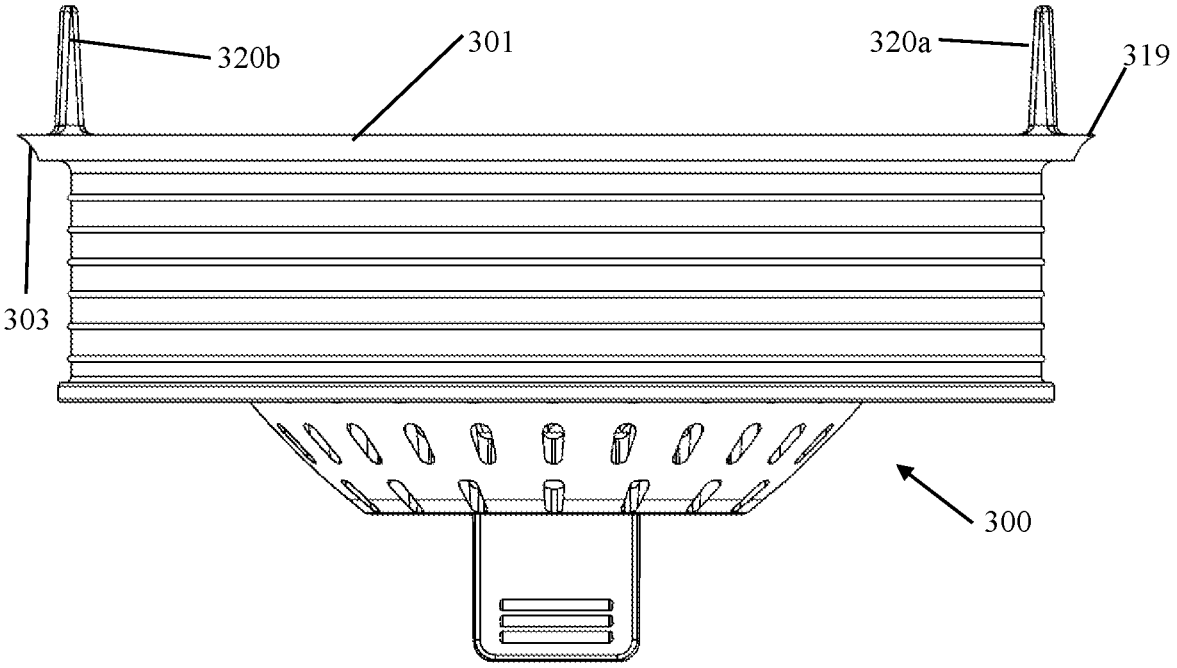
FIG. 71 is a side view of the drain strainer of FIG. 70.
Figure 72:
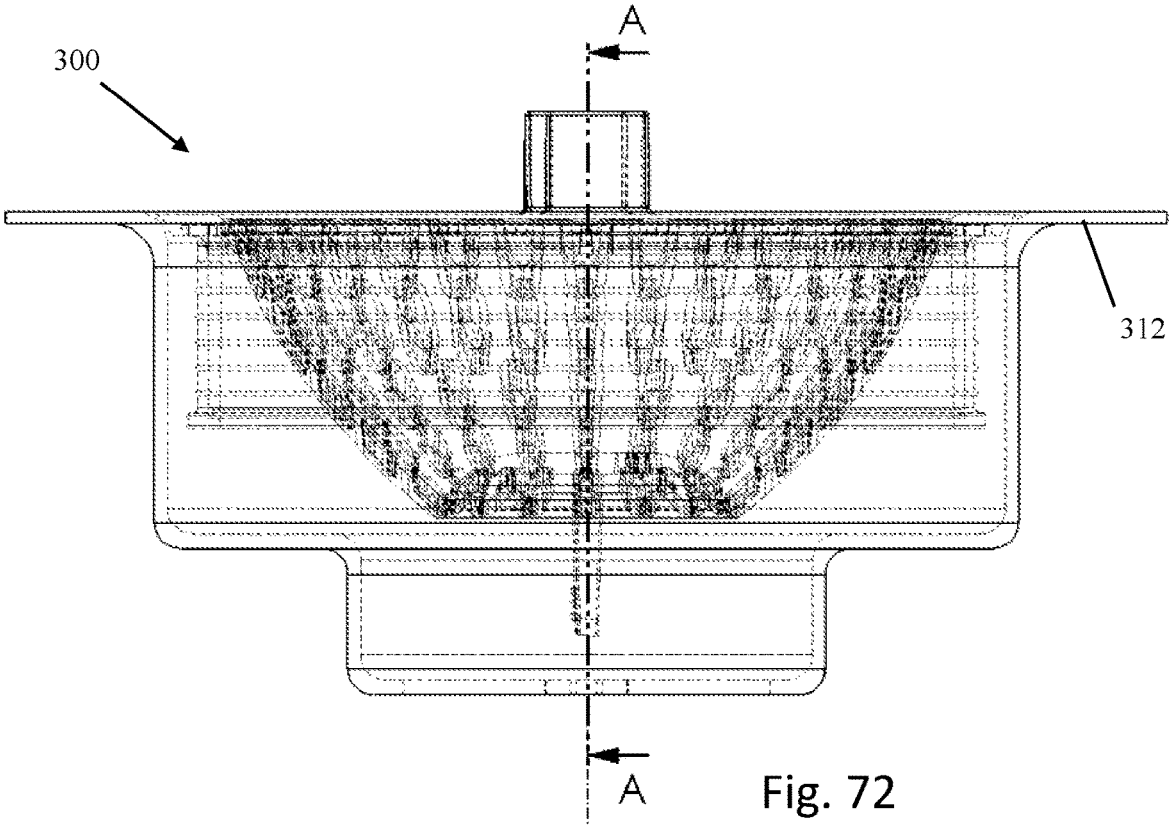
FIG. 72 is another side view of the drain strainer of FIG. 70 sitting in a drain and with dashed lines to indicate hidden elements.
Figure 73:
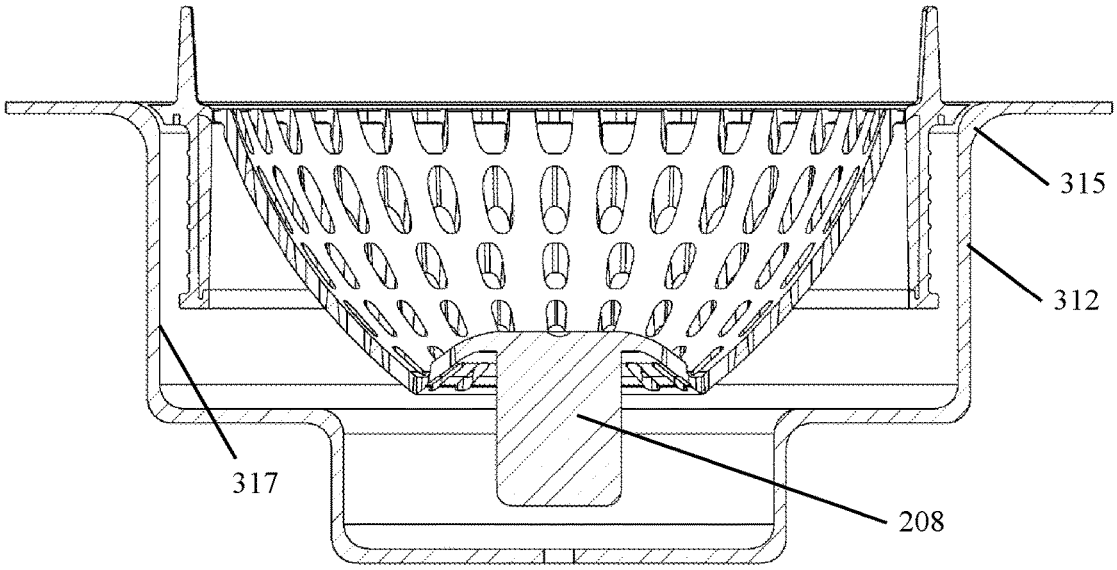
FIG. 73 a sectional view taken along line A-A of FIG. 72.

FIGS. 70-73 show a perspective view of another embodiment of the present invention. In this embodiment, the drain strainer 300 has a top strainer flange 301 that has a narrow width. The drain strainer 300 has lift out tabs 320*a*, 320*b* in which each tab is oriented circumferentially (relative to the longitudinal axis 307 along the drain strainer) along the strainer flange 301, such that one of the two opposite sides 313 having the largest area face the longitudinal axis 307 (FIG. 70) of the drain strainer. The strainer flange 301 has an underside 303 that slopes downwardly and inwardly from the outer edge of the strainer flange 301 to define a lip 319 as seen in FIG. 71. The underside of the lip 319 makes contact and engages with the inner side 317 of the drain flange 312 at the rim 315 of the drain flange 312, so that strainer flange 301 is flushed with the upper end of the drain flange 312 as seen in FIG. 73. The contact of the strainer flange 301 with the sink flange 312 at this location reduces the lip 319 that water would normally have to be high enough to get over.

This a notable difference since the bottom side of the strainer flange 201 in the previous embodiment shown in FIGS. 51-69 makes contact with the drain flange 211 on the top side of the drain flange 211, whereas this alternate embodiment makes contact with the drain flange 312 on the beveled outer circumferential wall of the strainer flange 301. All of the other elements of this embodiment are similar in structure and function to that of the embodiment shown in FIGS. 51-69. Thus, in the interest of brevity similar reference numbers are used to refer to elements that are similar in structure and function.

Figure 74:
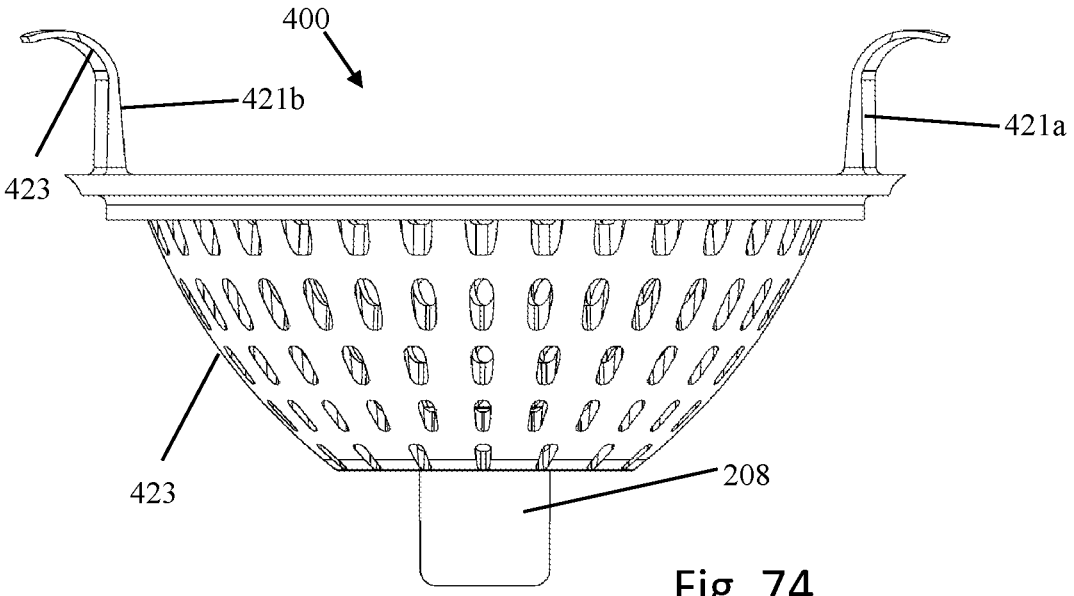
FIG. 74 is a side view of the drain strainer according to another embodiment of the present invention.
Figure 75:
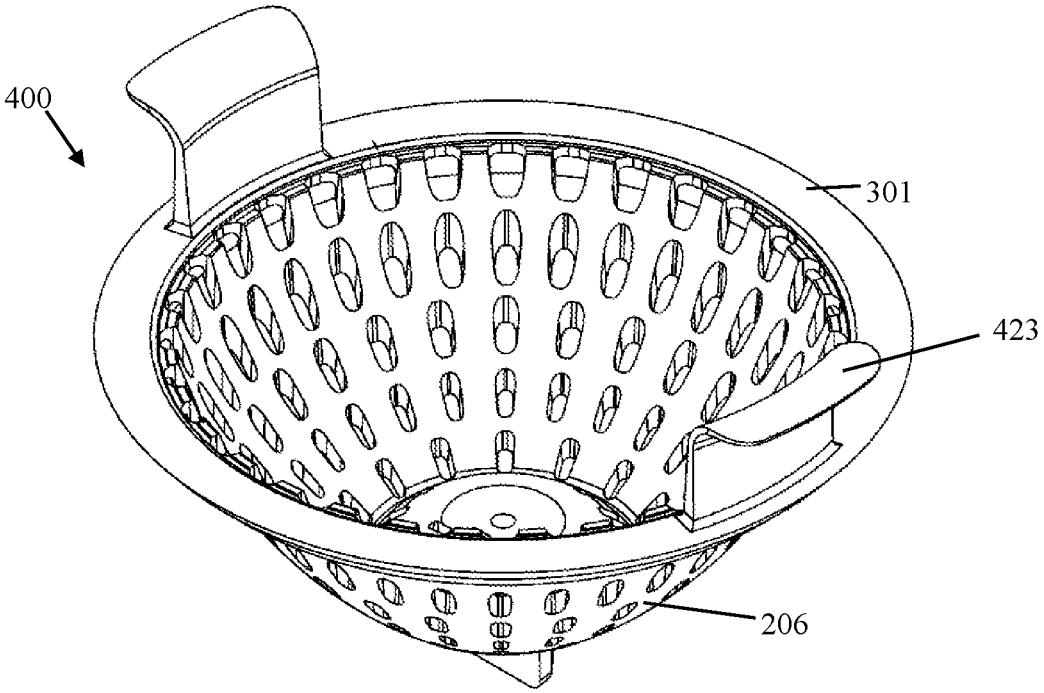
FIG. 75 is a top perspective view of the drain strainer of FIG. 74.
Figure 76:
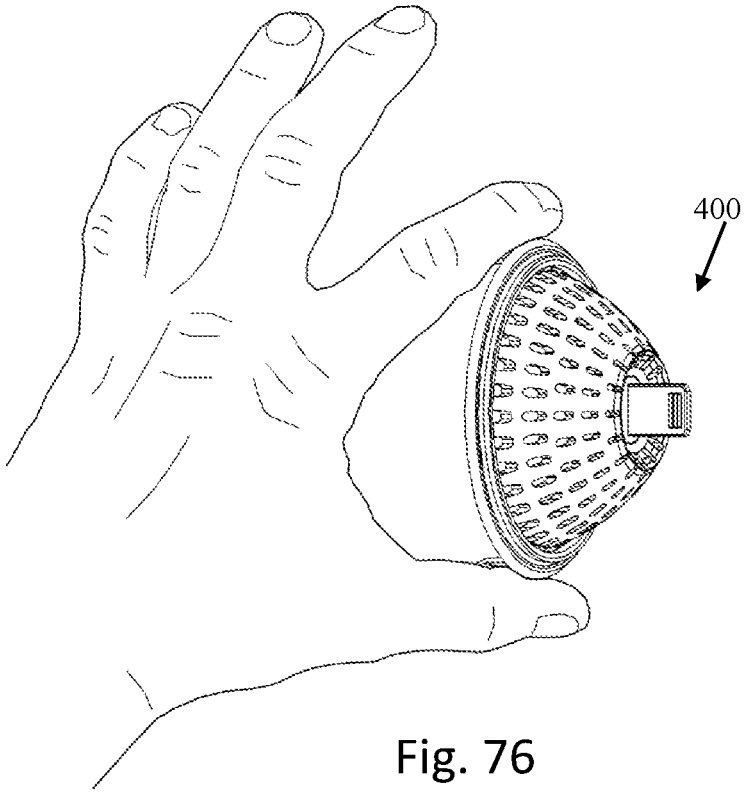
FIG. 76 is a side perspective view of the drain strainer of FIG. 74 being held by a user.

FIGS. 74-76 show another embodiment of a drain strainer 400. This embodiment is similar to the embodiment shown in FIGS. 70-73 except for the following. In this embodiment, the drain strainer has no lower grip surface or lower reinforcement collar. Further, this alternate embodiment features larger lift out tabs 421*a*, 421*b* that extend upwardly and then convexly curve outwardly to define c-shaped finger and thumb holders 423. FIG. 76 shows the user with his thumb and finger placed into their respective finger and thumb holders to enable the user to lift the drain strain off the sink drain and also to hold the drain strainer so that the user can pull the pull tab. All of the other elements of this embodiment are similar in structure and function to that of the to the embodiment shown in FIGS. 70-73. Thus, in the interest of brevity similar reference numbers are used to refer to elements that are similar in structure and function.

Figure 77:
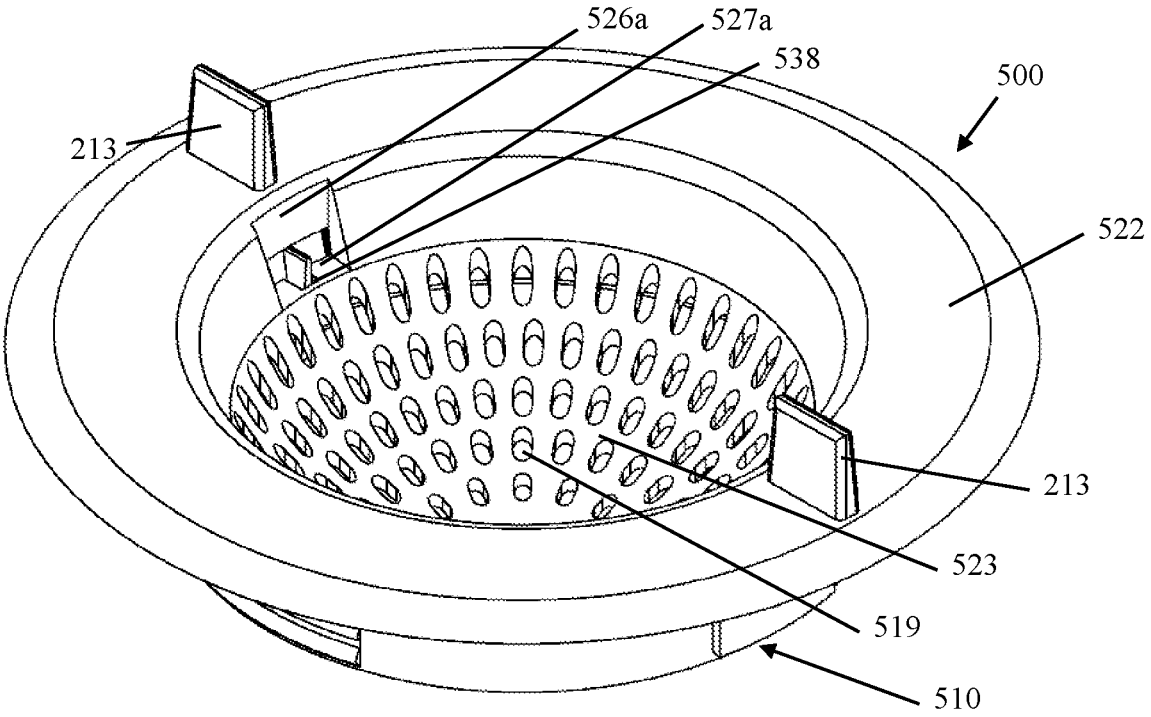
FIG. 77 is a top perspective view of a drain strainer according to another embodiment of the present invention.
Figure 78:
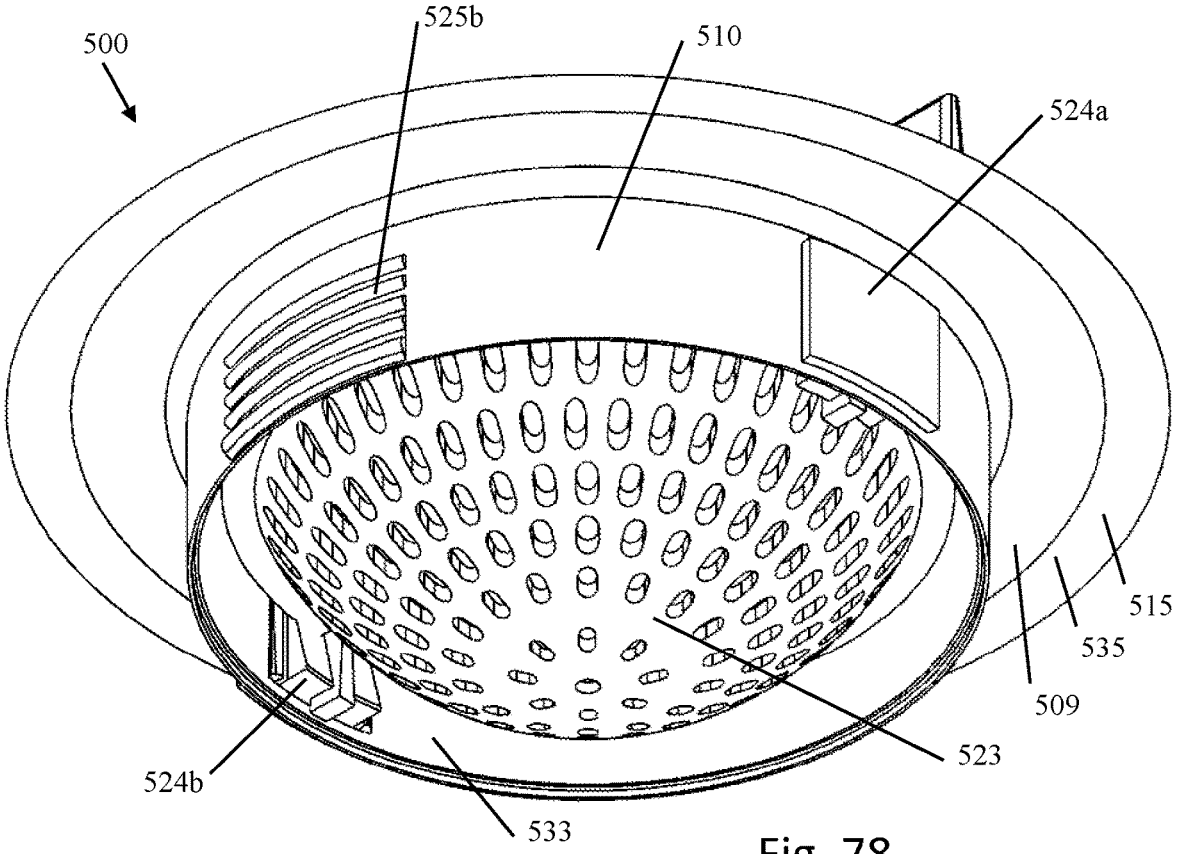
FIG. 78 is a bottom perspective view of the drain strainer of FIG. 77.

FIGS. 77-90 shows another embodiment of a drain strainer 500 that utilizes a push to set method to apply pre-load/tension to a drain strainer 500, and a squeeze to release method to release the tension and transform the potential energy to kinetic energy. As seen in FIG. 77, this alternate embodiment features an over-molded top strainer flange 522 that extends partially down to a rigid basket 523, and then is also over-molded to the rigid lower basket 523 with perforations 519 being formed in the basket 523 that allow water to flow through, but catch waste and other objects to prevent them from entering the drain. A reinforcement or grip collar 510 made of a rigid material is attached on the underside 535 (FIG. 78) of the strainer flange 522. In particular, the reinforcement collar 510 includes a flat collar flange 509 and a tubular collar body 533 as shown in FIG. 78. The tubular collar body 533 extends downwardly from the flat collar flange 509. The flexible and elastic material is molded over the collar flange 509. The collar material is suitable so that silicone has a chemical bond to it, however minor alterations to the collar could make it suitable for a mechanical bond as well. The strainer flange 522 also extends radially outward beyond the collar flange 509 to define the flexible outer end portion 515 of the strainer flange 522. The drain strainer 500 includes lift tabs 213 of similar construction and function as that of the embodiment shown in FIGS. 51-64.

Figure 79:
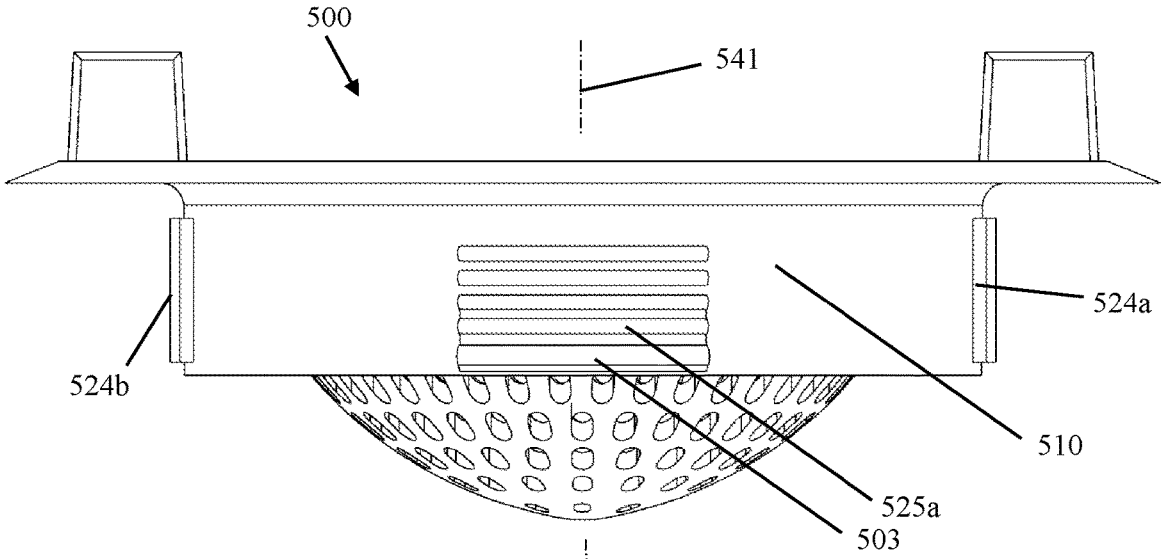
FIG. 79 is a side view of the drain strainer of FIG. 77.
Figure 80:
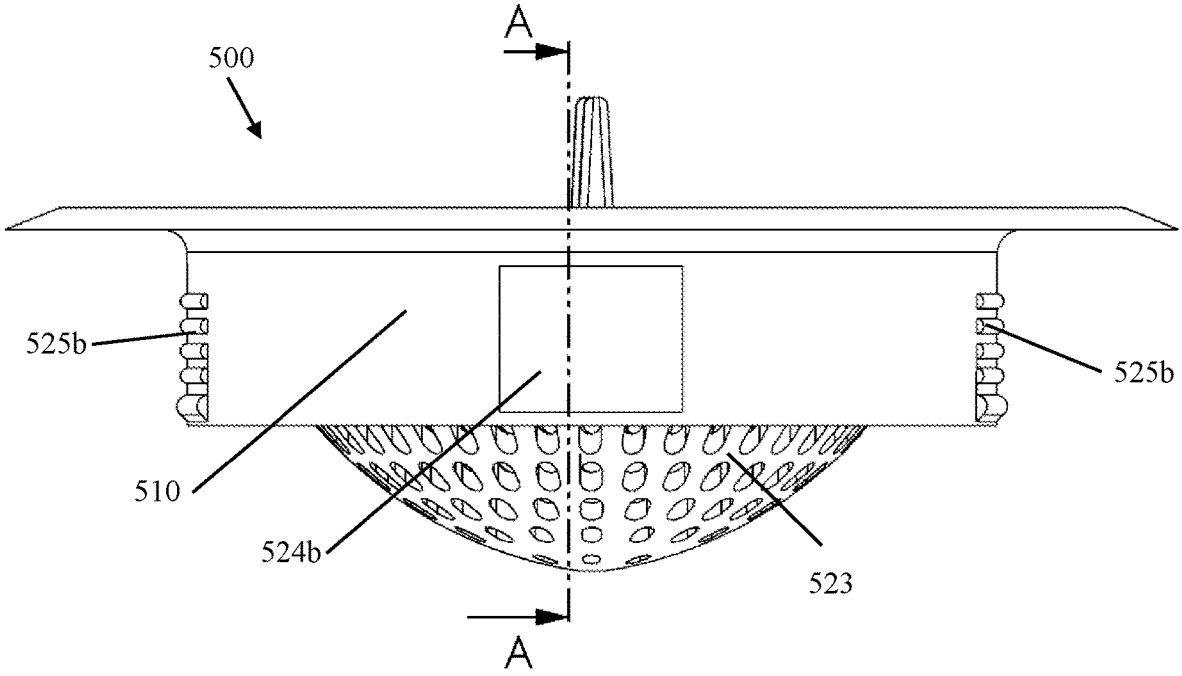
FIG. 80 is another side view of the drain strainer of FIG. 77.
Figure 81:
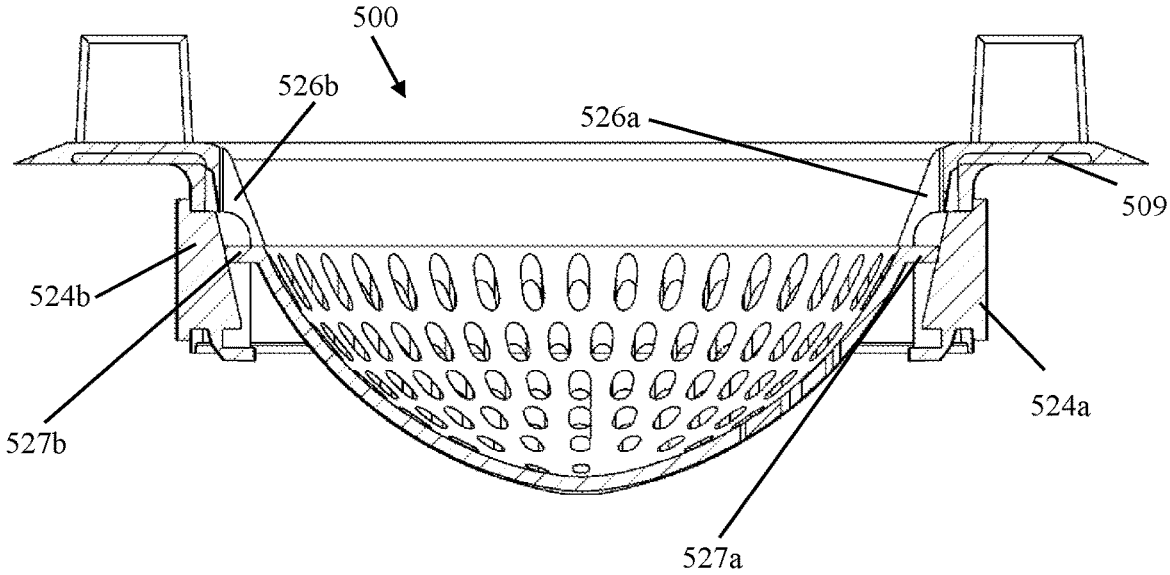
FIG. 81 is a sectional view taken along line A-A of FIG. 80.
Figure 82:
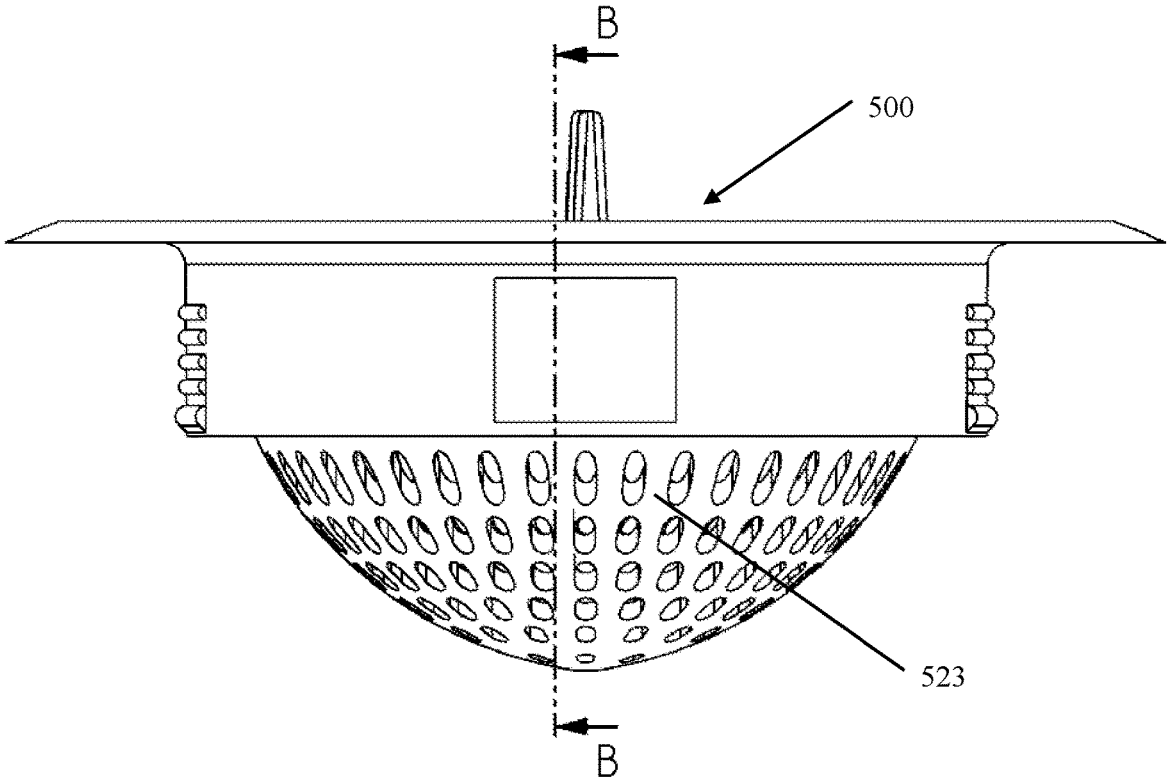
FIG. 82 is side view of the drain strainer of FIG. 77 when the basket is moved down in the extended position.
Figure 83:
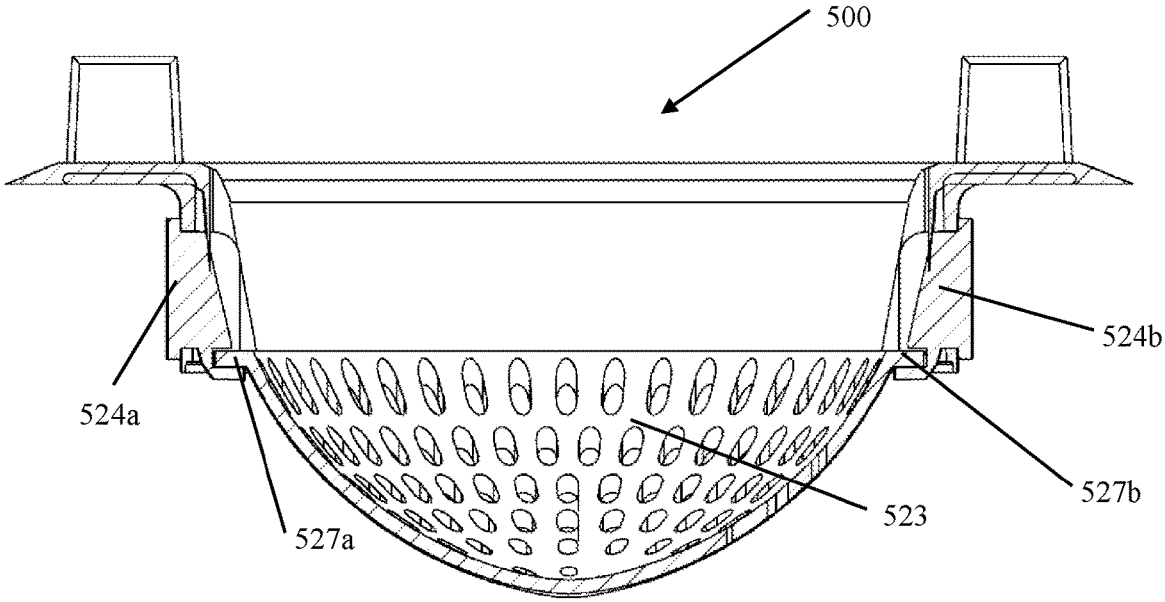
FIG. 83 is a sectional view taken along line B-B of FIG. 82.

The silicone/TPE that extends down into the basket 523 can stretch to store potential energy as seen in FIGS. 81 and 83. Two or more pockets or windows 526*a*, 526*b* in the silicone/TPE are provided, and leave a grip edge 527*a*, 527*b* exposed on the rigid lower basket 523 as seen in FIGS. 77 and 81. As illustrated in FIGS. 78 and 79, lock tabs 524*a*, 524*b* and grip surfaces 525*a* are provided on the collar body 533. The grip surfaces 525*a* are defined by grip elements in the form of ridges 503 formed on the outer side of the collar body 533.

Figure 84:
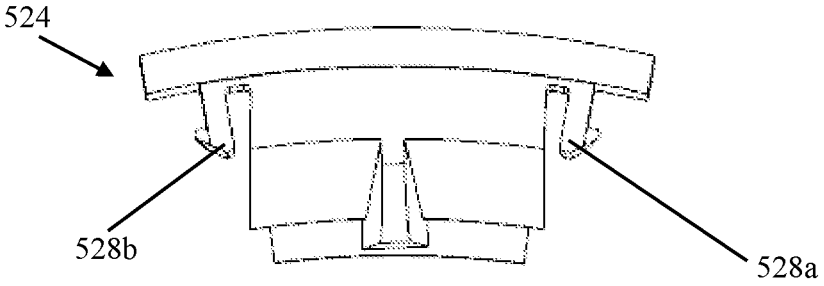
FIG. 84 is a top view of the lock tab of the drain strainer of FIG. 77.
Figure 85:
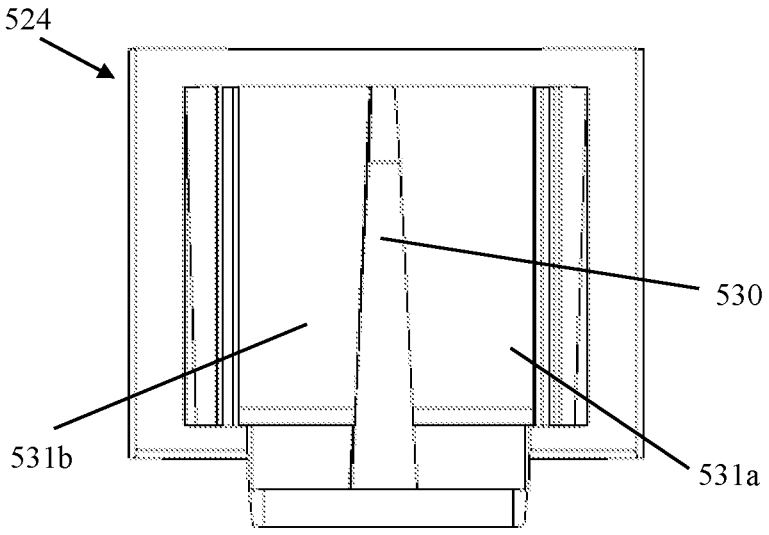
FIG. 85 is side view of the inner side of the lock tab of the drain strainer of FIG. 77.
Figure 86:
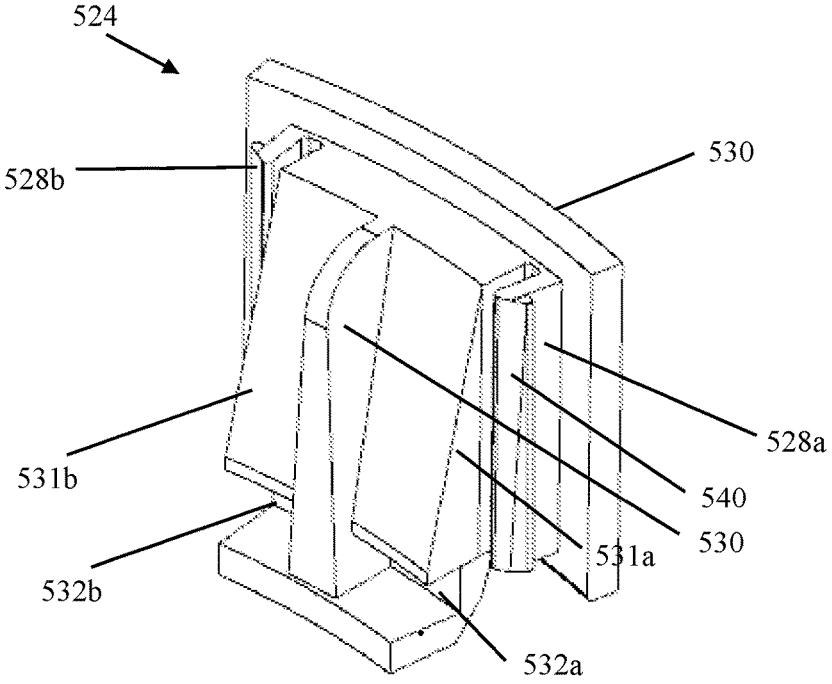
FIG. 86 is a top and side perspective view of the inner side of the lock tab of the drain strainer of FIG. 77.
Figure 87:
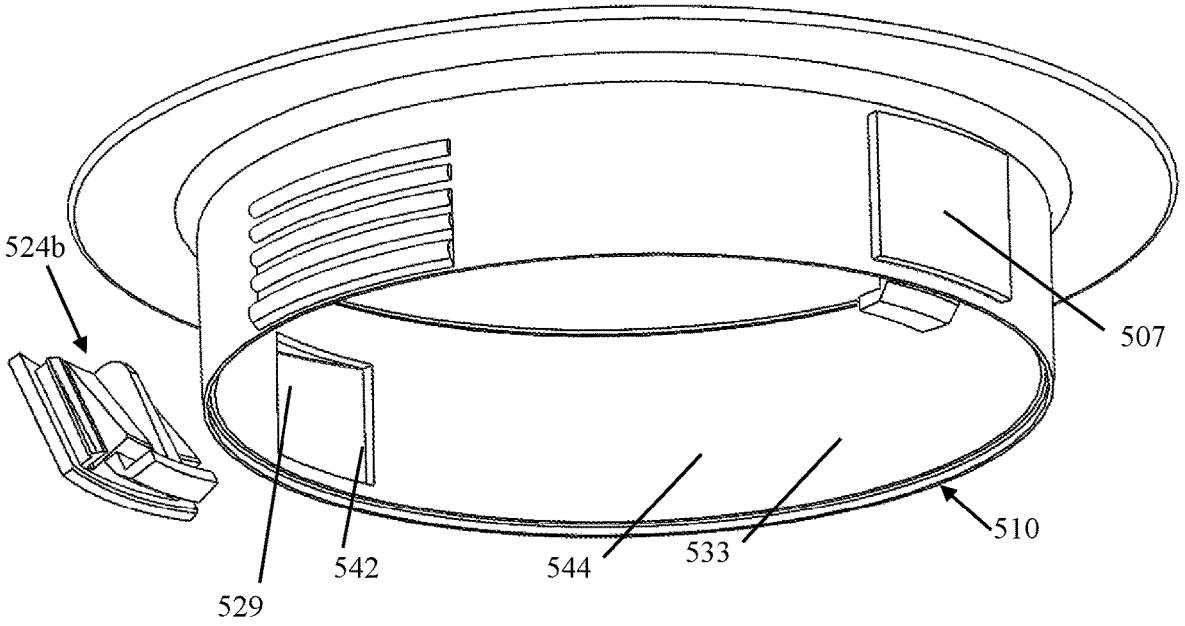
FIG. 87 is a side view of the grip collar of the drain strainer of FIG. 77 and with one lock tab installed in the grip collar and the other lock tab exploded from the collar.

As seen in FIGS. 84-86, each of the lock tabs 524*a*, 524*b* comprise two vertical lock elements 528*a*, 528*b* in the form of hooks that are attached to an outer cover portion 507 of the lock tab and extend outwardly (relative to lock tab) away from each other and then extend towards the outer cover portion 507. When the lock tab is being installed in the window 529 of the collar body 533, beveled sides 540 of the lock elements engage the edges 542 of the window causing the lock elements to move inwardly toward each other to enable the lock elements to extend through the window 529. Once the lock elements 528*a*, 528*b* extend through the window 529, the lock elements 528*a*, 528*b* then move outwardly away from each other and engage an inner side 544 of the collar body 533 to secure the lock tab 524 to the collar 510 in a bayonet type connection as shown in FIG. 87. FIG. 87 is a non-assembled view to highlight how the lock tabs 524 are inserted into the grip collar 510 after manufacturing is complete. The lock tab 524 is inserted with the bottom lock groove 532 first through the window of the grip collar 510. As the lock tab is fully inserted, the lock elements of the lock tab grab the inner side 544 of the collar body 533, which secures it to the grip collar.

As depicted in FIGS. 85 and 86, the lock tab 524 comprises a vertical guide wall 530, ramps 531*a*, 531*b*, and lock grooves 532*a*, 532*b*. These elements are attached to the cover portion 507. The guide wall 530 is located between the ramps 531*a*, 531*b*, and the ramps 531*a*, 531*b* are located between the lock elements 528*a*, 528*b*. The ramps slope downwardly and away from the cover portion 507. The basket 523 has slots 538 (FIG. 77) in the grip edges 527*a*, 527*b* that receive the guide walls 530 of the lock tabs 524*a*, 524*b*. In the rest position of the drain strainer 500, the grip edges 527*a*, 527*b* contact their respective ramps 531*a*, 531*b* as shown in FIGS. 78 and 81 before the basket is stretched down. As the basket 523 is pushed downstream along a longitudinal axis 541 (FIG. 79) of the drain strainer 500, the grip edges 527*a*, 527*b* slide down along their corresponding ramps 531*a*, 531*b* of both lock tabs 524*a*, 524*b*. This action causes the grip collar 510 to flex and widen. As the basket 523 reaches the bottom, the grip edges, 527*a* and 527*b*, disengage from their ramps 531*a*, 531*b* and strike the bottom edge of their lock grooves 532*a*, 532*b*. With the outward force removed from the grip collar 510, the grip collar 510 retracts back to its normal shape and moves inwardly with the lock tabs 524*a*, 524*b* such that grip edges 527*a*, 527*b* are inserted into their respective lock grooves 532*a*, 532*b*, thereby securing the grip edges 527*a*, 527*b* of the basket 523 in the lock grooves 532*a*, 532*b* as shown in FIG. 83.

Figure 88:
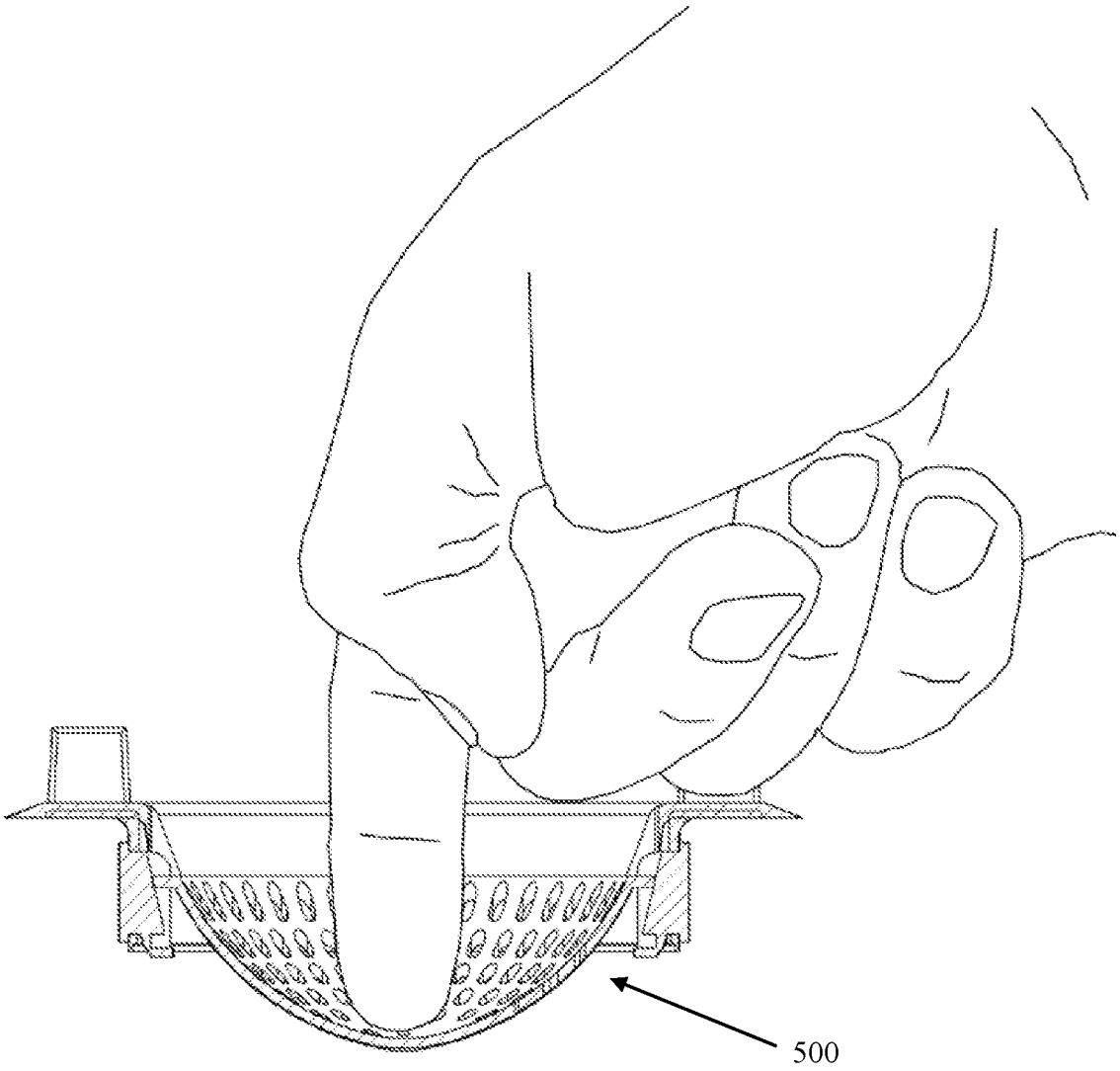
FIG. 88 is a view of the drain strainer similar to FIG. 81 and with a user starting to push the basket down.
Figure 89:
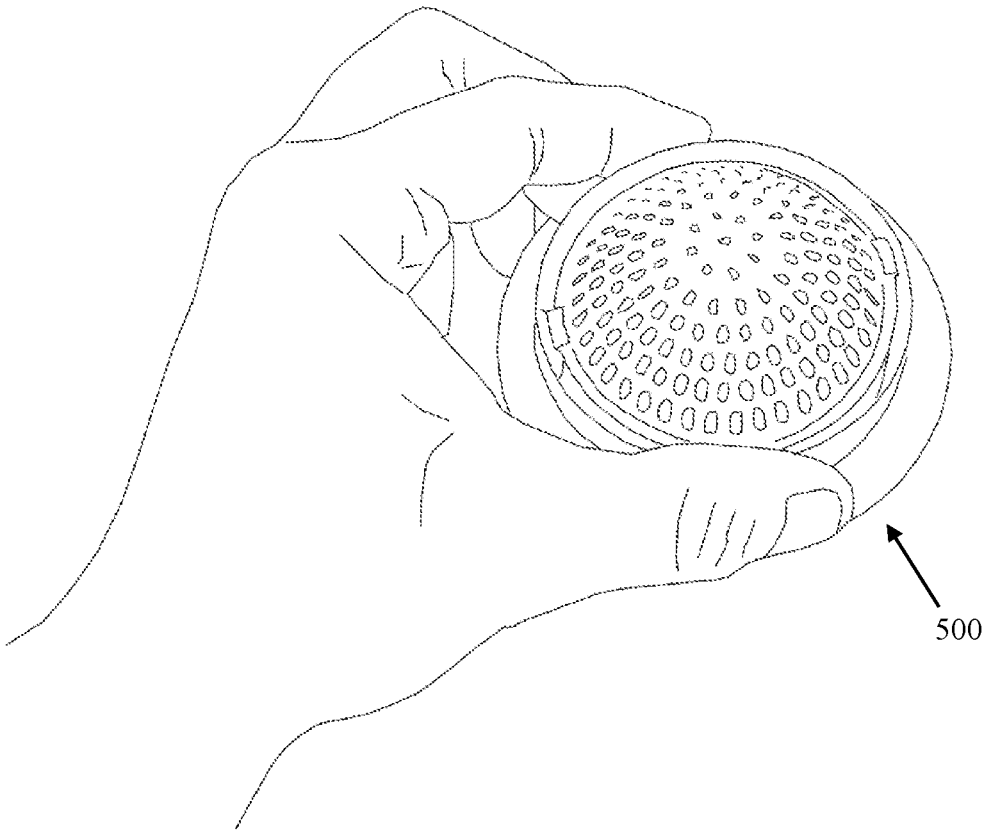
FIG. 89 is a bottom perspective view of the drain strainer of FIG. 77 with a user holding the drain strainer in an unreleased state.

FIG. 83 shows the basket in the pre-loaded configuration, where the grip edges 527*a*, 527*b* of the basket 523 are locked into the lock grooves 532*a*, 532*b* of the lock tabs 524*a*, 524*b*. When the lower portion of the basket 523 is pushed and locked down, the upper silicone/TPE portion of the basket 523 stretches and remains in a pre-loaded potential energy state. The potential energy state can instantly be transformed into kinetic energy whereby the basket 523 seeks to return to its original unstretched state. FIG. 88 shows a user ready to push down on the rigid basket 523 to pre-load the drain strainer 500, and FIG. 89 shows a user holding a pre-loaded drain strainer 500 before ejection.

Figure 90:
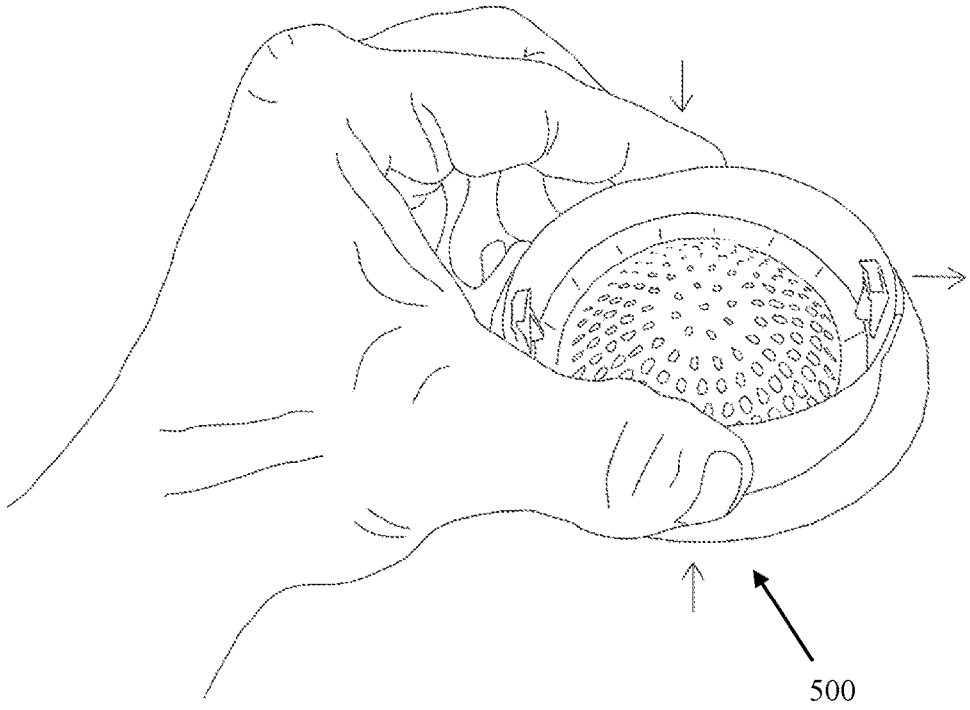
FIG. 90 is a bottom perspective view of the drain strainer of FIG. 77 with a user squeezing the drain strainer to release the strainer from the lock tabs.
Figure 91:
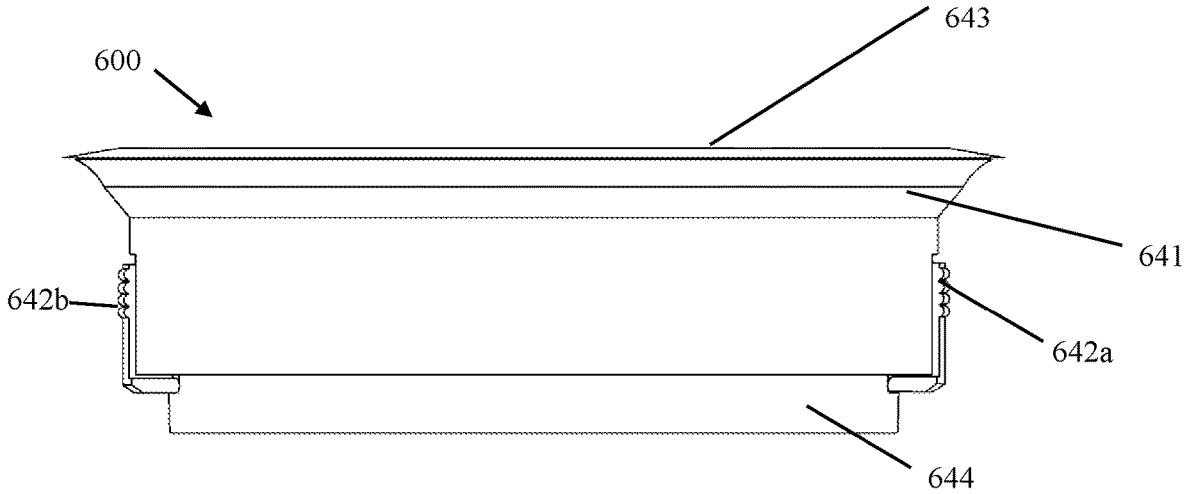
FIG. 91 is a side view of a drain strainer according to another embodiment of the present invention.
Figure 92:
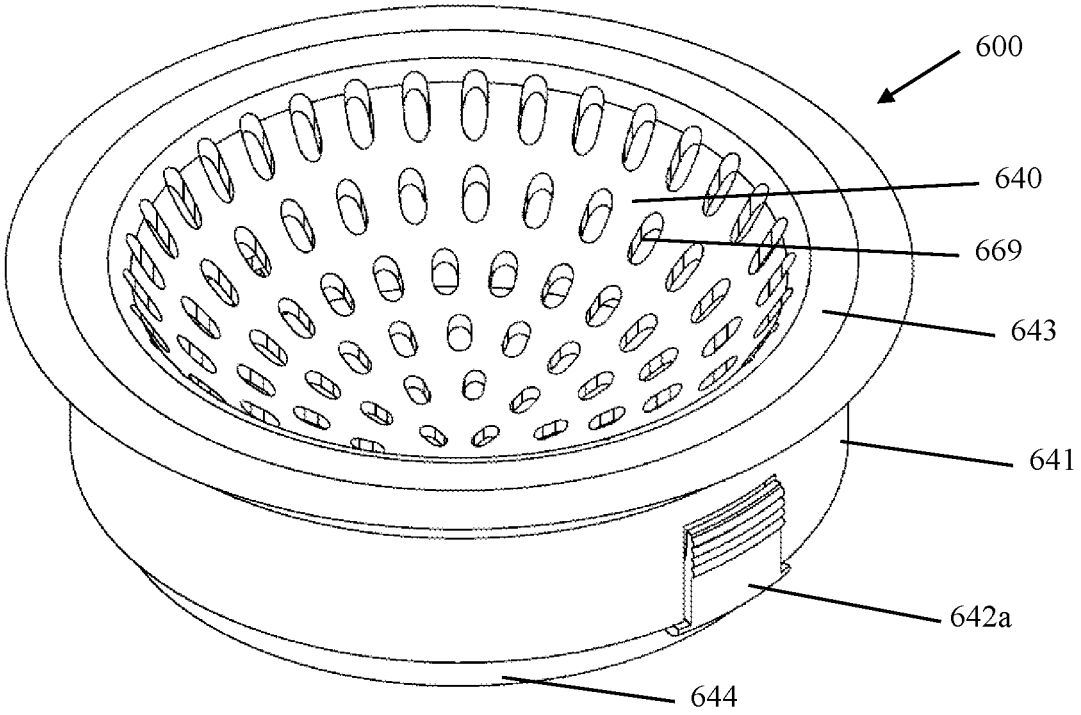
FIG. 92 a top perspective view of the drain strainer of FIG. 91.
Figure 93:
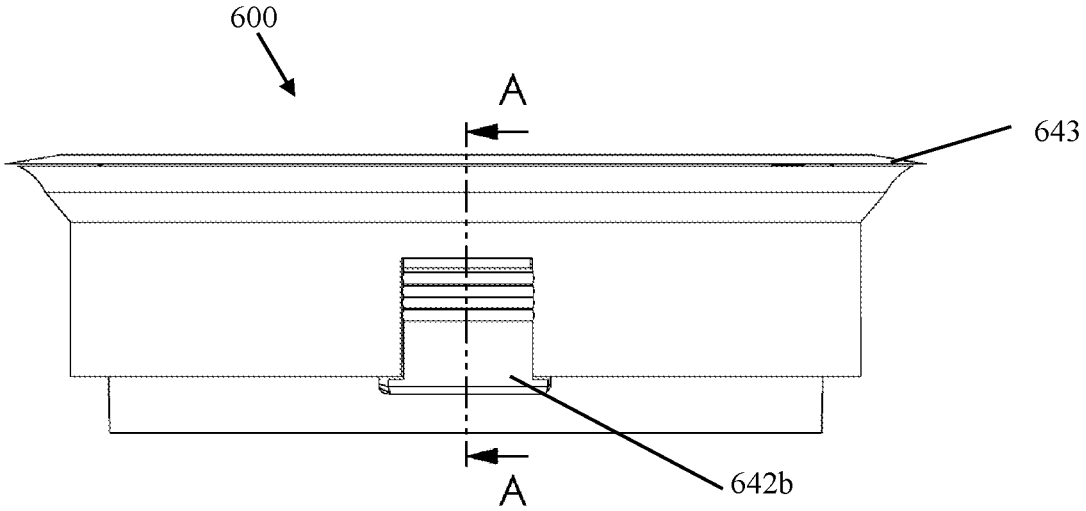
FIG. 93 is another side view of the drain strainer of FIG. 91.

FIG. 90 shows a user squeezing the grip collar 510, and the basket 523 is unlocked and released from the lock tabs 524*a*, 524*b*. The user performs this conversion by squeezing the two grip surfaces 525*a*, 525*b* located opposite of the tabs on the grip collar 510. By squeezing the grip surfaces, the grip collar wall bends into an oval which subsequently widens the area of the lock tabs. The lock tabs widen and move away from the basket and release the basket 523. The basket is immediately propelled upstream, which creates momentum in the basket 523, and in turn, ejects all the contents that were within the basket 523 as seen in FIG. 90.

FIGS. 91-102 show another embodiment of a drain strainer 600. In this embodiment, the drains strainer 600 has a cylindrical external housing 641 that sits within a drain flange. This embodiment features a top flange 643 that includes a basket structure 640 that sits within the external housing 641. The basket 640 includes perforations 669 that allow water to flow through, but catch waste and other objects to prevent them from entering the drain. The basket 640 is made of a rigid material such as plastic or metal. The drain strainer 600 includes a vertical or near vertical wall 644 that is integrally formed with and depends downwardly from the top flange 643 and rests next to a bottom lip 645 (FIG. 99) of the housing 641. The drain strainer 600 has a biasing member in the form of a spring 652 (FIGS. 94, 96, 98, 100, 102) that is wound around the vertical wall 644 and undergoes compression during the pre-load phase. Other types of biasing members may be used instead of a spring such as, for example, a compressive rubber element. This drain strainer 600 includes lock tabs 642*a*, 642*b*. Each of the lock tabs 642*a*, 642*b* is similar in structure and function. Similar reference numbers will be used for similar elements in each of the lock tabs 642*a*, 642*b*.

Figure 97:
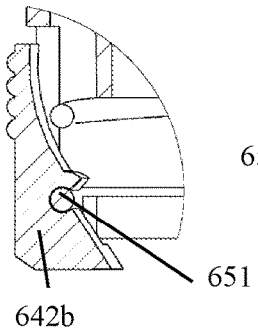
FIG. 97 is an enlarged part surrounded by circle D of FIG. 98.
Figure 98:
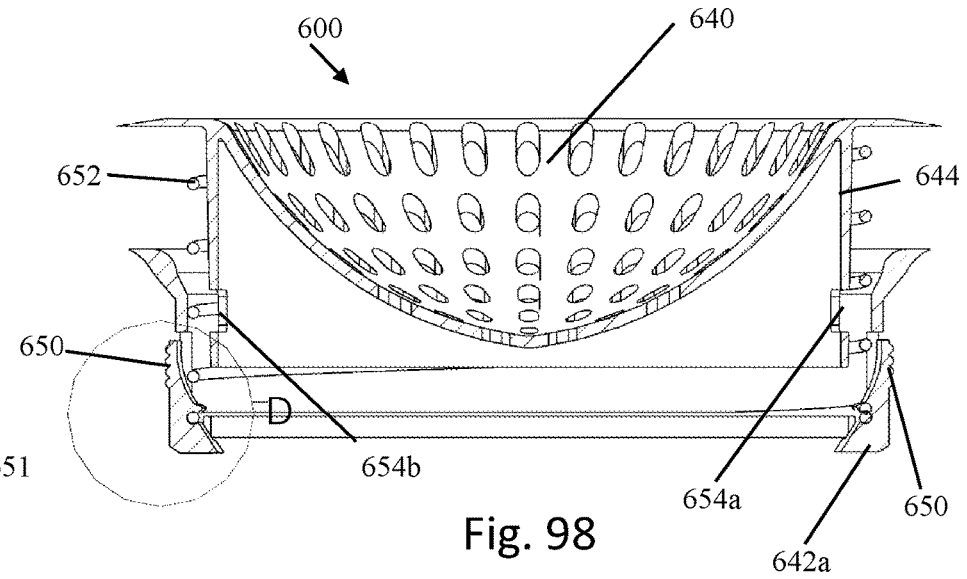
FIG. 98 is a sectional view taken along line C-C of FIG. 96.
Figure 99:
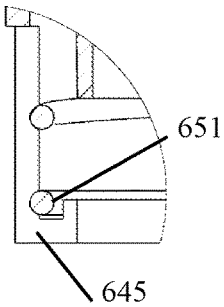
FIG. 99 is an enlarged part surrounded by circle D of FIG. 100.
Figure 100:
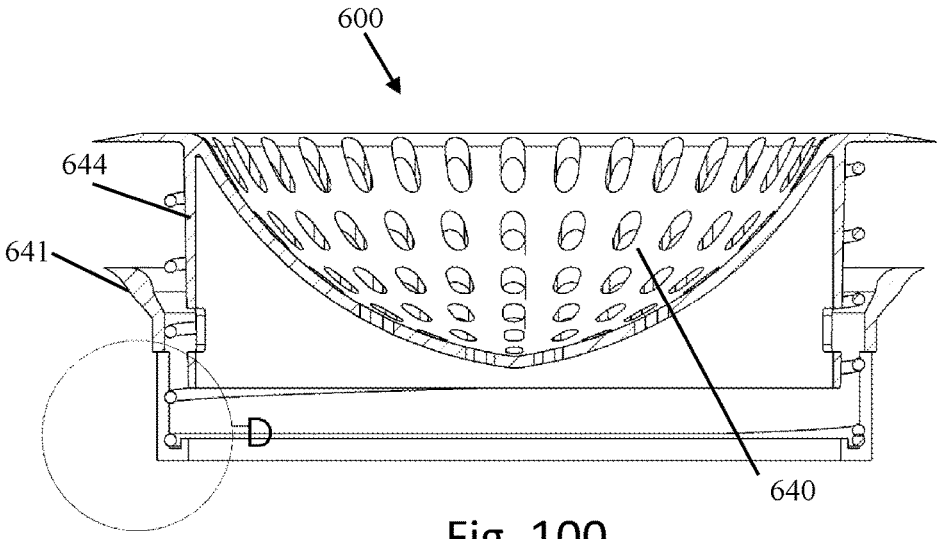
FIG. 100 is a sectional view taken along line C-C of FIG. 96, but without the lock tabs.
Figure 101:
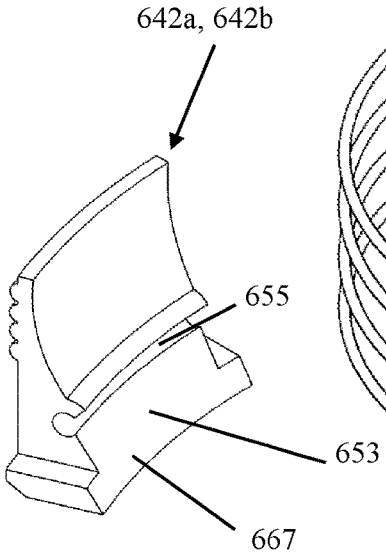
FIG. 101 is a top perspective view of a lock tab of the drain strainer of FIG. 91.
Figure 102:
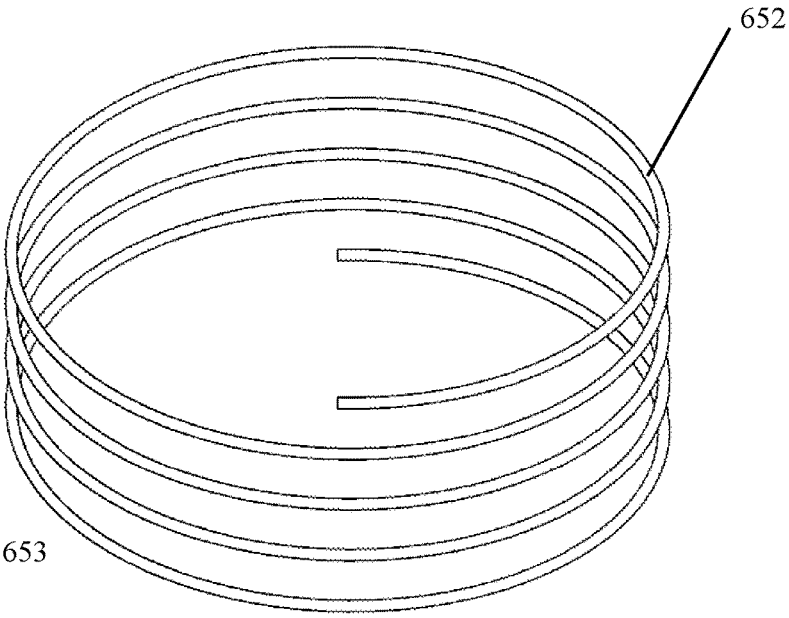
FIG. 102 is a perspective view of the spring of the drain strainer of FIG. 91.

FIGS. 97 and 98 show the lock tab 642*b* installed onto a bottom ring 651 of the compression spring 652. Each of the lock tabs 642*a*, 642*b* has grip elements in the form of ridges 656 (FIG. 95) on its outer side that defines a grip surface area 650. Each of the lock tabs 642*a*, 642*b* has an inner arcuate groove 655 (FIG. 101) that receives the bottom ring 651. The bottom ring 651 of the spring 652 acts as a pivot point whereby each of the lock tabs 642*a*, 642*b* can then rotate slightly around the spring 652. Each of the lock tabs 642*a*, 642*b* features a ramp 653 (FIG. 101). When a user presses inward on the grip surface area 650 of the lock tab, the ramp 653 will move outward and away from the wall 644.

Figure 94:
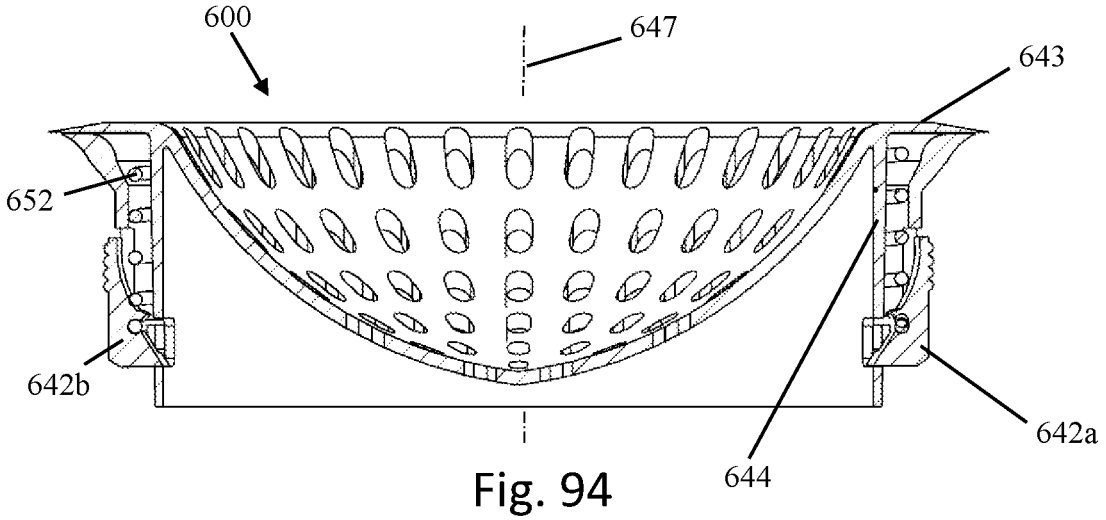
FIG. 94 is a sectional view taken along line A-A of FIG. 93.
Figure 95:
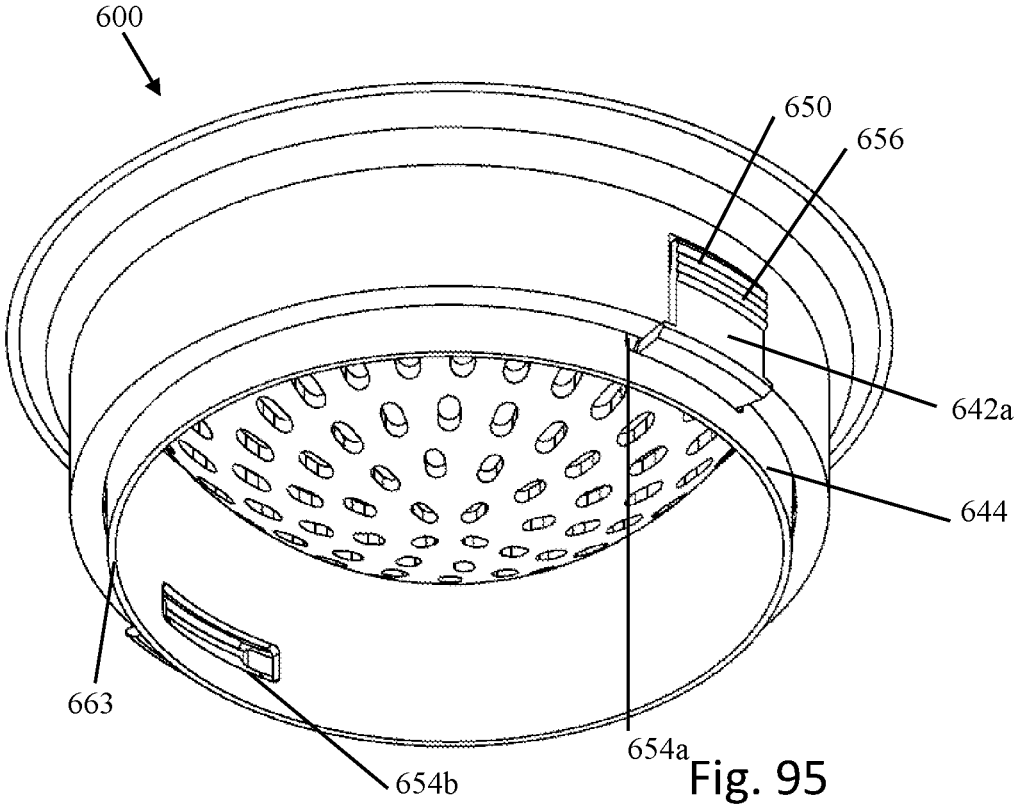
FIG. 95 is a bottom perspective view of the drain strainer of FIG. 91.
Figure 96:
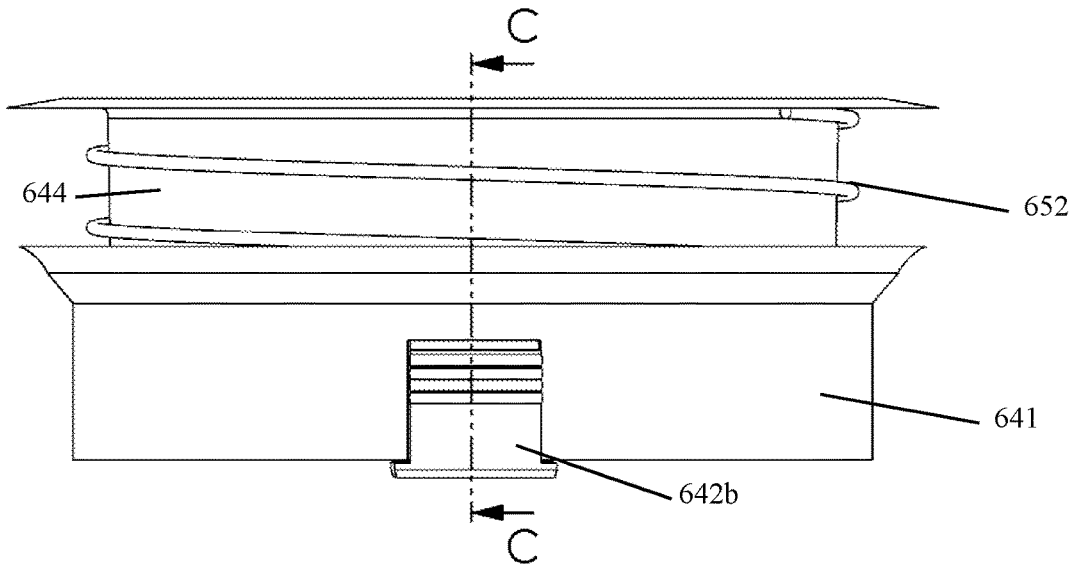
FIG. 96 is a side view of the drain strainer similar to FIG. 93, but with the drain strainer in the ejection mode in which the waste is ejected.

To pre-load the drain strainer 600 from its rest position, a user pushes down on the basket 640. This moves the vertical wall 644 downstream along a longitudinal axis 647 (FIG. 94) of the drain strainer 600 relative to the housing 641. The bottom 663 of the vertical wall 644 strikes the ramps 653*a*, 653*b* of the lock tabs 642*a*, 642*b*. This will kick the bottom 667 (FIG. 101) of each lock tab 642 away from the vertical wall 644 until windows 654*a*, 654*b* (FIG. 95) within the vertical wall 644 become exposed below the housing 641. The lock tabs 642*a*, 642*b* then engage into the windows 654*a*, 654*b* and thereby lock the vertical wall 644 in place which keeps the compression spring 652 in a compressed, potential energy state as seen in FIG. 94. In the compression spring's natural state, the upper portion's flat flange sits above the lower portion's top edge in a compressed/potential energy state with lock tabs 642*a*, 642*b* engaged.

As the user pushes on the grips 650 of the lock tabs 642*a*, 642*b*, the bottom 667 of each lock tab swings away from each window whereby the vertical wall 644 is released and the potential energy of the spring is converted to kinetic energy. This immediately moves the wall 644 and basket 640 axially away from the user (or upstream relative to the drain strainer being positioned in the drain), which creates momentum in the basket 640, and thereby ejects the contents within the basket 640.

Figure 103:
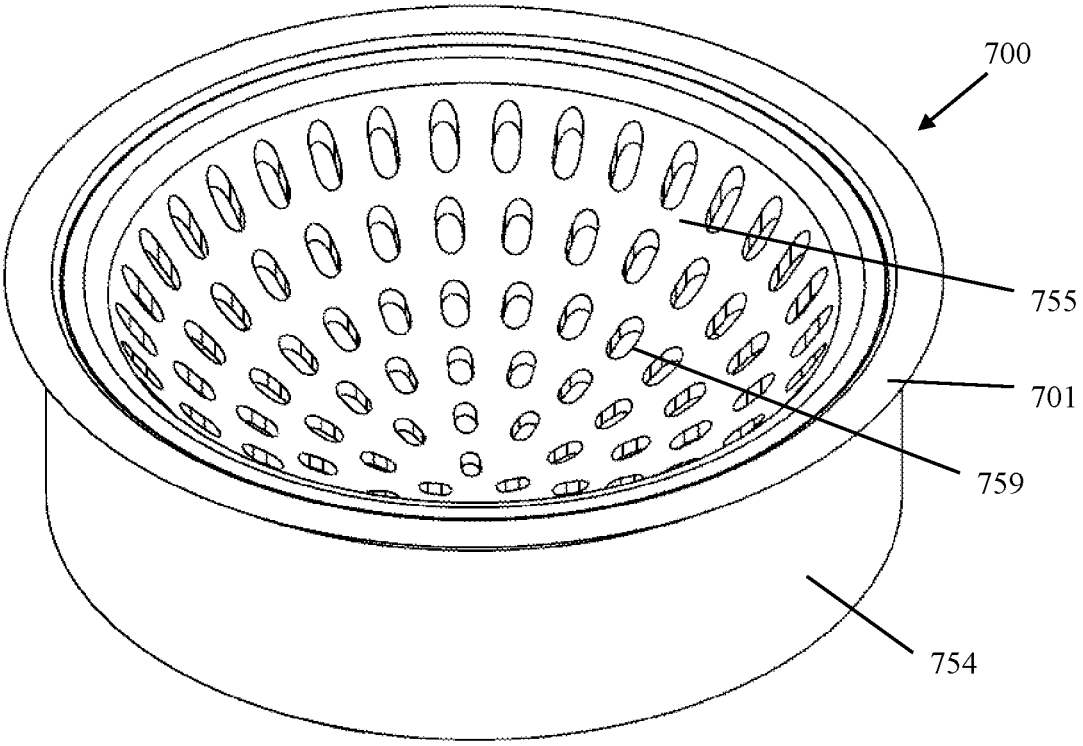
FIG. 103 is a top perspective view of a drain strainer according to another embodiment of the present invention.
Figure 104:
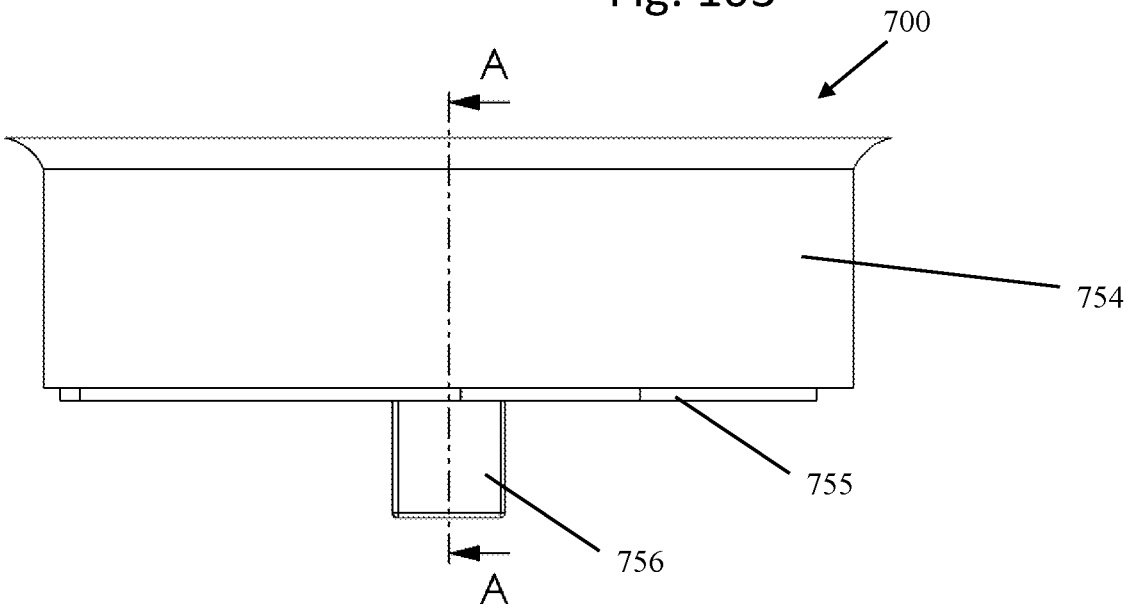
FIG. 104 is a side view of the drain strainer of FIG. 103.
Figure 105:
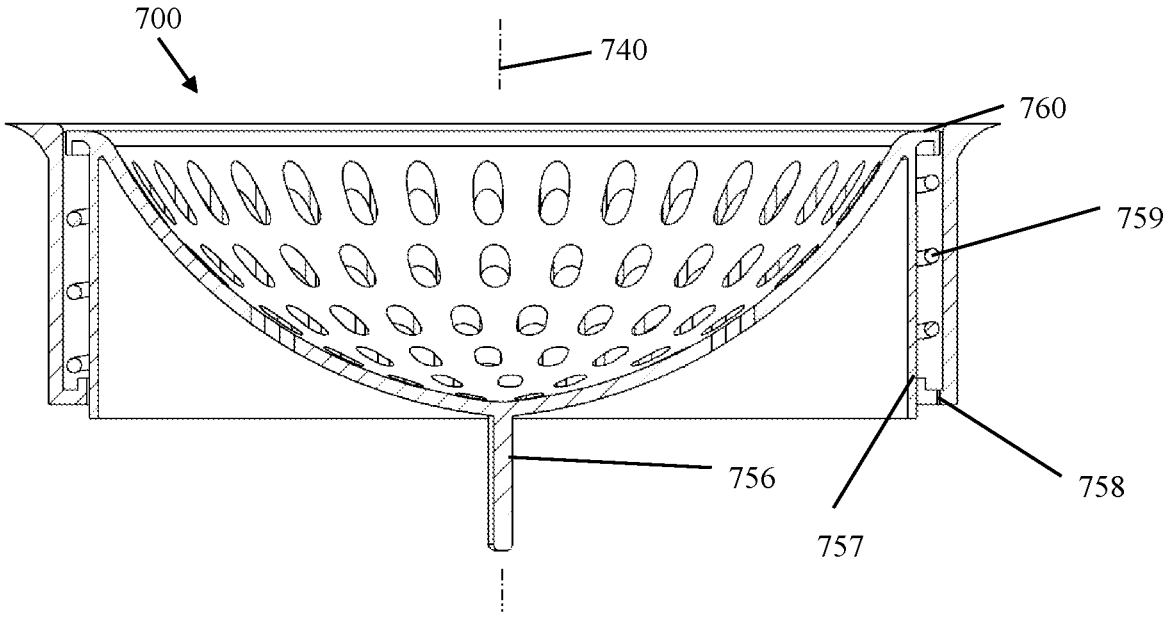
FIG. 105 is a sectional view taken along line A-A of FIG. 104.

FIGS. 103-108 show another embodiment of a drain strainer 700. This embodiment is a compression spring style strainer with manual pull/release pre-load and activation. As seen in FIG. 103, this alternate embodiment features an external housing 754 that sits within a drain flange. The drain strainer 700 includes a strainer flange 701. An internal structure and basket 755 is provided and features a pull tab 756 on the bottom of the basket 755 as seen in FIG. 104. The basket 755 includes perforations 750 that allow water to flow through, but catch waste and other objects to prevent them from entering the drain. The basket 755 is made of a rigid material such as plastic or metal. As shown in FIG. 105, the internal structure also features a vertical wall 757 that rests next to a bottom spring lip 758 of the housing 754. A compression spring 759 sits in between the external and internal structures, such that the bottom of the spring 759 rests in the bottom spring lip 758, and the top of the spring rests in an upper spring lip 760 which is incorporated into the internal structure at the top of the basket 755.

Figure 106:
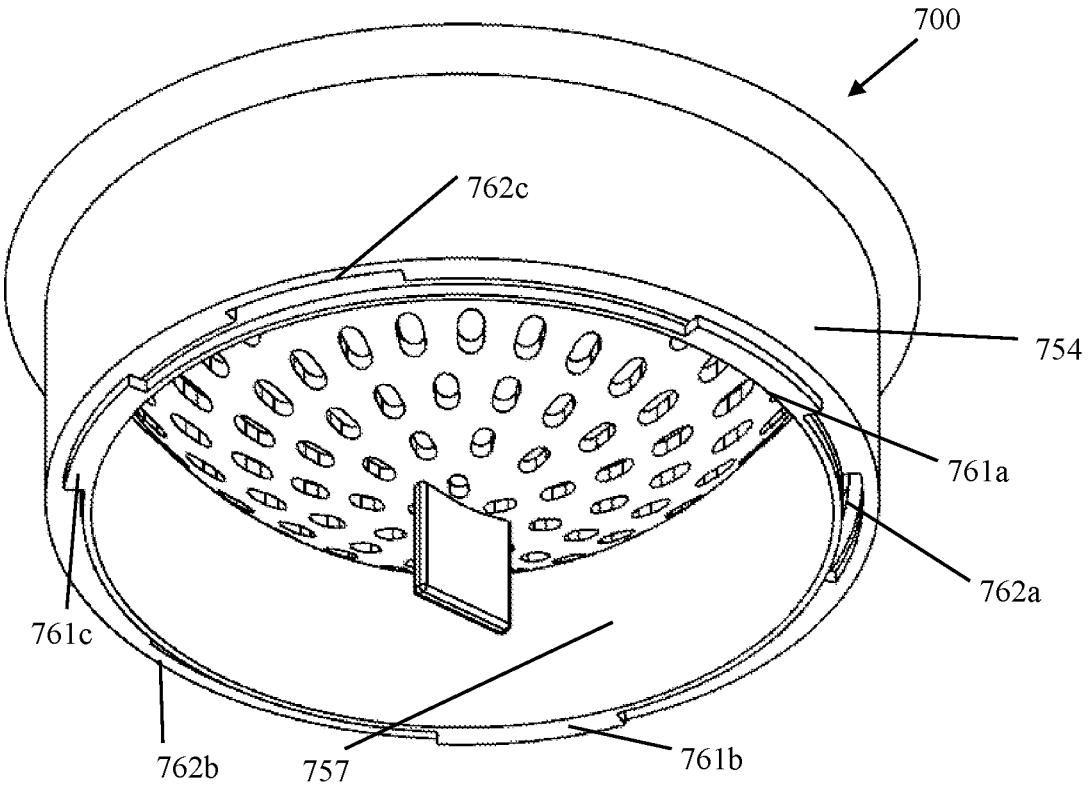
FIG. 106 is a bottom perspective view of the drain strainer of FIG. 103.

Referring to FIG. 106, the vertical wall 757 of the internal structure can be seen extending beyond the bottom of the housing 754 of the external structure. Multiple tabs 761*a*, 761*b*, 761*c* are formed on the bottom of the vertical wall and laterally extend outwardly beyond the vertical wall 757. The tabs prevent the strainer from coming apart after it has been assembled. The housing 754 includes slots 762*a*, 762*b*, 762*c* on its bottom that are of similar shape as the tabs but are sized slightly larger to enable the tabs to extend through when aligned to them. This arrangement provides a way to install the wall 757 and basket 755 into the housing 754 then twist one relative to the other to keep the unit together. Specifically, the slots 762*a*, 762*b*, 762*c* are aligned with their respective tabs 761*a*, 761*b*, 761*c* and then housing 754 is moved upwardly relative to the vertical wall 757 until the tabs extend through their slots. Then, the housing 754 is rotated relative to the vertical wall 757 until the tabs are moved away from the slots, thereby locking the vertical wall 757 to the housing 754.

Figure 107:
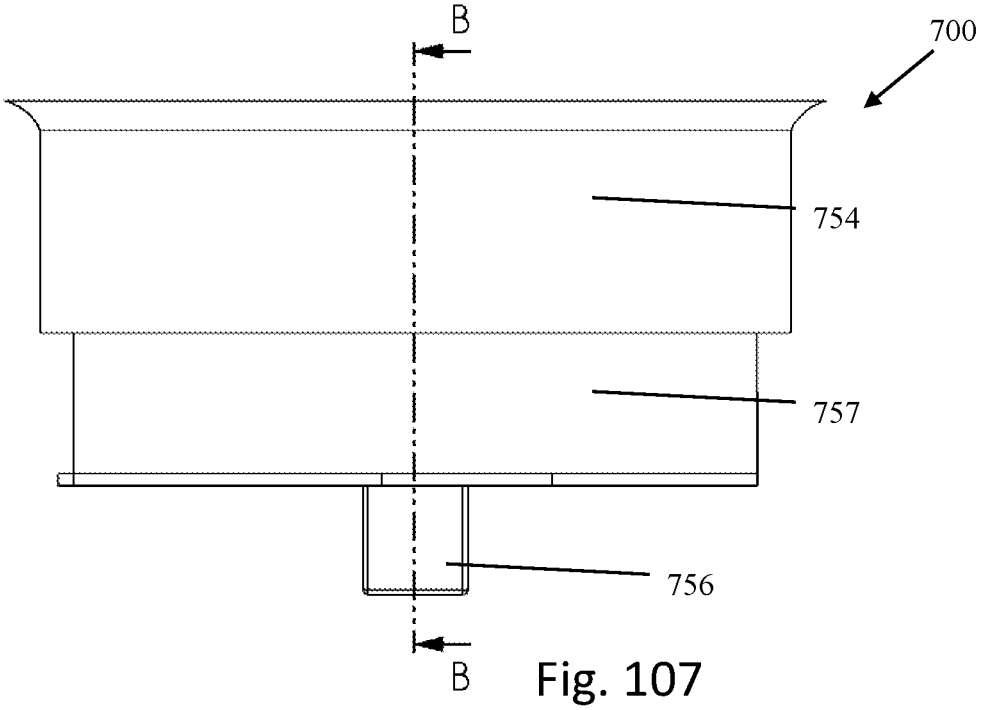
FIG. 107 is a view similar to FIG. 104, but with the basket pulled down to compress the spring.
Figure 108:
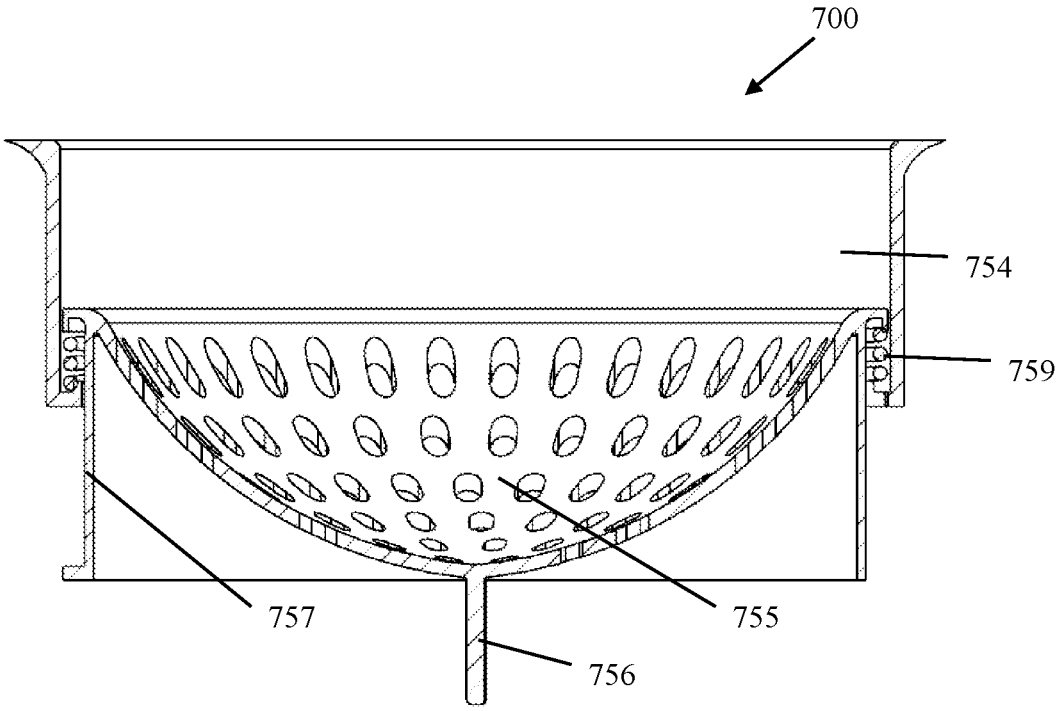
FIG. 108 is a sectional view taken along line B-B of FIG. 107.

This arrangement enables basket 755 and vertical wall 757 to be manually pulled by the pull tab 756 which when pulled compresses the spring 759. In the use or rest position where the drain strainer 700 sits in the drain flange, the compression spring 759 is at a relaxed or slightly compressed state as shown in FIGS. 103-106. To eject the contents in the drain strainer 700, the user first lifts the drain strainer 700 out of the drain flange and pulls the pull tab 756. This action draws the basket 755 and vertical wall 757 downwardly or downstream along a longitudinal axis 740 (FIG. 105) of the drain strainer 700 and compresses the spring 759 to a potential energy state as shown in FIGS. 107 and 108. Once the user is ready, the user may release the pull tab 756, by which the compression spring 759 converts potential energy to kinetic energy and immediately moves the vertical wall 757 and basket 755 upward or upstream, which creates momentum in the basket 755 and ejects the contents within the basket 755.

Figure 109:
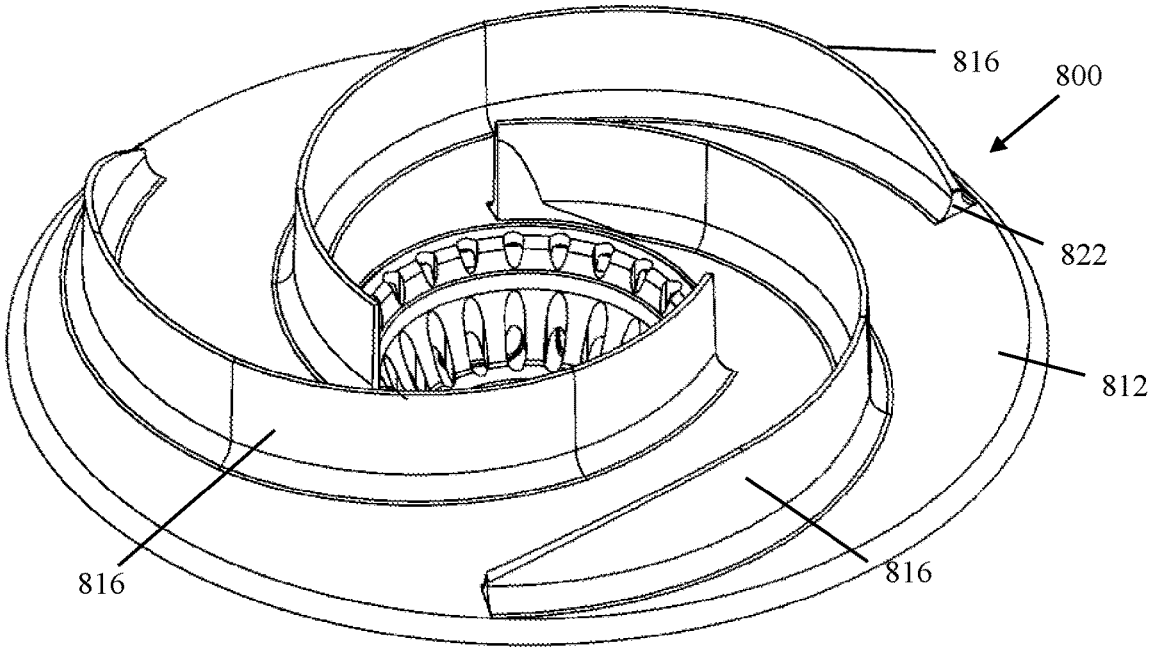
FIG. 109 is a top perspective view of a drain strainer according to another embodiment of the present invention.
Figure 110:
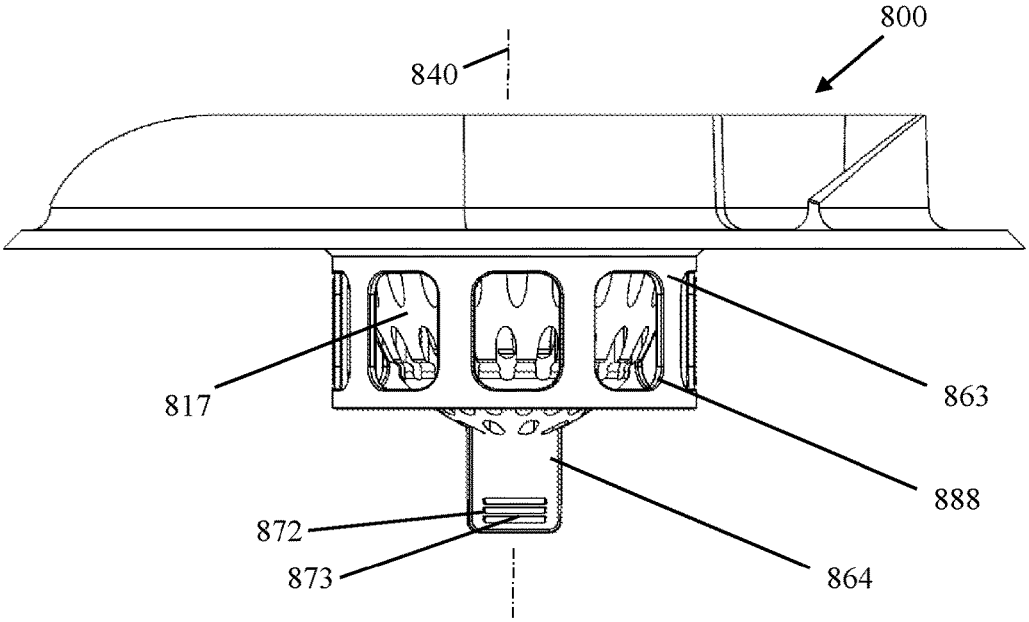
FIG. 110 is a side view of the drain strainer of FIG. 109.
Figure 111:
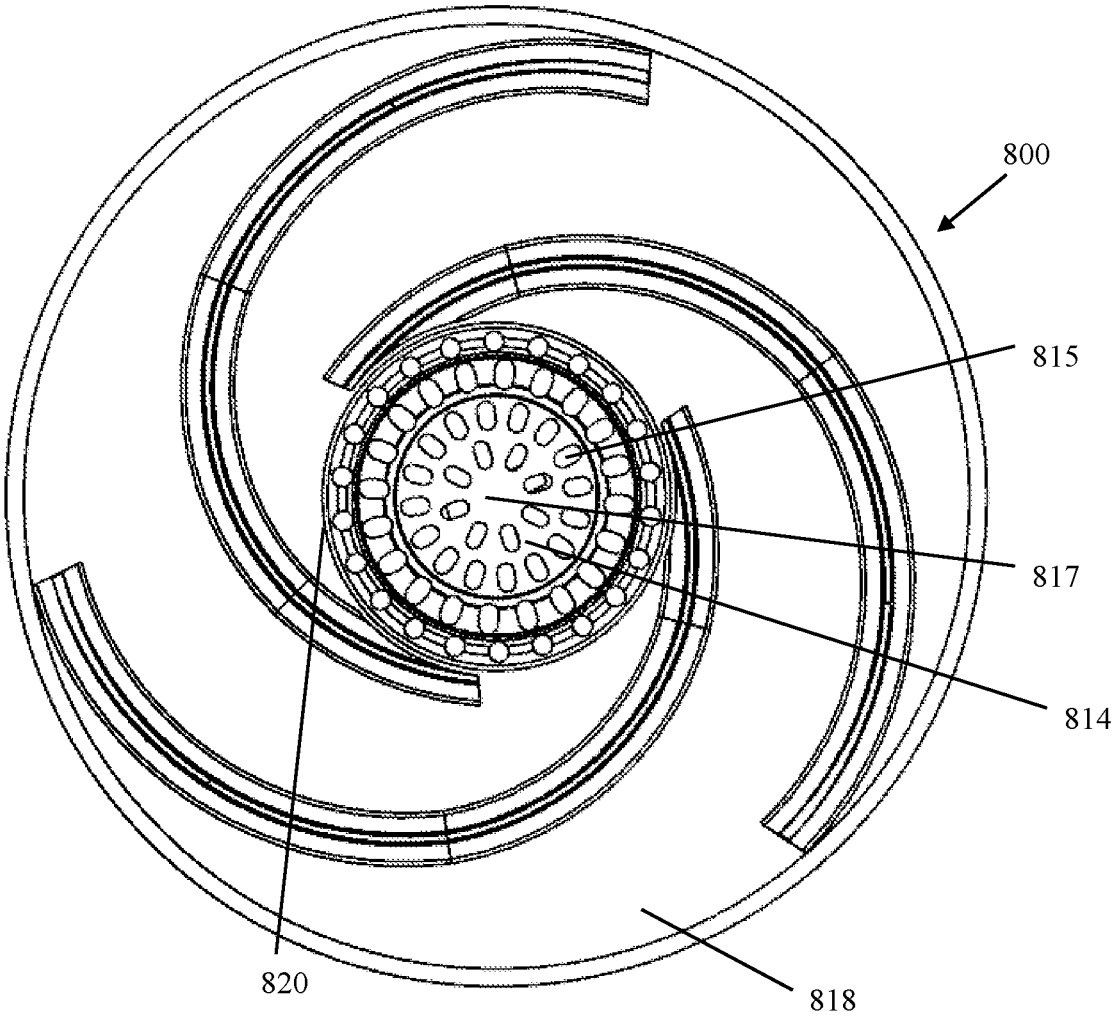
FIG. 111 is a top view of the drain strainer of FIG. 109.
Figure 112:
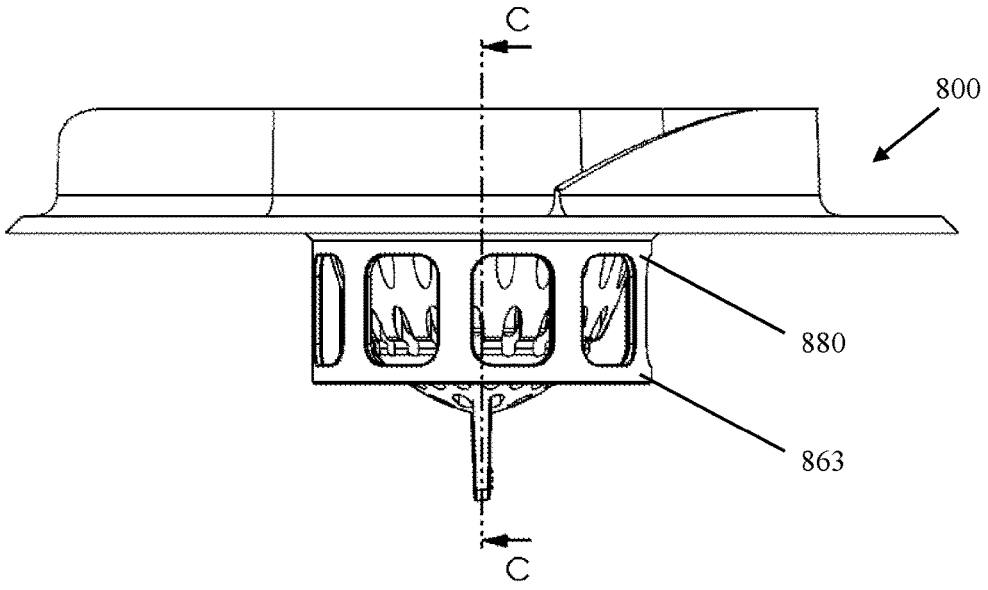
FIG. 112 is another side view of the drain strainer of FIG. 109.
Figure 113:
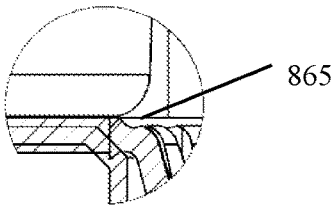
FIG. 113 is an enlarged part surrounded by circle E of FIG. 115.
Figure 114:
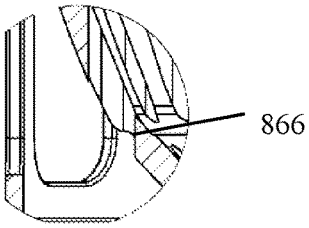
FIG. 114 is an enlarged part surrounded by circle D of FIG. 115.
Figure 115:
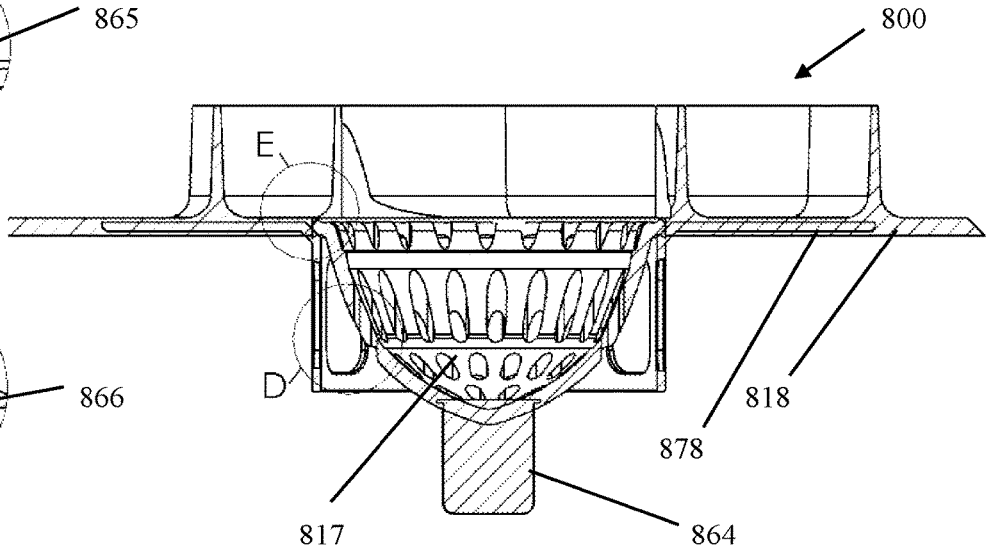
FIG. 115 is a sectional view taken along line C-C of FIG. 112.

FIGS. 109-117 show another embodiment of the drain strainer 800. Referring to FIGS. 109 and 111, the drain strainer 800 comprises a circular base flange 812 that sits in the base of a tub, shower, or other liquid storage container in a rest position. The base flange 812 is relatively flat at an outer diameter of the base flange 812, and then transitions to a depressed central common area or cavity 814 that is defined by a basket 817 with perforations 815 within the basket 817. The drain strainer 800 further comprises three upwardly vertical protrusions 816 that originate near the outer diameter or edge 818 of the base flange 812 and spiral or curve in towards the center to the outer edge 820 of the cavity 814. Each protrusion 816 is c-shaped and has a base 822 that mounts or is formed on the base flange 812 and tapers a partial distance going upwardly from the bottom side of the protrusion 816. The base flange 812 is made of a soft, rubber-like material with an approximate outside diameter of 4" but may also feature other variations of this dimension. Inset a bit from the outer diameter or edge 818 of the base flange 812, the three vertical protrusions 816 begin an incline to their full height in a spiral fashion towards a central longitudinal axis 840 (FIG. 110) of the drain strainer 800 and stop around 1.75" from the axis but may also feature other variations of this dimension. At this approximate dimension, the base flange 812 transitions into the central common area or cavity 814.

As seen in FIG. 110, the drain strainer may comprise a grip collar 863 that is attached to and depends downwardly from the base flange 812. The grip collar 863 includes a collar flange 878 (FIG. 115) and a vertical wall 880 that is formed with the collar flange 878 and depends downwardly from the collar flange 878. The grip collar 863 may include lateral openings 888 around the circumference of the grip collar 863 to help facilitate water flow in a tight area, such as a shower drain flange. The drain strainer 800 further comprises a pull tab 864 formed on the bottom surface of the basket 817 that depends downwardly from the basket 817. The pull tab 864 may include grip elements in the form of ridges 872 near its distal end that form a grip area 873.

Figure 116:
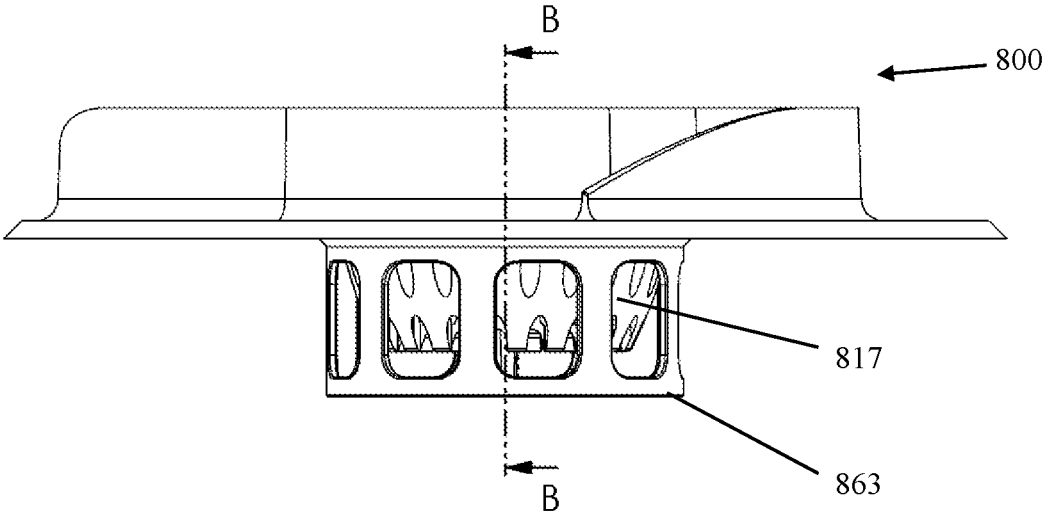
FIG. 116 is a view similar to FIG. 112, but with the bottom of the basket being inverted.
Figure 117:
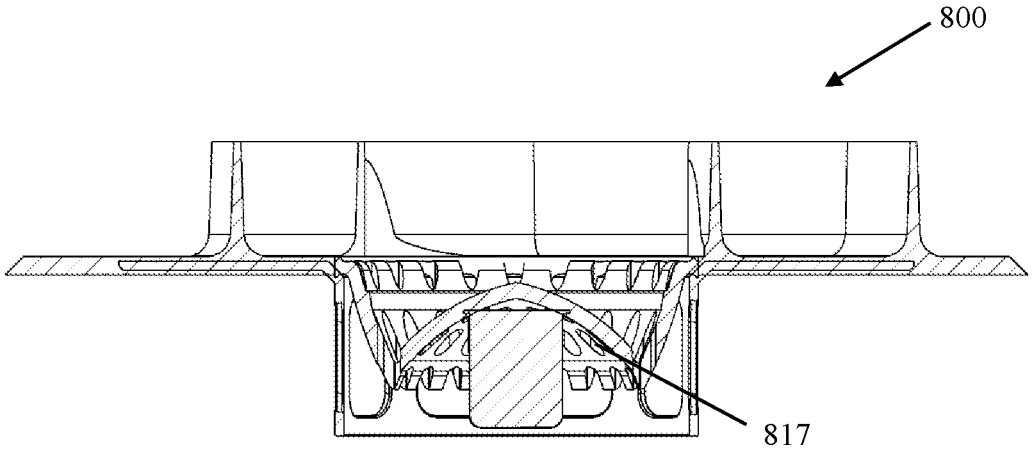
FIG. 117 is a sectional view taken along line B-B of FIG. 116.

The top flange 812 and the basket 817 are made of a silicone or a Thermoplastic elastomers (TPE) type of material that has flexibility. The strainer flange 812 is overmolded over the grip collar 863 in an inverted/ejected position. The soft, rubber-like material of the central basket 817 allows the basket 817 to be stretched and when the pull tab 864 on the bottom of the basket 817 is pulled along the longitudinal axis 840, the basket 817 stretches and stores potential energy. Upon release of the pull tab 864, the potential energy is converted to kinetic energy and propels the contents within the cavity 814 outward. This unique feature allows a user to aim and discharge the contents within the central cavity 814 in a quick, efficient motion without touching the contents within the cavity 814. Referring to FIGS. 112-115, the drain strainer 800 also includes living hinges 865 and 866 to help facilitate inversion characteristics. Living hinge 865 is located at the junction of the strainer flange 812 and basket 817 and helps to invert the basket 817 from manufacturing mode to sell/use mode. The second living hinge 866 is located in the basket near the pull tab 864 and allows the pull tab 864 and center of the basket 817 to partially invert if the pull tab 864 strikes the bottom of the drain flange as illustrated in FIGS. 116 and 117.

Figure 118:
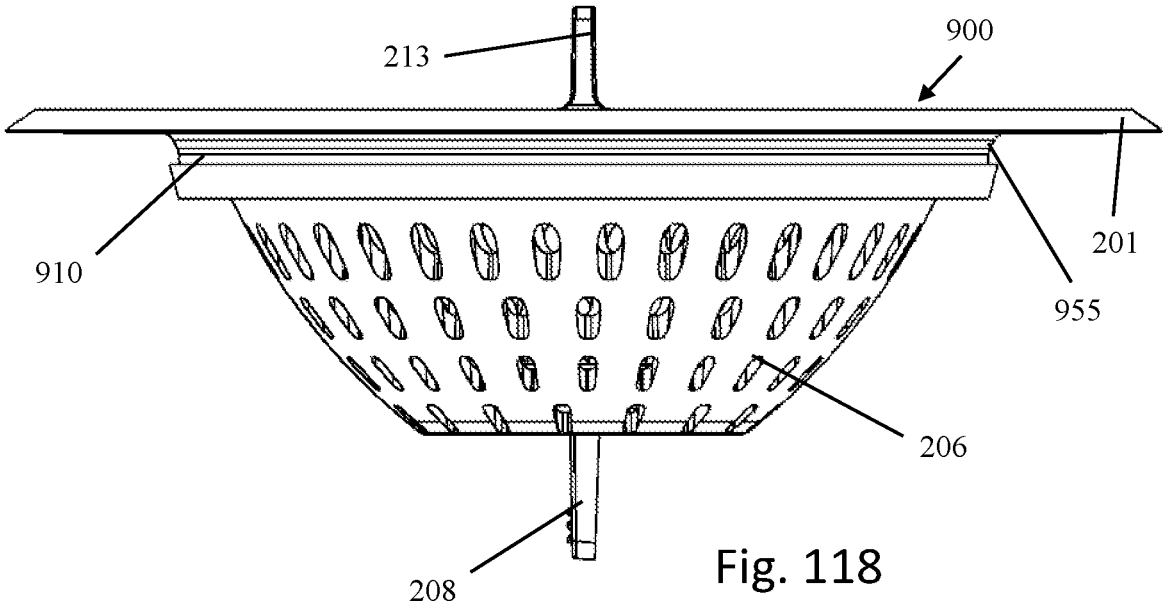
FIG. 118 is a side view of a drain strainer with the grip collar removed for illustrative purposes according to another embodiment of the present invention.
Figure 122:
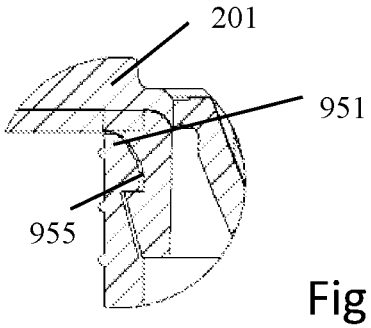
Figure 123:
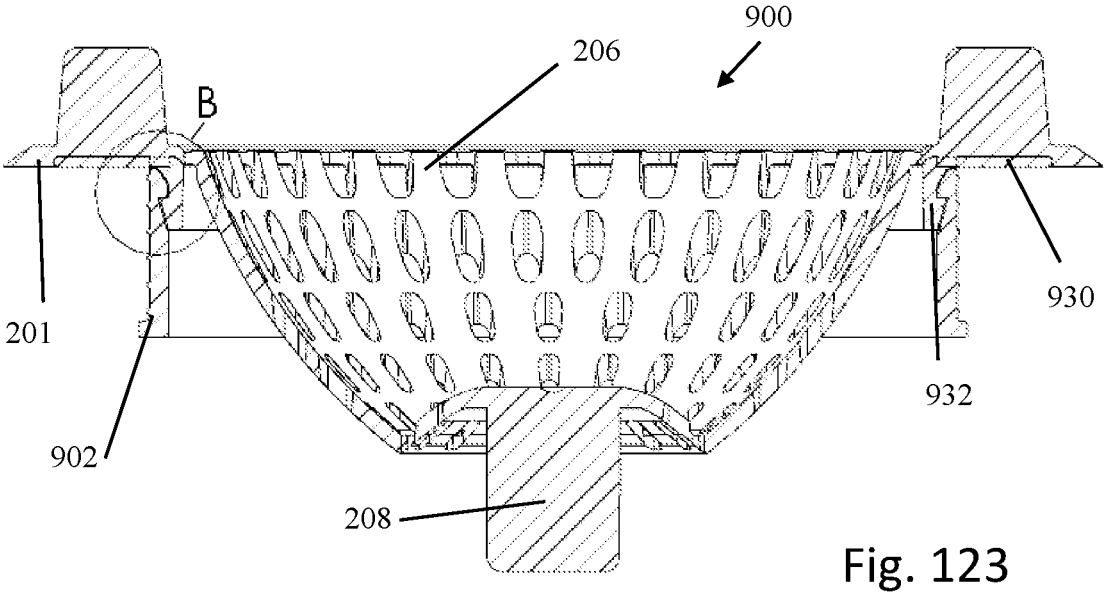

FIGS. 118-123 shows another embodiment of a drain strainer 900 that has a grip collar 902 that is a separate piece and can be snapped connected to a reinforcement collar 910 of the drain strainer 900. This embodiment is similar to that shown in FIGS. 51-69 except for the following. In this embodiment, the reinforcement collar 910 would be shorter in height than the reinforcement collar 210 of the embodiment shown in FIGS. 51-69. The reinforcement collar 910 includes a flat collar flange 930 and a tubular collar body 932 as shown in FIGS. 118 and 123. The reinforcement collar 910 also includes an outer annular groove 955 formed in the outer surface of the tubular collar body 932 and extending circumferentially around the tubular collar body 932. The tubular collar body 932 extends downwardly from the flat collar flange 930. The flexible material of the strainer flange, such as silicone or a thermoplastic elastomer, may be molded over the outside and top of the collar flange 930.

Figure 119:
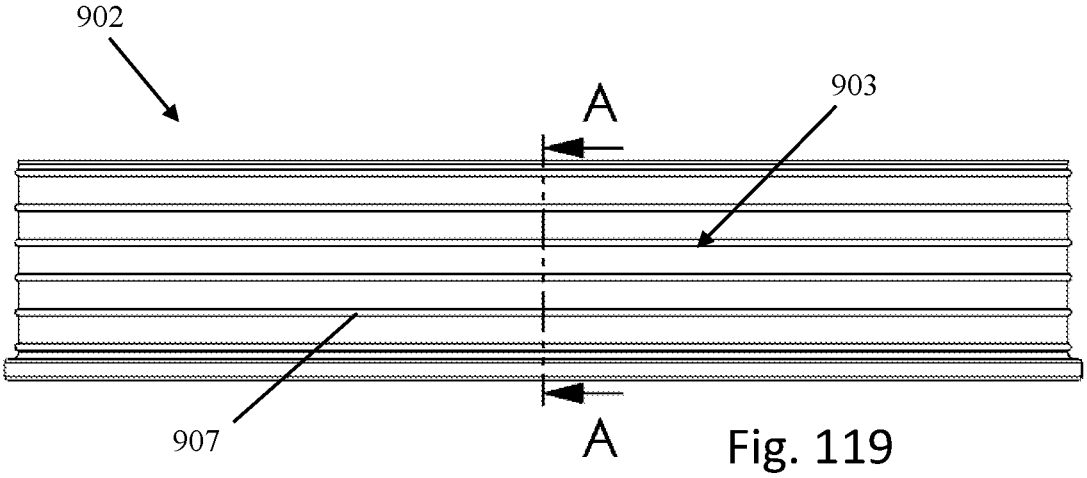
Figure 120:
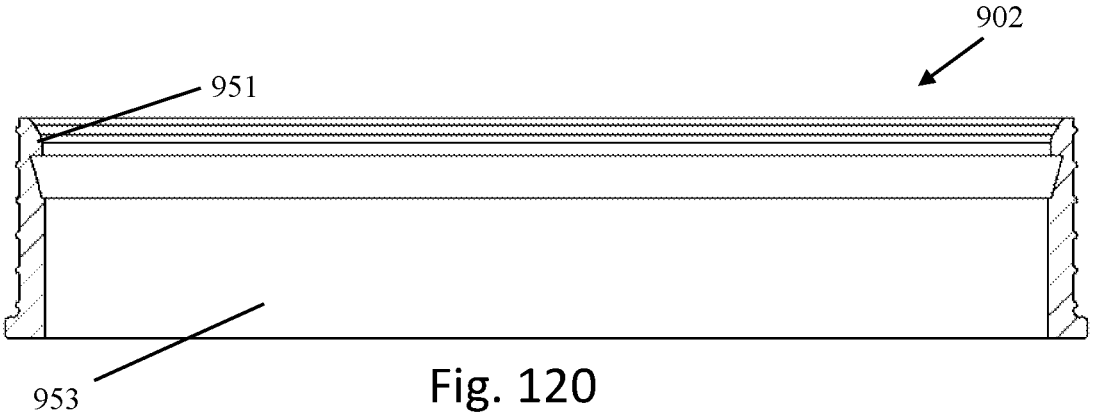
Figure 121:
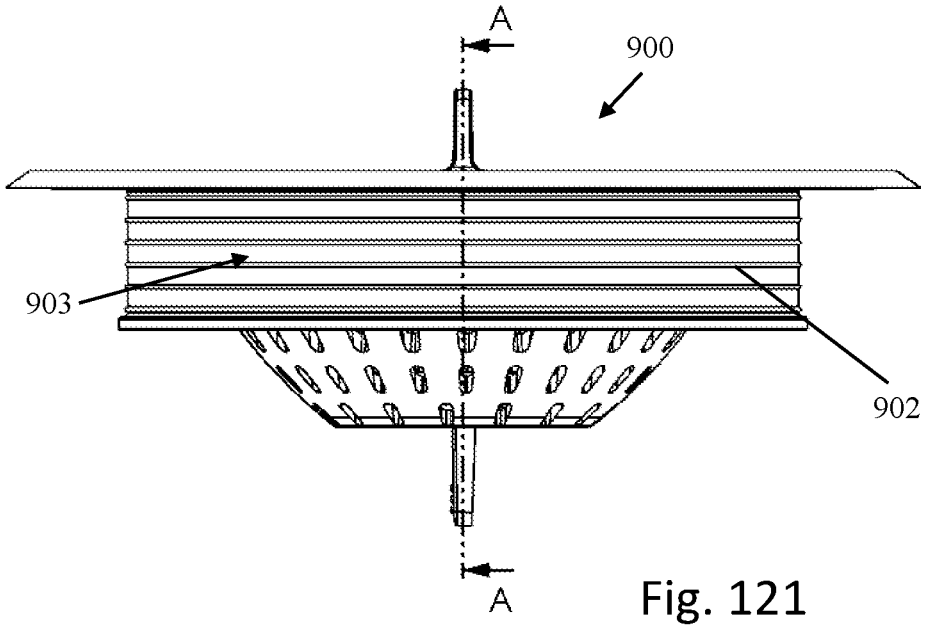

The grip collar 902 is a piece that is molded separately from the strainer flange 201, basket 206, and reinforcement collar 910 as illustrated in FIGS. 119 and 120. The grip collar 902 could be a solid rigid component or over-molded with a soft texture material like silicone or TPE. The grip collar 902 is tubular and is vertically oriented or near vertically oriented. As illustrated in FIGS. 119-123, the grip collar 902 has an outer surface that includes grip elements in the form of outer ridges 907 that define a grip surface 903.

The outer ridges 907 are configured to enable the grip surface 903 to be comfortably held by a user's hand and also to help prevent the user's hand from slipping off the grip surface 903 especially when the grip surface 903 is wet. Other variations may be possible to provide a comfortable, non-slip surface such as dots or other patterned protrusions or indents. In the present invention, the grip collar 902 is oriented in a circular fashion, but may take shape in other formats, such as an ellipse, square, or other variations. As seen in FIG. 120, the grip collar 902 includes an annular inner ridge 951 that extends inwardly from the inner side 953 of the grip collar 902 to define a hooklike configuration. The grip collar 902 is removably assembled on the reinforcement collar 910 such that the inner ridge 951 is snappingly received in the annular groove 955 of the reinforcement collar 910 as shown in FIGS. 122 and 123. The grip collar 902 may be flexed outwardly and/or the reinforcement collar 910 may be flexed inwardly to enable the grip collar 902 to be secured to the reinforcement collar 910 and also removed from the reinforcement collar 910. All of the other elements of this embodiment are similar in structure and function to that of the embodiment shown in FIGS. 51-69. Thus, in the interest of brevity similar reference numbers are used to refer to elements that are similar in structure and function.

The disclosed device is unique in that it is structurally different from other known devices or solutions. For example, the device is unique at least due to the presence of: (1) vertical protrusions, spiral or slanted in nature, incorporated into the base flange for inducing water vortex flow. (2) A basket having a central common area or cavity with the ability to stretch, so as to be pulled or twisted or pinched in order to change its shape and store potential energy thereby which can be released. (3) A basket having a central common area or cavity with the ability to propel or eject waste outward and away from itself by means of restoring itself to its natural state after being released from a potential energy mode. (4) A pull tab or other way for the user to pull the basket into stretched position. (5) Lock elements that can secure a basket in a potential energy state whereby it can be released later in a kinetic energy state. (6) A basket having a central common area or cavity that is moved to compress a spring to a compressed position to preload a drain strainer to the potential energy state and then upon release of the spring from the compressed position releases, the potential energy of the drain strainer is converted to kinetic energy to eject the debris from the basket. It should be noted that the above-mentioned examples as to how the device is unique is not limited to those above-mentioned examples.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above-described embodiments, method, and examples, but by all embodiments and methods within the scope and spirit of the invention.

What is claimed is:

1. A drain strainer comprising:

a basket, wherein the basket defines a central cavity, wherein the basket comprises perforations that are sized to enable liquid to drain through the basket while debris is collected in the basket, wherein the drain strainer is configured to be preloaded to a potential energy state and upon the drain strainer being released from the potential energy state the potential energy converts to kinetic energy that is sufficient to eject the debris from the basket, wherein the basket is configured to be stretched to a stretched position in a downstream direction and then released to eject the debris from the basket; and a pull tab, wherein the pull tab is attached to and extends externally away in the downstream direction from an underside of the basket, wherein the length of the pull tab is greater than the width of the pull tab, wherein the pull tab is operative to enable a user to grasp the pull tab to pull the basket downstream and stretch the basket to the stretched position.

2. The drain strainer of claim 1, wherein the pull tab comprises a flat planar surface that is parallel with a longitudinal axis of the drain strainer.

3. The drain strainer of claim 1 further comprising a holder, wherein the holder surrounds the basket, wherein the holder is in operative connection with the basket, wherein the holder is configured to enable a user to hold the holder and stretch the basket to the stretched position.

4. The drain strainer of claim 3, wherein the holder includes ridges, wherein the ridges define a grip surface for helping a user grip the holder and hold the basket in the stretched position.

5. The drain strainer of claim 3 further comprising a reinforcement collar, wherein the reinforcement collar surrounds the basket, wherein the holder is tubular, wherein the reinforcement collar is attached to the underside of the strainer flange and an inner side of the holder.

6. The drain strainer of claim 5 further comprising a strainer flange, wherein the strainer flange is in operative connection with the holder, wherein the basket is configured to be moved relative to the strainer flange, wherein the strainer flange is made of an elastic material, wherein strainer flange is over-molded over the reinforcement collar with the elastic material.

7. The drain strainer of claim 1, wherein the basket includes a bottom wall, wherein the bottom wall of the basket projects upwardly to define a recess formed on the underside of the basket, wherein the pull tab is integrally formed in one piece with the bottom wall at the recess.

8. The drain strainer of claim 1 further comprising a strainer flange, wherein the strainer flange is in operative connection with the basket, wherein the basket is configured to be moved relative to the strainer flange.

9. The drain strainer of claim 8 further comprising lift out tabs, wherein the lift out tabs are attached to the strainer flange and extend upwardly from the strainer flange.

10. The drain strainer of claim 9, wherein the lift out tabs curve as the lift out tabs extend upwardly to define finger and thumb holders.

11. The drain strainer of claim 8, further comprising a holder, wherein the holder is in operative connection with the strainer flange, wherein the holder is configured to enable a user to grasp the holder with one hand and move the basket relative to the holder with the other hand to the stretched position.

12. The drain strainer of claim 11, wherein the holder includes ridges, wherein the ridges define a grip surface for helping a user grip the holder.

13. The drain strainer of claim 11 further comprising a lock apparatus, wherein the lock apparatus is attached to the holder and operatively connected with the basket, wherein the lock apparatus is operative to lock the basket in the stretched position, wherein the lock apparatus is operative to unlock and release the basket from the stretched position when the holder is grasped by the hand of the user and squeezed inwardly to eject the debris from the basket.

14. The drain strainer of claim 8 further comprising a first living hinge, wherein the first living hinge is formed at the junction of the basket and the strainer flange, wherein the basket comprises a side wall, wherein the first living hinge has a thickness that is less than a thickness of the side wall of the basket, wherein the first living hinge is configured to enable the basket to invert and extend upwardly relative to the basket beyond the strainer flange to a manufacturing position and then uninvert and extend downwardly relative to the basket beyond the strainer flange to an operative position.

15. The drain strainer of claim 14 further comprising a second living hinge, wherein the basket comprises a bottom wall, wherein the bottom wall of the basket projects upwardly to define a recess formed on the underside of the basket, wherein the second living hinge has a thickness that is less than a thickness of either the side wall or the bottom wall, wherein the second living hinge is formed at the junction of the side wall and the bottom wall of the basket, wherein the second living hinge is configured to keep the bottom wall of the basket projecting upwardly when the basket is in the operative position.

16. The drain strainer of claim 8 further comprising a living hinge, wherein the basket comprises a side wall and a bottom wall, wherein the bottom wall of the basket projects upwardly to define a recess formed on the underside of the basket, wherein the living hinge is formed at the junction of the side wall and the bottom wall of the basket, wherein the living hinge has a thickness that is less than a thickness of either the side wall or the bottom wall, wherein the living hinge is configured to keep the bottom wall of the basket projecting upwardly when the basket is not stretched.

17. The drain strainer of claim 1, wherein the pull tab is attached to and extends externally away in the downstream direction from an underside of the basket when the strainer is in a noninverted operational mode position that enables the strainer to be placed in the drain to allow liquid to flow through the basket while debris is collected in the basket.

18. The drain strainer of claim 1, wherein the basket is molded with a flexible and elastic material that has sufficient elasticity to enable the basket to be stretched to the stretched position and then released to eject the debris from the basket.

19. The drainer strainer of claim 1, wherein the pull tab is attached to an underside of the basket, wherein the underside of the basket is opposite a side from which debris is collected.

20. A drain strainer comprising:

a basket, wherein the basket defines a central cavity, wherein the basket comprises perforations that are sized to enable liquid to drain through the basket while debris is collected in the basket; and a biasing member, wherein the biasing member is in operative connection with the basket, wherein the basket is configured to be moved to urge the biasing member to a biased position and then released to release the biasing member from the biased position to eject the debris from the basket.

21. The drain strainer of claim 20, wherein the biasing member comprises a spring, wherein the spring is in operative connection with the basket, wherein basket is configured to be moved to compress the spring to a compressed position and then released to release the spring from the compressed position.

22. A drain strainer comprising:

a basket, wherein the basket defines a central cavity, wherein the basket comprises perforations that are sized to enable liquid to drain through the basket while debris is collected in the basket, wherein the drain strainer is configured to be in a potential energy state and upon the drain strainer being released from the potential energy state the potential energy converts to kinetic energy that is sufficient to eject the debris from the basket; and a lock apparatus, wherein the lock apparatus is configured to lock the drain strainer in the potential energy state wherein the lock apparatus is configured to unlock and release the drain strainer from the potential energy state such that the potential energy converts to kinetic energy that is sufficient to eject the debris from the basket.

23. A drain strainer comprising:

a basket, wherein the basket comprises perforations that are sized to enable liquid to drain through the basket while debris is collected in the basket;

a strainer flange, wherein the strainer flange is in operative connection with the basket, wherein the basket is configured to be moved relative to the strainer flange; and a holder, wherein the holder is in operative connection with the basket, wherein the holder extends downwardly from the strainer flange and surrounds the basket, wherein the holder is configured to enable a user to grasp the holder with one hand and move the basket relative to the holder with the other hand from a first position to a second position such that the second position is downstream of the first position, wherein the movement between the first position and second position creates a potential energy state, wherein the release from the second position back to the first position creates an energy conversion from potential to kinetic energy wherein kinetic movement is derived from the energy conversion which moves the basket upstream and forcefully ejects debris collected in the basket, wherein the holder is located radially inward from the strainer flange with respect to a longitudinal axis of the strainer.

24. The drain strainer of claim 23 further comprising lift out tabs, wherein the lift out tabs are attached to the strainer flange and extend upwardly from the strainer flange.

25. The drain strainer of claim 24, wherein the lift out tabs curve as the lift out tabs extend upwardly to define finger and thumb holders.

26. The drain strainer of 24 further comprising a reinforcement collar, wherein the reinforcement collar surrounds the basket, wherein the holder is tubular, wherein the reinforcement collar is attached to the underside of the strainer flange and an inner side of the holder.

27. The drain strainer of claim 26, wherein the strainer flange is made of an elastic material, wherein strainer flange is over-molded over the reinforcement collar with the elastic material.

28. The drain strainer of claim 23, wherein the holder includes ridges, wherein the ridges define a grip surface for helping a user grip the holder.

29. The drain strainer of claim 23, wherein the basket includes a bottom wall, wherein the holder extends downwardly to a position that is closer to the bottom wall of the basket than the strainer flange.

30. The drain strainer of claim 23, wherein the holder extends downwardly to a lower section of the strainer basket.

* * * * *